US011622602B2

(12) United States Patent
Redon et al.

(10) Patent No.: US 11,622,602 B2
(45) Date of Patent: Apr. 11, 2023

(54) ARTICLE OF FOOTWEAR HAVING A SOLE PLATE

(71) Applicant: PUMA SE, Herzogenaurach (DE)

(72) Inventors: Arnaud Redon, Nuremberg (DE); Romain Girard, Lauf an der Pegnitz (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 17/404,388

(22) Filed: Aug. 17, 2021

(65) Prior Publication Data

US 2022/0053879 A1 Feb. 24, 2022

Related U.S. Application Data

(60) Provisional application No. 63/067,073, filed on Aug. 18, 2020.

(51) Int. Cl.
*A43B 13/18* (2006.01)
*A43B 13/04* (2006.01)

(52) U.S. Cl.
CPC ..... *A43B 13/186* (2013.01); *A43B 13/04* (2013.01)

(58) Field of Classification Search
None
See application file for complete search history.

(56) References Cited

U.S. PATENT DOCUMENTS 4,020,569 A 5/1977 Fukuoka
4,542,598 A 9/1985 Misevich et al.
5,052,130 A 10/1991 Barry et al.
5,191,727 A 3/1993 Barry et al.
(Continued)

FOREIGN PATENT DOCUMENTS

CN 111213958 A 6/2020
CN 212014663 U 11/2020
(Continued)

OTHER PUBLICATIONS

Good Luck Trainer, ToryBurch.com, [online], [site visited Apr. 11, 2022]. <URL: https://www.toryburch.com/en-eu/shoes/sneakers/good-luck-trainer/85463.html. (Year: 2022).
(Continued)

*Primary Examiner* — Jila M Mohandesi
(74) *Attorney, Agent, or Firm* — Quarles & Brady LLP

(57) ABSTRACT

An article of footwear having a sole structure and an upper, the sole structure includes an outsole with a ground-engaging surface, a first cushioning member disposed between the outsole and the upper in a heel region of the sole structure, a second cushioning member disposed between the outsole and the upper in a forefoot region of the sole structure, and a sole plate having a rear portion and a curved portion that includes an anterior curved portion and a posterior curved portion. Additionally, the anterior curved portion is disposed proximate the second cushioning member, a portion of the posterior curved portion spans between the first cushioning member and the second cushioning member, and the rear portion is disposed between the first cushioning member and the upper. Further, the ground-engaging surface is not continuous along a midfoot region of the article of footwear.

20 Claims, 41 Drawing Sheets

(56) References Cited

U.S. PATENT DOCUMENTS

| | | | | |
|---|---|---|---|---|
| 5,315,769 | A | 5/1994 | Barry et al. | |
| 5,528,842 | A * | 6/1996 | Ricci | A43B 21/30 36/38 |
| 6,389,713 | B1 * | 5/2002 | Kita | A43B 13/18 36/31 |
| D466,272 | S | 12/2002 | Erickson et al. | |
| D472,038 | S | 3/2003 | Meynard | |
| D481,200 | S | 10/2003 | Belley et al. | |
| 6,662,469 | B2 * | 12/2003 | Belley | A43B 13/16 36/19 R |
| D489,880 | S | 5/2004 | McClaskie | |
| 6,920,705 | B2 | 7/2005 | Lucas et al. | |
| 7,401,422 | B1 | 7/2008 | Scholz et al. | |
| 7,484,317 | B2 | 2/2009 | Kita et al. | |
| 7,513,065 | B2 | 4/2009 | Kita et al. | |
| 7,624,515 | B2 | 12/2009 | Kita et al. | |
| 7,987,618 | B2 | 8/2011 | Nishiwaki et al. | |
| 8,074,377 | B2 | 12/2011 | Nishiwaki et al. | |
| 8,112,909 | B2 * | 2/2012 | Kubo | A43B 13/10 36/107 |
| 8,387,279 | B2 * | 3/2013 | Pauk | A43B 13/122 36/27 |
| 8,393,028 | B2 | 3/2013 | Namkook et al. | |
| 8,418,379 | B2 * | 4/2013 | Nishiwaki | A43B 13/181 36/28 |
| D707,432 | S | 6/2014 | Mochen et al. | |
| 9,572,398 | B2 | 2/2017 | Hurd et al. | |
| D783,960 | S | 4/2017 | Hatfield | |
| 10,010,137 | B2 | 7/2018 | Foxen | |
| 10,226,097 | B2 | 3/2019 | Farris et al. | |
| 10,299,535 | B2 | 5/2019 | Hurd et al. | |
| D854,293 | S | 7/2019 | Mokos et al. | |
| D864,530 | S | 10/2019 | Verfl et al. | |
| 10,448,701 | B2 | 10/2019 | Farris et al. | |
| D866,146 | S | 11/2019 | Cass et al. | |
| 10,524,536 | B2 | 1/2020 | Bunnell et al. | |
| D878,026 | S | 3/2020 | Nikolic | |
| D879,437 | S | 3/2020 | Brosseau et al. | |
| D879,438 | S | 3/2020 | Brosseau et al. | |
| D885,729 | S | 6/2020 | Swierszczyk et al. | |
| D893,140 | S | 8/2020 | Felloni et al. | |
| D893,144 | S | 8/2020 | Sfredda et al. | |
| D895,244 | S | 9/2020 | Felloni et al. | |
| D897,082 | S | 9/2020 | Belforti | |
| 10,765,172 | B2 | 9/2020 | Foxen | |
| D899,038 | S | 10/2020 | Thompson | |
| D900,458 | S | 11/2020 | Swierszczyk et al. | |
| D905,391 | S | 12/2020 | Papp | |
| D905,938 | S | 12/2020 | Sfredda et al. | |
| D907,342 | S | 1/2021 | Odinot et al. | |
| D917,137 | S | 4/2021 | Carson | |
| D918,548 | S | 5/2021 | Bracalente | |
| D919,261 | S | 5/2021 | Brosseau et al. | |
| D919,262 | S | 5/2021 | Brosseau et al. | |
| D923,925 | S | 7/2021 | Bramani | |
| D937,549 | S | 12/2021 | Della Valle et al. | |
| D938,155 | S | 12/2021 | Nikolic | |
| D943,883 | S | 2/2022 | Bertelli | |
| D945,138 | S | 3/2022 | Mitchell et al. | |
| 2003/0079374 | A1 * | 5/2003 | Belley | A43B 9/10 36/19 R |
| 2006/0137228 | A1 | 6/2006 | Kubo et al. | |
| 2007/0101617 | A1 | 5/2007 | Brewer et al. | |
| 2008/0052965 | A1 | 3/2008 | Sato | |
| 2010/0218397 | A1 | 9/2010 | Nishiwaki et al. | |
| 2011/0203137 | A1 | 8/2011 | Long | |
| 2016/0029741 | A1 * | 2/2016 | Foxen | A43B 13/42 36/103 |
| 2016/0073734 | A1 | 3/2016 | Grabber et al. | |
| 2017/0035143 | A1 | 2/2017 | Sato et al. | |
| 2017/0079376 | A1 | 3/2017 | Bunnell et al. | |
| 2018/0271215 | A1 | 9/2018 | Foxen | |
| 2020/0008519 | A1 | 1/2020 | Farris et al. | |
| 2020/0100564 | A1 | 4/2020 | Bunnell et al. | |
| 2020/0100565 | A1 | 4/2020 | Yoshida et al. | |
| 2022/0053879 | A1 | 2/2022 | Redon et al. | |
| 2022/0225729 | A1 * | 7/2022 | Bonin | A43B 13/185 |

FOREIGN PATENT DOCUMENTS

| | | | |
|---|---|---|---|
| DE | 4137350 | A1 | 5/1993 |
| DE | 202013003797 | U1 | 7/2013 |
| EP | 1346655 | B1 | 8/2006 |
| EP | 1894484 | B1 | 3/2018 |
| EP | 2911542 | B1 | 12/2018 |
| EP | 3434132 | A1 | 1/2019 |
| EP | 3174419 | B1 | 7/2019 |
| EP | 3574791 | A1 | 12/2019 |
| EP | 3316719 | B1 | 5/2020 |
| EP | 3316721 | B1 | 5/2020 |
| KR | 101057729 | B1 | 8/2011 |
| KR | 20190075138 | A | 6/2019 |
| WO | 1995003719 | A1 | 2/1995 |
| WO | 2011050720 | A1 | 5/2011 |
| WO | 2012115343 | A1 | 8/2012 |
| WO | 2017048934 | A1 | 3/2017 |
| WO | 2017048937 | A1 | 3/2017 |
| WO | 2017048938 | A1 | 3/2017 |
| WO | 2017048939 | A1 | 3/2017 |

OTHER PUBLICATIONS

Beau Today Women's Chink Sneakers Platform Das Shoes for Women, Ubuy.com, [online], site visited Apr. 11, 2022]. <URL: https://www.ubuy.com.tr/en/product/1IZIAHXK8-beau-today-women-s chunky-sneakers-platform-dad-shoes-for-women-beige-brown-us-6-5> (Year: 2022).

International Search Report and the Written Opinion of the International Searching Authority from corresponding PCT Application No. PCT/IB2021/057602 dated Nov. 12, 2021 (14 pages).

* cited by examiner

ARTICLE OF FOOTWEAR HAVING A SOLE PLATE

CROSS REFERENCE TO RELATED APPLICATIONS

This patent application claims the benefit of U.S. Provisional Patent Application 63/067,073, filed on Aug. 18, 2020, the entire contents of which is hereby incorporated by reference, for any and all purposes.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear including a sole plate.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole attaches to a lower surface or boundary of the upper and positions itself between the upper and the ground. As a result, the sole typically provides stability and cushioning to the user when the shoe is being worn. In some instances, the sole may include multiple components, such as an outsole, a midsole, and an insole. The outsole may provide traction to a bottom surface of the sole, and the midsole may be attached to an inner surface of the outsole, and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper of many shoes may comprise a wide variety of materials, which may be utilized to form the upper and chosen for use based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

However, in many cases, articles of footwear having uppers with an increased comfort and better fit are desired, along with soles having improved cushioning systems or structural characteristics such as a sole plate to add rigidity or spring-like properties.

SUMMARY

An article of footwear, as described herein, may have various configurations. The article of footwear may have an upper and a sole structure connected to the upper.

In some embodiments, the present disclosure provides a sole structure for an article of footwear. The sole structure includes an outsole having a ground-engaging surface. Further, the sole structure includes a first cushioning member extending through a forefoot region, a midfoot region, and a heel region of the sole structure; a second cushioning member disposed between the outsole and the first cushioning member in the forefoot region of the sole structure; and a sole plate having a first portion disposed between the outsole and the second cushioning member, and a second portion disposed between the second cushioning member and the first cushioning member. Additionally, the ground-engaging surface is not continuous along a midfoot region of the article of footwear.

In another embodiment, the sole structure includes an outsole having a ground-engaging surface; a first cushioning member extending through a forefoot region, a midfoot region, and a heel region of the sole structure; a second cushioning member disposed between the outsole and the first cushioning member in the forefoot region of the sole structure; and a sole plate having an upper flange, a lower flange, and a gap between the upper flange and the lower flange. Further, a portion of the upper flange is disposed between the outsole and the second cushioning member, and a portion of the lower flange is disposed between the second cushioning member and the first cushioning member. Additionally, the ground-engaging surface is not continuous along a midfoot region of the article of footwear.

In further embodiments, the sole structure includes an outsole having a ground-engaging surface; a first cushioning member disposed between the outsole and the upper in a heel region of the sole structure; a second cushioning member disposed between the outsole and the upper in a forefoot region of the sole structure; and a sole plate having a rear portion and a curved portion that includes an anterior curved portion and a posterior curved portion. Additionally, in this embodiment, the anterior curved portion is disposed within the second cushioning member, a portion of the posterior curved portion spans between the first cushioning member and the second cushioning member, and the rear portion is disposed between the first cushioning member and the upper. Further, the ground-engaging surface is not continuous along a midfoot region of the article of footwear.

In another embodiment, the sole structure includes an outsole having a ground-engaging surface; a first cushioning member extending through a forefoot region, a midfoot region, and a heel region of the sole structure; a second cushioning member disposed between the outsole and the first cushioning member in the forefoot region of the sole structure; and a sole plate disposed between the first cushioning member and the upper in the midfoot region of the sole structure. Further, the ground-engaging surface is not continuous along a midfoot region of the article of footwear.

Another aspect of the present disclosure is an article of footwear having a sole structure and an upper. In this embodiment, the sole structure includes an outsole having a ground-engaging surface, a first cushioning member disposed between the outsole and the upper in a heel region of the sole structure, a second cushioning member disposed between the outsole and the upper in a forefoot region of the sole structure, and a sole plate having a rear portion and a curved portion that includes an anterior curved portion and a posterior curved portion. The anterior curved portion is disposed proximate the second cushioning member, a portion of the posterior curved portion spans between the first cushioning member and the second cushioning member, and the rear portion is disposed between the first cushioning member and the upper. Additionally, the ground-engaging surface is not continuous along a midfoot region of the article of footwear.

In some further embodiments, a gap extends between the first cushioning member and the second cushioning member. Further, a portion of the midfoot region of the sole structure consists of the sole plate and the sole structure further includes a second plate. In some embodiments, the second plate includes sidewalls and the second plate encases the sole plate. Additionally, in further embodiments, the sole plate includes a plurality of raised portions and grooves, and in these embodiments, a material may be positioned within the grooves of the sole plate, such as a thermoplastic polyurethane. In other embodiments, the sole plate may be constructed from a carbon fiber and the second plate may be constructed from thermoplastic polyurethane.

Another aspect of the present disclosure provides an article of footwear having a sole structure and an upper. In this embodiment, the sole structure includes a first cushioning member positioned in a heel region of the sole structure, a second cushioning member positioned in a forefoot region of the sole structure, and a plate continuously extending from the heel region, a midfoot region, and the forefoot region of the sole structure. Additionally, a gap extends between the first cushioning member and the second cushioning member, and the plate extends between the gap.

In some embodiments, the plate may be positioned within the second cushioning member and the plate may be positioned above the first cushioning member in the heel region of the sole structure. In these embodiments, a gap extends between the plate and the upper in the midfoot region of the sole structure. Additionally, in further embodiments, the sole structure includes an outsole, a portion of the second cushioning member extends between the outsole and the plate in the forefoot region of the sole structure, and the first cushioning member extends between the plate and the outsole in the heel region of the sole structure.

In other embodiments, the plate may be positioned within the second cushioning member and may be positioned within the first cushioning member such that the plate bifurcates the second cushioning member and the first cushioning member.

In further embodiments, the sole structure includes an outsole, a portion of the first cushioning member extends between the plate and the outsole in the heel region of the sole structure, and a portion of the second cushioning member extends between the plate and the outsole in the forefoot region of the sole structure. In some embodiments, the sole structure further includes a second plate having sidewalls that encase the plate. In these embodiments, the plate can include a plurality of raised portions and grooves, and a material may be positioned within the grooves of the plate.

According to yet another aspect of the present disclosure, an article of footwear having a sole structure and an upper is also provided. In this embodiment, the sole structure includes an outsole having a ground-engaging surface; a first cushioning member disposed in a heel region of the sole structure; a second cushioning member disposed in a forefoot region of the sole structure; a first plate having a rear portion and a curved portion that includes an anterior curved portion and a posterior curved portion; and a second plate having a base and sidewalls that extend therefrom. Further, the anterior curved portion is disposed proximate the second cushioning member, a portion of the posterior curved portion spans between the first cushioning member and the second cushioning member, and the rear portion is disposed between the first cushioning member and the upper. Even further, the first plate includes a plurality of raised portions and a plurality of grooves, and a material is positioned within the grooves of the first plate.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

Figure 1:
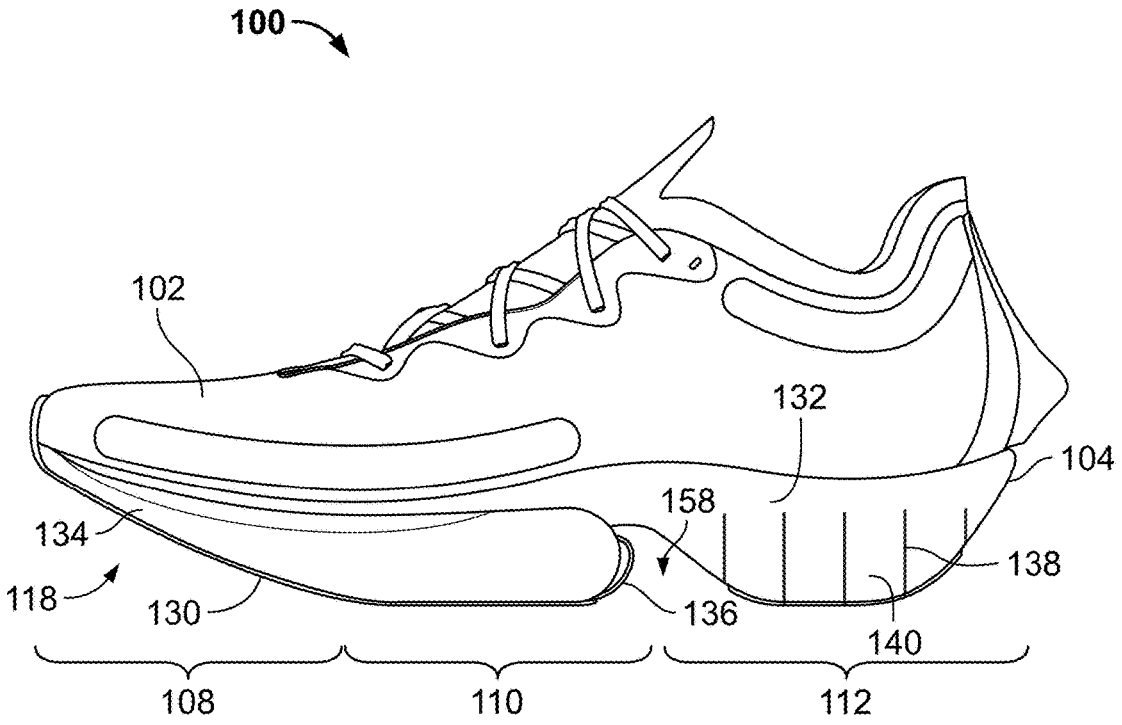
FIG. 1 is a lateral side view of an article of footwear configured as a left shoe that includes an upper and a sole structure, according to an embodiment of the disclosure.
Figure 2:
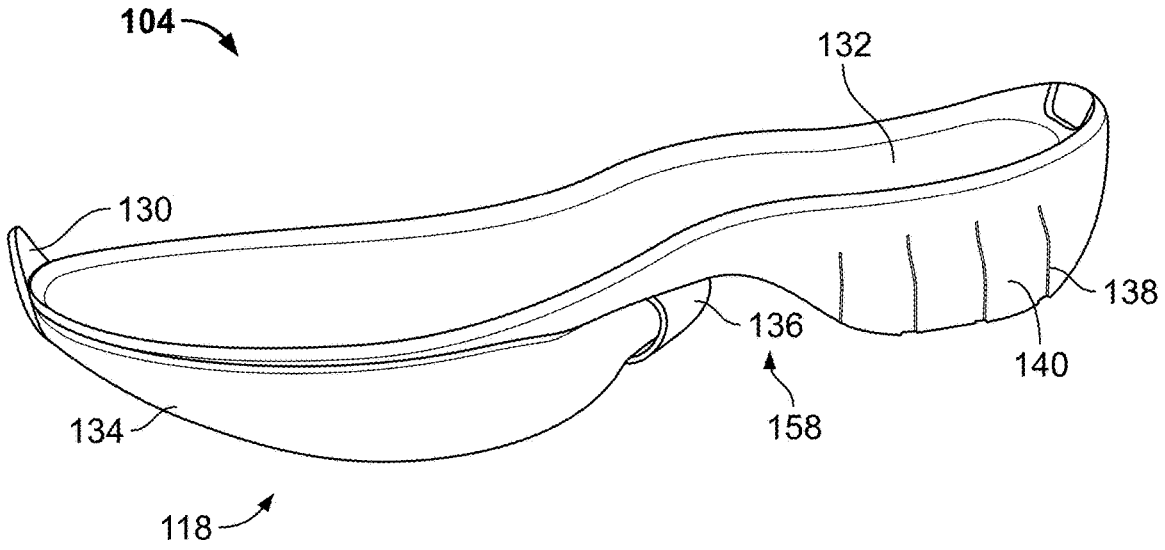
FIG. 2 is a top, lateral side view of the sole structure of the article of footwear of FIG. 1, the sole structure having a sole plate.
Figure 3:
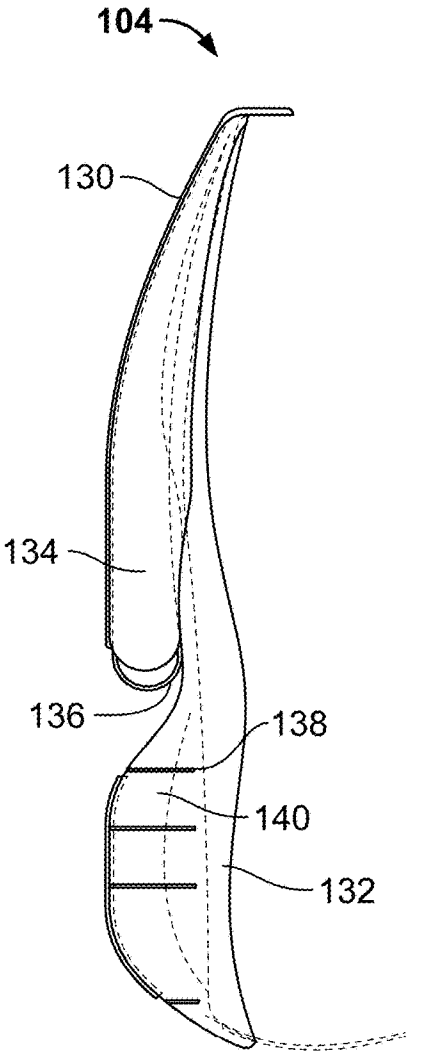
FIG. 3 is a lateral side view of the sole structure of FIG. 2.

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values±5% of the numeric value that the term precedes.

The terms "weight percent," "wt-%," "percent by weight," "% by weight," and variations thereof, as used herein, refer to the concentration of a substance or component as the weight of that substance or component divided by the total weight, for example, of the composition or of a particular component of the composition, and multiplied by 100. It is understood that, as used herein, "percent," "%," and the like may be synonymous with "weight percent" and "wt-%."

The present disclosure is directed to an article of footwear and/or specific components of the article of footwear, such as an upper and/or a sole or sole structure. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

FIGS. 1-12 depict an exemplary embodiment of an article of footwear 100 including an upper 102 and a sole structure 104. The upper 102 is attached to the sole structure 104 and together define an interior cavity into which a foot may be inserted. For reference, the article of footwear 100 defines a forefoot region 108, a midfoot region 110, and a heel region 112. The forefoot region 108 generally corresponds with portions of the article of footwear 100 that encase portions of the foot that includes the toes, the ball of the foot, and joints connecting the metatarsals with the toes or phalanges. The midfoot region 110 is proximate and adjoining the forefoot region 108, and generally corresponds with portions of the article of footwear 100 that encase the arch of foot, along with the bridge of the foot. The heel region 112 is proximate and adjoining the midfoot region 110 and generally corresponds with portions of the article of footwear 100 that encase rear portions of the foot, including the heel or calcaneus bone, the ankle, and/or the Achilles tendon.

Many conventional footwear uppers are formed from multiple elements (e.g., textiles, polymer foam, polymer sheets, leather, and synthetic leather) that are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102.

Figure 5:
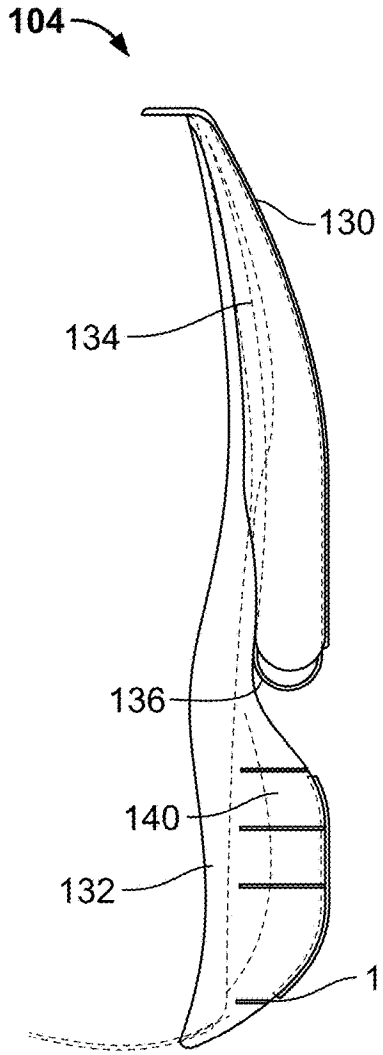
FIG. 5 is a medial side view of the sole structure of FIG. 2.

The article of footwear 100 also includes a medial side 116 (e.g., see FIG. 3) and a lateral side 118 (e.g., see FIG. 5). In particular, the lateral side 118 corresponds to an outside portion of the article of footwear 100 and the medial side 116 corresponds to an inside portion of the article of footwear 100. As such, left and right articles of footwear have opposing lateral and medial sides, such that the medial sides 116 are closest to one another when a user is wearing the articles of footwear 100, while the lateral sides 118 are defined as the sides that are farthest from one another while being worn. The medial side 116 and the lateral side 118 adjoin one another at opposing, distal ends of the article of footwear 100.

Unless otherwise specified, the forefoot region 108, the midfoot region 110, the heel region 112, the medial side 116, and the lateral side 118 are intended to define boundaries or areas of the article of footwear 100. To that end, the forefoot region 108, the midfoot region 110, the heel region 112, the medial side 116, and the lateral side 118 generally characterize sections of the article of footwear 100. Further, both the upper 102 and the sole structure 104 may be characterized as having portions within the forefoot region 108, the midfoot region 110, the heel region 112, and on the medial side 116 and the lateral side 118. Therefore, the upper 102 and the sole structure 104, and/or individual portions of the upper 102 and the sole structure 104, may include portions thereof that are disposed within the forefoot region 108, the midfoot region 110, the heel region 112, and on the medial side 116 and the lateral side 118.

The sole structure 104 is connected or secured to the upper 102 and extends between a foot of a user and the ground when the article of footwear 100 is worn by the user. The sole structure 104 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user. As will be further discussed herein, the sole structure 104 of the present embodiment of the invention includes one or more components that provide the sole structure 104 with preferable spring and damping properties.

Figure 6:
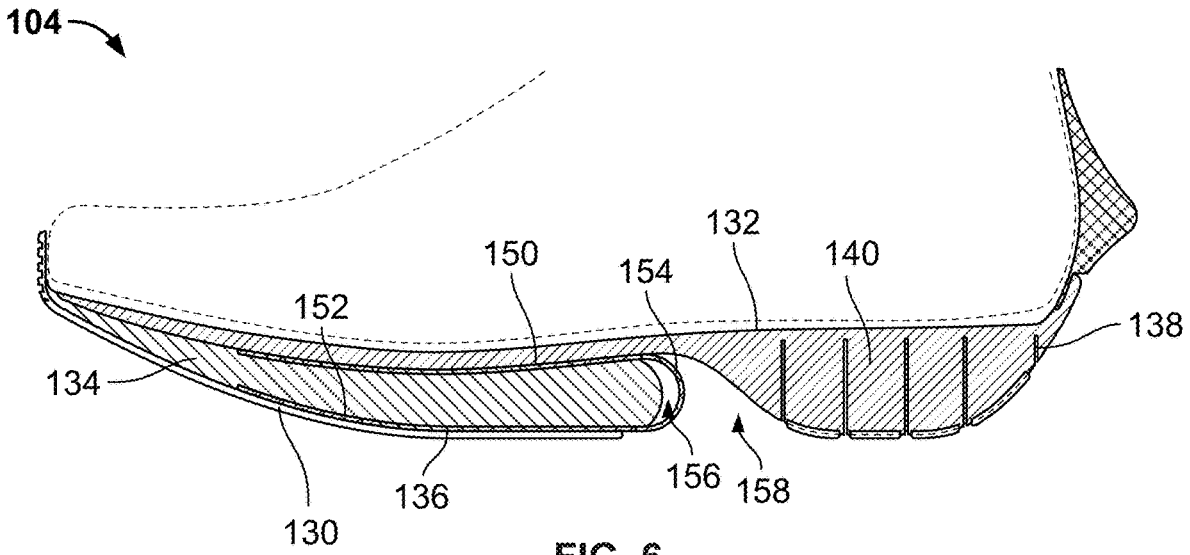
FIG. 6 is a cross-sectional view of the sole structure of FIG. 4 taken along line 6-6 thereof.
Figure 7:
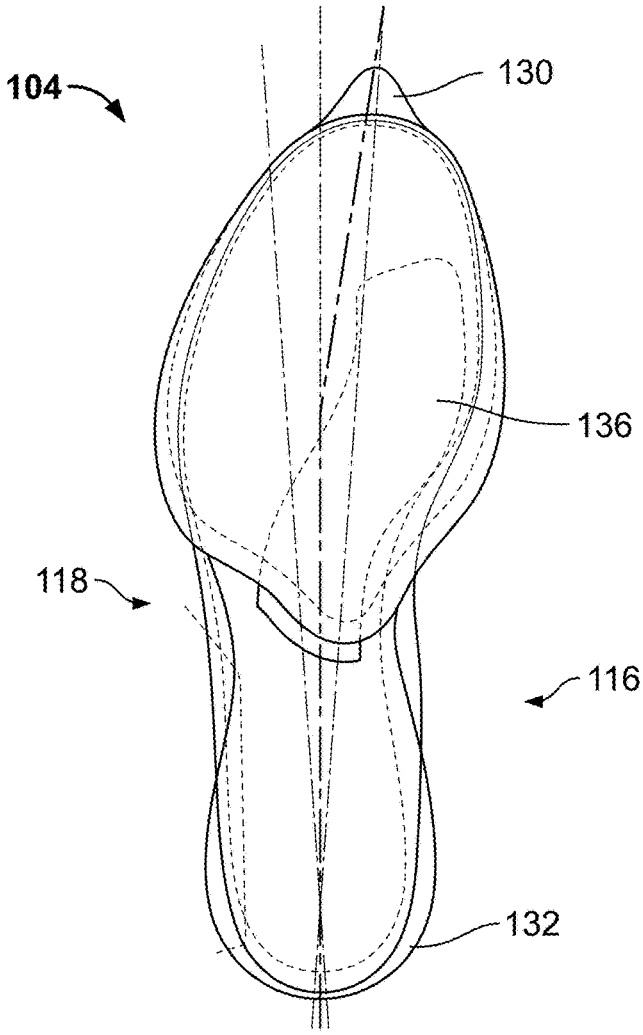
FIG. 7 is a top view of the sole structure of FIG. 2.
Figure 8:
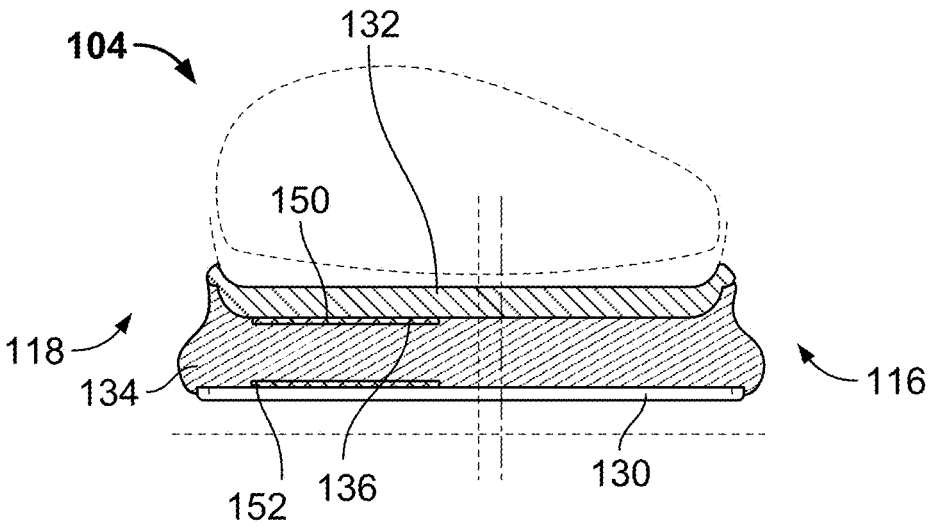
FIG. 8 is a cross-sectional view of the sole structure of FIG. 4 taken along line 8-8 thereof.
Figure 9:
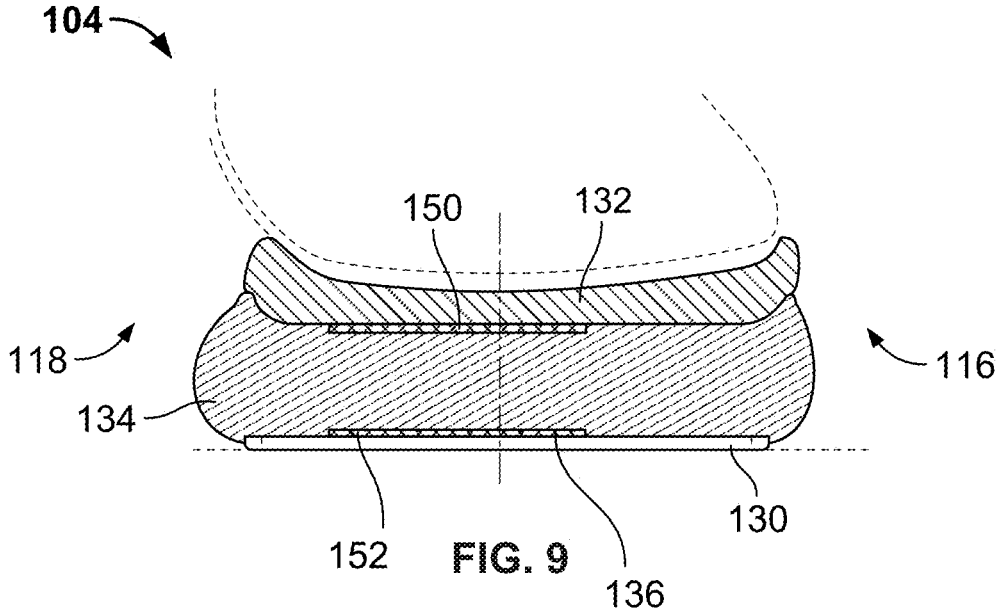
FIG. 9 is a cross-sectional view of the sole structure of FIG. 4 taken along line 9-9 thereof.
Figure 10:
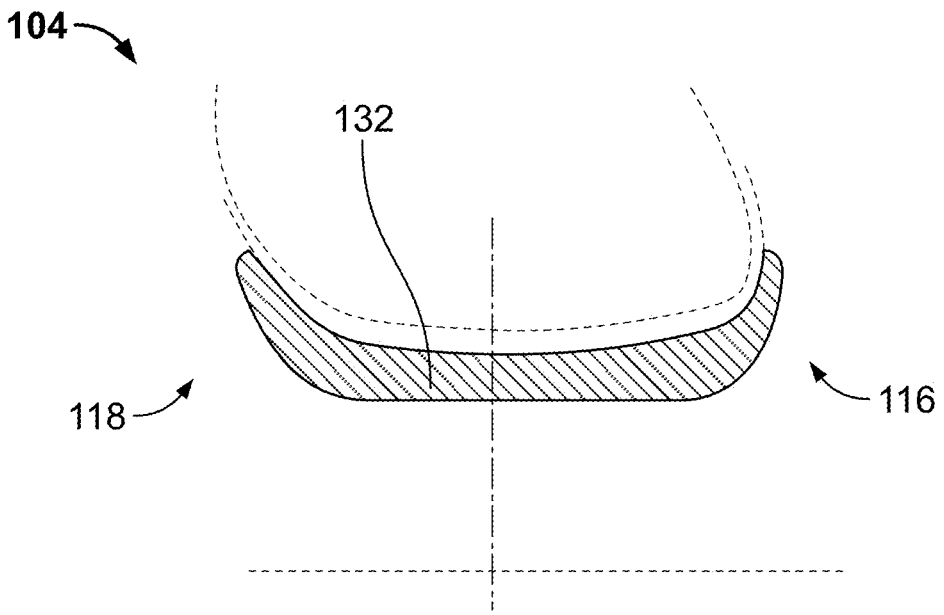
FIG. 10 is a cross-sectional view of the sole structure of FIG. 4 taken along line 10-10 thereof.
Figure 11:
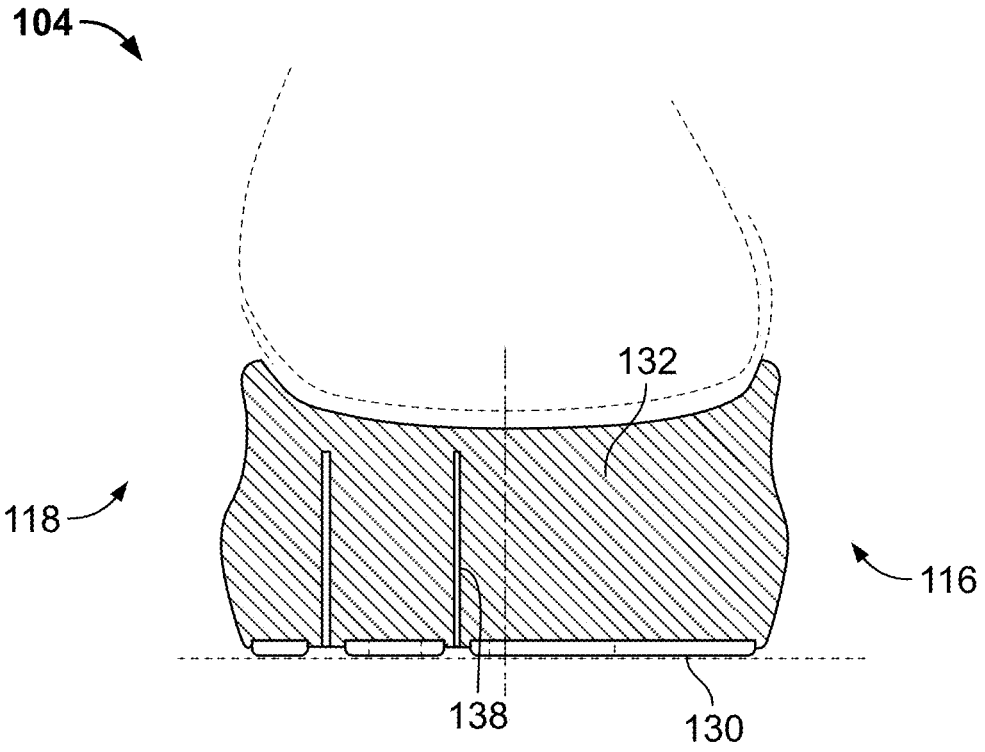
FIG. 11 is a cross-sectional view of the sole structure of FIG. 4 taken along line 11-11 thereof.
Figure 12:
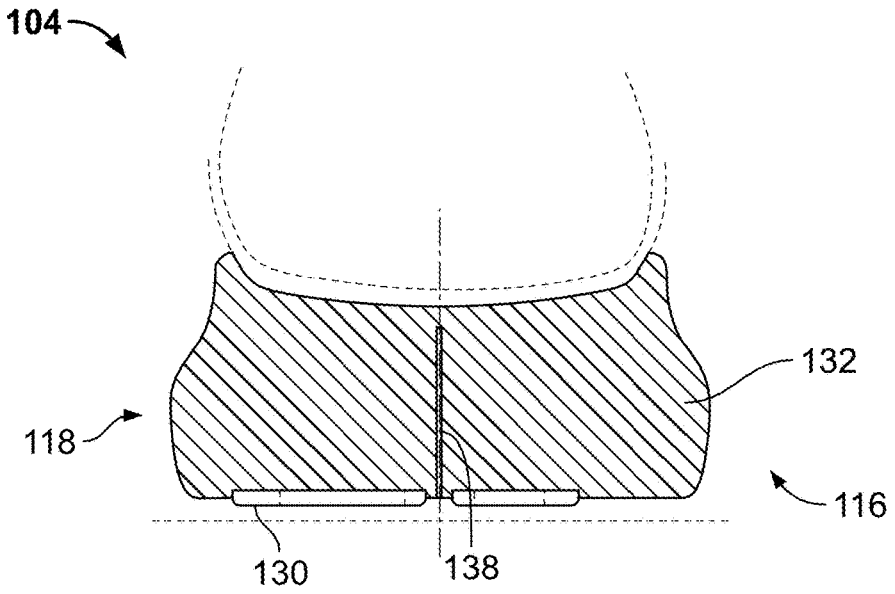
FIG. 12 is a cross-sectional view of the sole structure of FIG. 4 taken along line 12-12 thereof.

The sole structure 104 includes an outsole 130, a first cushioning member 132, a second cushioning member 134, and a sole plate 136 (see FIG. 6). The outsole 130 may define a bottom end or surface of the sole structure 104 across the heel region 112, the midfoot region 110, and the forefoot region 108. Further, the outsole 130 may be a ground-engaging portion or include a ground-engaging surface of the sole structure 104 and may be opposite of the insole thereof. The outsole 130 may be formed from one or more materials to impart durability, wear-resistance, abrasion resistance, or traction to the sole structure 104. In some embodiments, the outsole 130 may be formed from rubber, for example.

Figure 4:
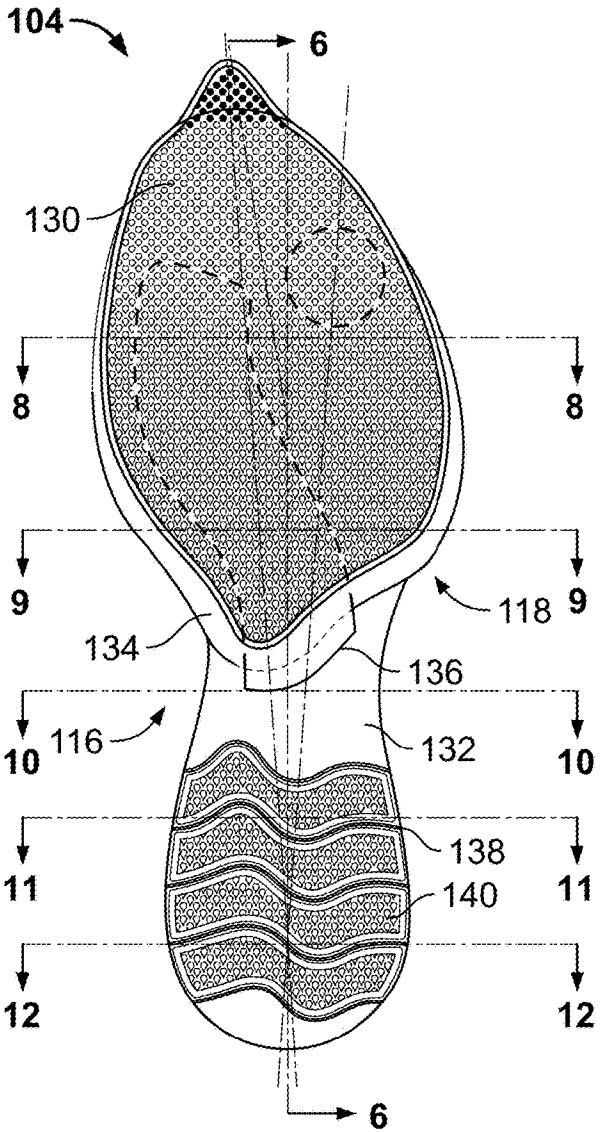
FIG. 4 is a bottom view of the sole structure of FIG. 2.

The first cushioning member 132 may be positioned adjacent to and on top of the outsole 130 in the heel region 112, and positioned adjacent to and on top of the second cushioning member 134 in the midfoot region 110 and forefoot region 108. The first cushioning member 132 may include one or more longitudinal grooves or flex lines 138 that extend between the medial side 116 and the lateral side 118, which segments the first cushioning member 132 in the heel region 112. For example, in the particular embodiment shown in FIGS. 1-12, the first cushioning member 132 includes five flex lines 138, which define four flex regions 140. Further, as best shown in FIG. 4, the flex lines 138 may have a sinusoidal shape between the medial side 116 and the lateral side 118.

The second cushioning member 134 may be positioned adjacent to and on top of the outsole 130 in the midfoot region 110 and forefoot region 108. As will be further discussed herein, the second cushioning member 134 may also be positioned between or be enclosed within the sole plate 136 in the midfoot region 110 and/or the forefoot region 108 (see FIG. 6).

The first cushioning member 132 and/or the second cushioning member 134 may be individually constructed from a thermoplastic material, such as polyurethane (PU), for example, and/or an ethylene-vinyl acetate (EVA), copolymers thereof, or a similar type of material. In other embodiments, the first cushioning member 132 and/or the second cushioning member 134 may be an EVA-Solid-Sponge ("ESS") material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. The first cushioning member 132 and/or the second cushioning member 134 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®.

In embodiments where the first cushioning member 132 and/or the second cushioning member 134 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam, which may be used as the first cushioning member 132 and, more preferably, the second cushioning member 134. In further embodiments, the first cushioning member 132 and/or the second cushioning member 134 may be formed using alternative methods known in the art, including the use of an expansion press, an injection machine, a pellet expansion process, a cold foaming process, a compression molding technique, die cutting, or any combination thereof. For example, the first cushioning member 132 and/or the second cushioning member 134 may be formed using a process that involves an initial foaming step in which supercritical gas is used to foam a material and then compression molded or die cut to a particular shape.

Figure 13:
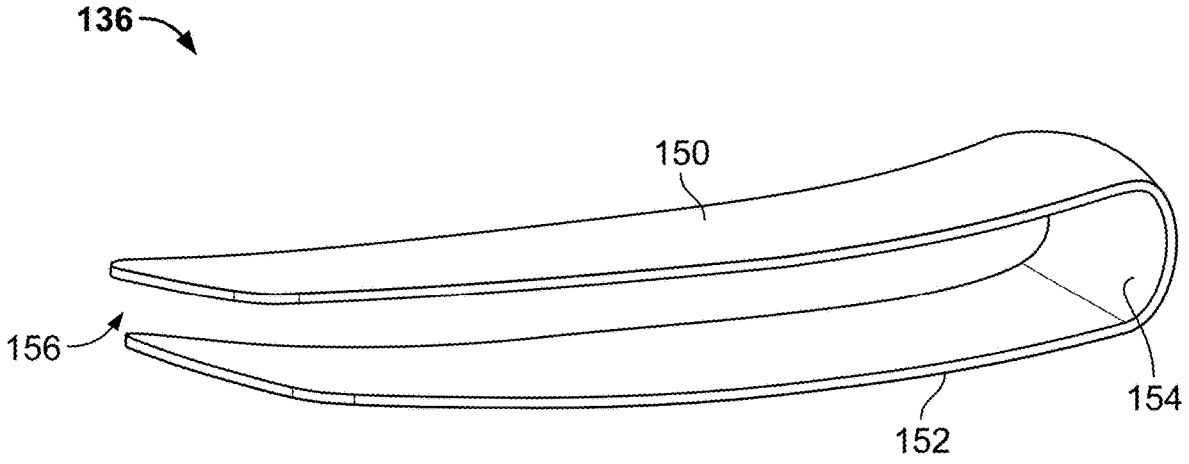
FIG. 13 is an isometric view of the sole plate of the sole structure of FIG. 2.
Figure 14:
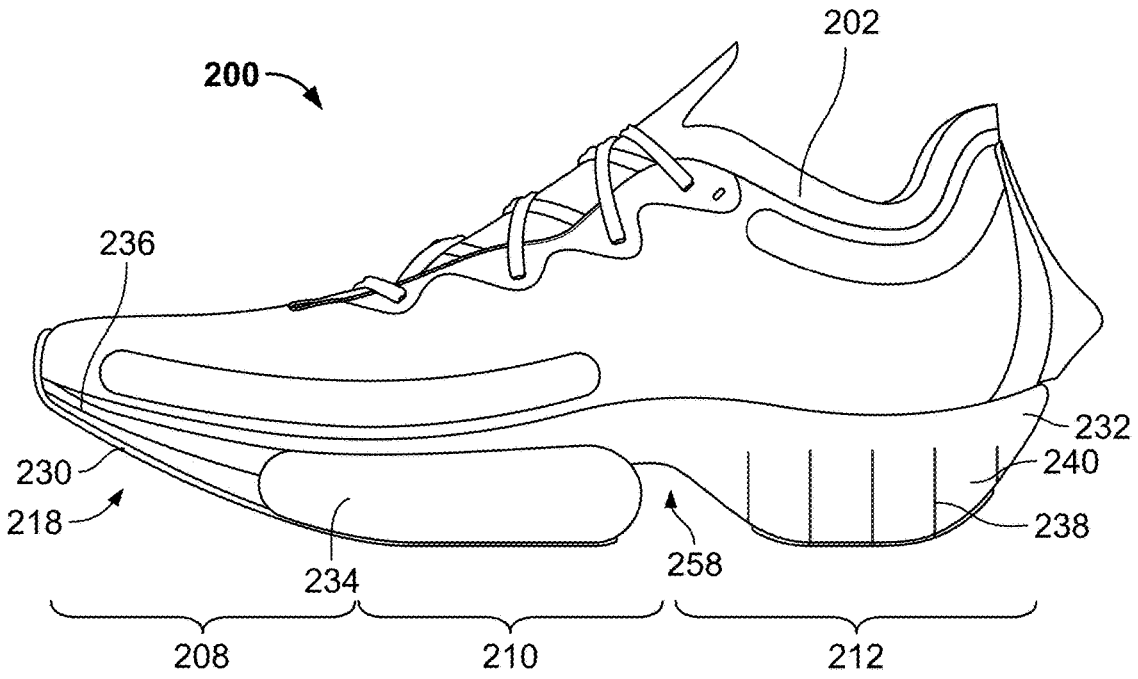
FIG. 14 is a lateral side view of an article of footwear configured as a left shoe that includes an upper and a sole structure, according to another embodiment of the disclosure.
Figure 15:
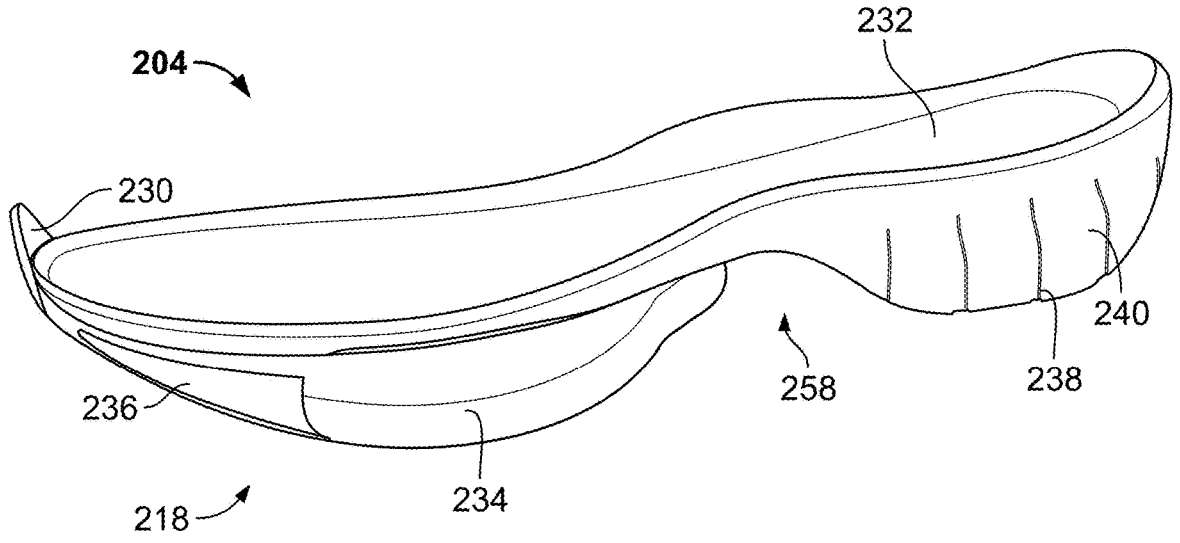
FIG. 15 is a top, lateral side view of the sole structure of the article of footwear of FIG. 14, the sole structure having a sole plate.

The sole structure 104 further includes the sole plate 136, which as best shown in FIG. 13, includes an upper flange 150 and a lower flange 152 and an arched, curved, or C-shaped rear portion 154 that connects the upper flange 150 and the lower flange 152. Further, a gap 156 extends between the upper flange 150 and the lower flange 152, into which the second cushioning member 134 may be positioned, as previously discussed herein. As shown in FIG. 6, the sole plate 136 extends at least partially through the midfoot region 110 and at least partially through the forefoot region 108. As further illustrated in FIG. 6, the rear portion 154 of the sole plate 136 may be spaced from a rear side of the second cushioning member 134, which creates a spacing 158 therebetween.

With continued reference to FIG. 6, the lower flange 152 may be adjacent to and positioned between the outsole 130 and the second cushioning member 134, and the upper flange 150 may be adjacent to and positioned between the second cushioning member 134 and the first cushioning member 132. In some embodiments, the sole plate 136 has a uniform thickness. For example, in particular embodiments, the thickness is approximately 1.2 centimeters.

In some embodiments, the sole plate 136 comprises a PU plastic, such as a thermoplastic polyurethane (TPU) material, for example. Other thermoplastic elastomers consisting of block copolymers are also possible. In other embodiments, the sole plate 136 can include carbon fiber, for example.

In some embodiments, the outsole 130 or the ground-engaging surface is not continuous along the article of footwear 100. For example, as best shown in FIG. 6, there is a spacing 158, or an absence of a ground-engaging surface, along the article of footwear 100, which is located within the midfoot region 110 of the article of footwear 100.

FIGS. 14-25 show another configuration of an article of footwear 200. Similar to the sole structure 104, the sole structure 204 is configured to be attached to an upper 202 and together define an interior cavity into which a foot may be inserted. For reference, the sole structure 204 defines a forefoot region 208, a midfoot region 210, and a heel region 212. The forefoot region 208 generally corresponds with portions of an article of footwear, such as the article of footwear 200, for example, that encase portions of the foot that include the toes, the ball of the foot, and joints connecting the metatarsals with the toes or phalanges. The midfoot region 210 is proximate and adjoining the forefoot region 208, and generally corresponds with portions of the article of footwear that encase the arch of a foot, along with the bridge of a foot. The heel region 212 is proximate and adjoining the midfoot region 210 and generally corresponds with portions of the article of footwear that encase rear portions of the foot, including the heel or calcaneus bone, the ankle, and/or the Achilles tendon.

Figure 16:
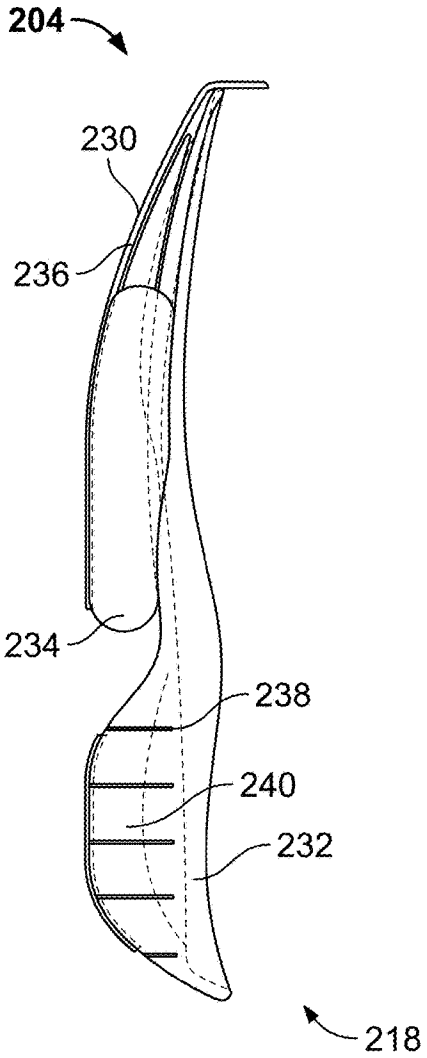
FIG. 16 is a lateral side view of the sole structure of FIG. 15.

The article of footwear 200 also includes a medial side 216 (e.g., see FIG. 18) and a lateral side 218 (e.g., see FIG. 16). In particular, the lateral side 218 corresponds to an outside portion of the article of footwear 200 and the medial side 216 corresponds to an inside portion of the article of footwear 200. As such, left and right articles of footwear have opposing lateral and medial sides, such that the medial sides 216 are closest to one another when a user is wearing the articles of footwear 200, while the lateral sides 218 are defined as the sides that are farthest from one another while being worn. The medial side 216 and the lateral side 218 adjoin one another at opposing, distal ends of the article of footwear 200.

Unless otherwise specified, the forefoot region 208, the midfoot region 210, the heel region 212, the medial side 216, and the lateral side 218 are intended to define boundaries or areas of the article of footwear 200. To that end, the forefoot region 208, the midfoot region 210, the heel region 212, the medial side 216, and the lateral side 218 generally characterize sections of the article of footwear 200. Further, both the upper 202 and the sole structure 204 may be characterized as having portions within the forefoot region 208, the midfoot region 210, the heel region 212, and on the medial side 216 and the lateral side 218. Therefore, the upper 202 and the sole structure 204, and/or individual portions of the upper 202 and the sole structure 204, may include portions thereof that are disposed within the forefoot region 208, the midfoot region 210, the heel region 212, and on the medial side 216 and the lateral side 218.

The sole structure 204 is connected or secured to the upper 202 and extends between a foot of a user and the ground when the article of footwear 200 is worn by the user. The sole structure 204 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user. As will be further discussed herein, the sole structure 204 of the present embodiment of the invention includes one or more components that provide the sole structure 204 with preferable spring and damping properties.

Figure 19:
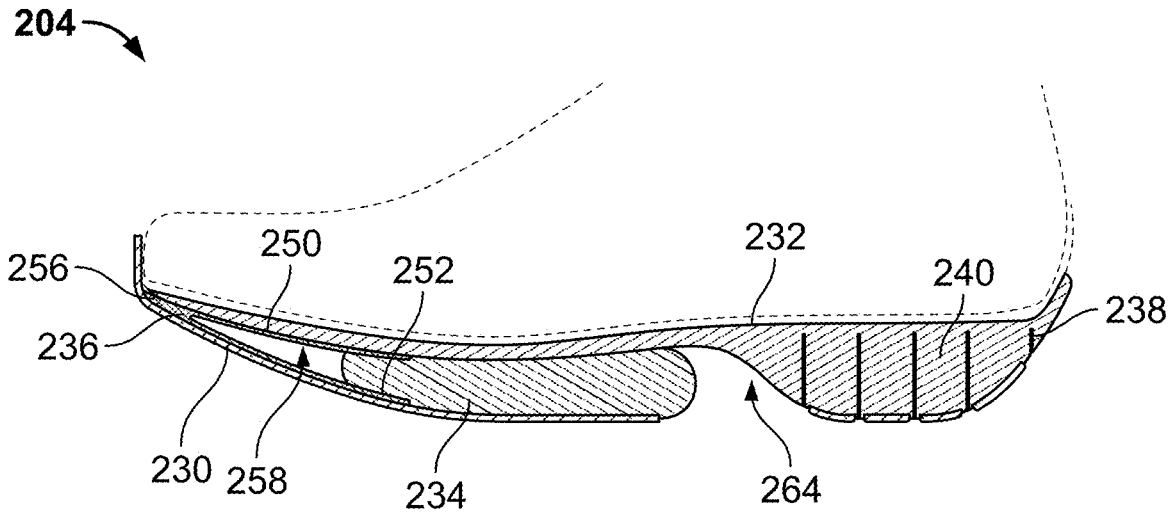
FIG. 19 is a cross-sectional view of the sole structure of FIG. 17 taken along line 19-19 thereof.
Figure 20:
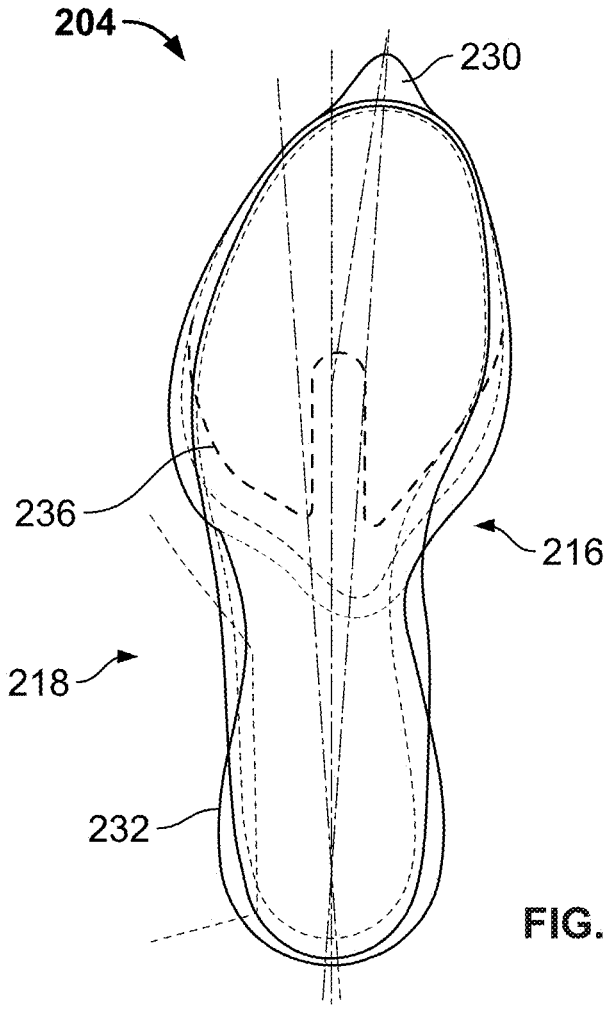
FIG. 20 is a top view of the sole structure of FIG. 15.
Figure 21:
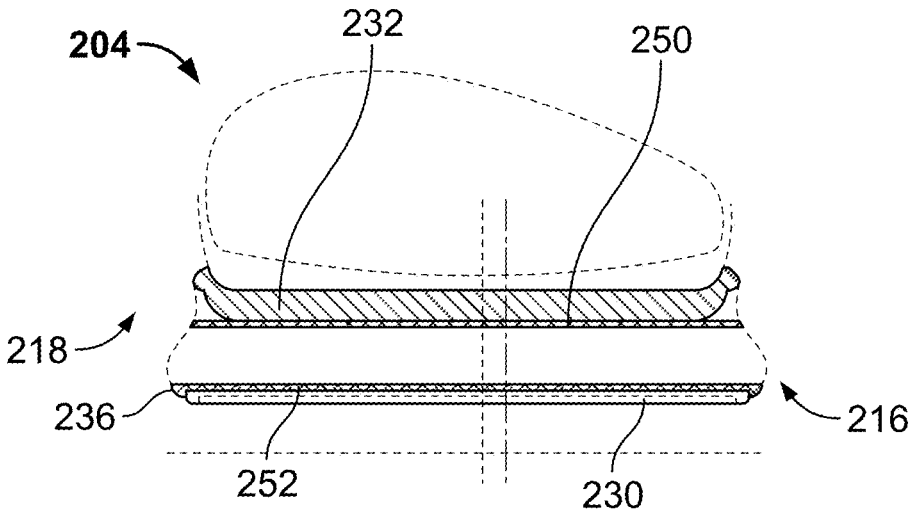
FIG. 21 is a cross-sectional view of the sole structure of FIG. 17 taken along line 21-21 thereof.
Figure 22:
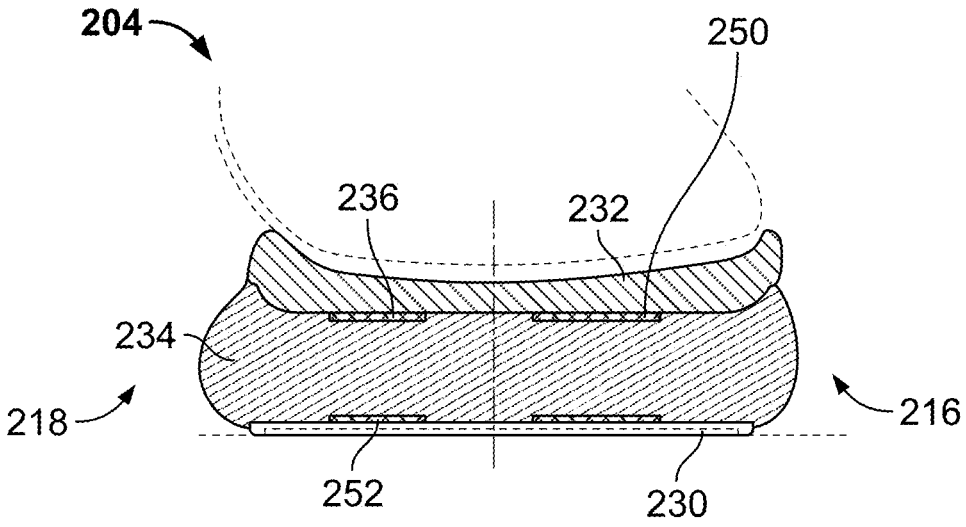
FIG. 22 is a cross-sectional view of the sole structure of FIG. 17 taken along line 22-22 thereof.
Figure 23:
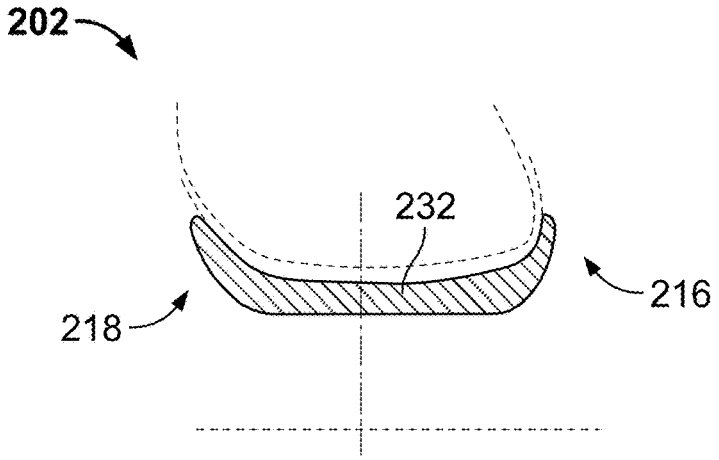
FIG. 23 is a cross-sectional view of the sole structure of FIG. 17 taken along line 23-23 thereof.
Figure 24:
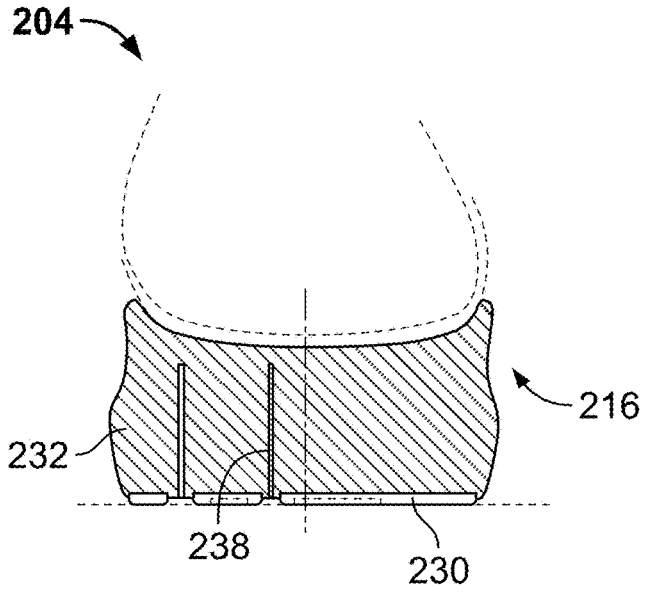
FIG. 24 is a cross-sectional view of the sole structure of FIG. 17 taken along line 24-24 thereof.
Figure 25:
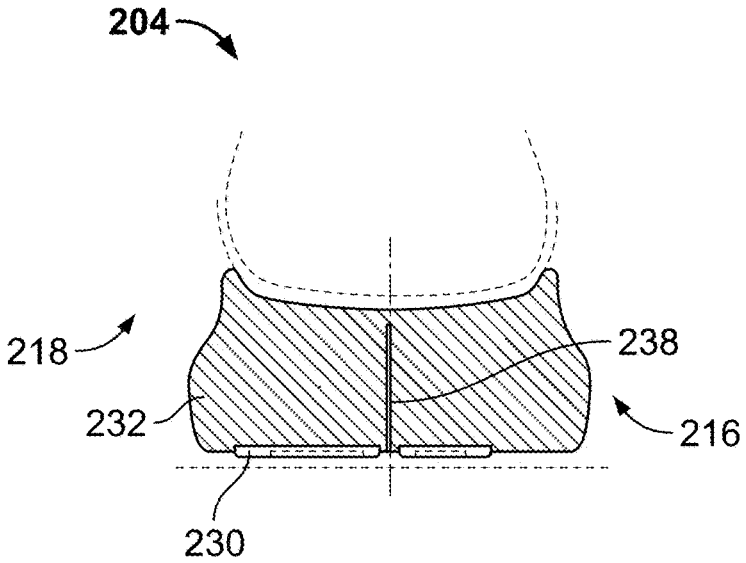
FIG. 25 is a cross-sectional view of the sole structure of FIG. 17 taken along line 25-25 thereof.

The sole structure 204 includes an outsole 230, a first cushioning member 232, a second cushioning member 234, and a sole plate 236 (see FIG. 19). The outsole 230 may define a bottom end or surface of the sole structure 204 across the heel region 212, the midfoot region 210, and the forefoot region 208. Further, the outsole 230 may be a ground-engaging portion or include a ground-engaging surface of the sole structure 204 and may be opposite of the insole thereof. The outsole 230 may be formed from one or more materials to impart durability, wear-resistance, abrasion resistance, or traction to the sole structure 204. In some embodiments, the outsole 230 may be formed from rubber, for example.

Figure 17:
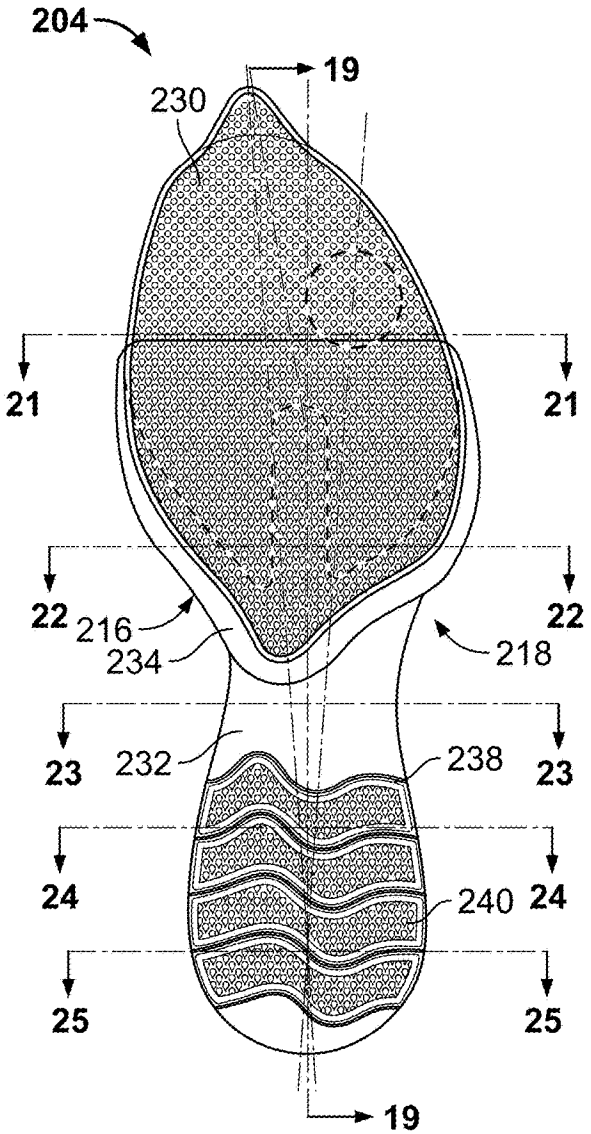
FIG. 17 is a bottom view of the sole structure of FIG. 15.
Figure 18:
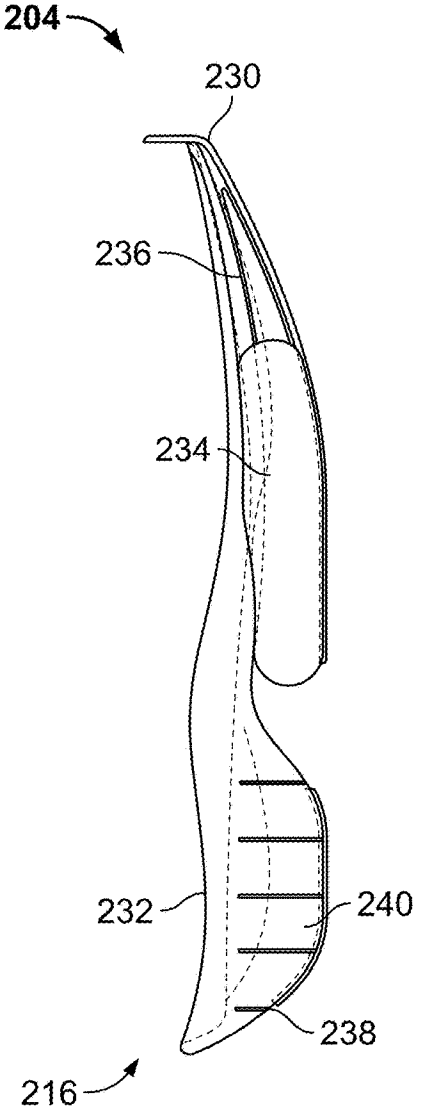
FIG. 18 is a medial side view of the sole structure of FIG. 15.

The first cushioning member 232 may be positioned adjacent to and on top of the outsole 230 in the heel region 212, and positioned adjacent to and on top of the second cushioning member 234 in the midfoot region 210 and forefoot region 208. The first cushioning member 232 may include one or more longitudinal grooves or flex lines 238 that extend between the medial side 216 and the lateral side 218, which segments the first cushioning member 232 in the heel region 212. For example, in the particular embodiment shown in FIGS. 14-25, the first cushioning member 232 includes five flex lines 238, which define four flex regions 240. Further, as best shown in FIG. 17, the flex lines 238 may have a sinusoidal shape between the medial side 216 and the lateral side 218.

The second cushioning member 234 may be positioned adjacent to and on top of the outsole 230 in the midfoot region 210 and forefoot region 208. As will be further discussed herein, the second cushioning member 234 may also be positioned between or be enclosed within the sole plate 236 in the forefoot region 208 (see FIG. 19).

The first cushioning member 232 and/or the second cushioning member 234 may be individually constructed from a thermoplastic material, such as polyurethane (PU), for example, and/or an ethylene-vinyl acetate (EVA), copolymers thereof, or a similar type of material. In other embodiments, the first cushioning member 232 and/or the second cushioning member 234 may be an EVA-Solid-Sponge ("ESS") material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. The first cushioning member 232 and/or the second cushioning member 234 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®.

In embodiments where the first cushioning member 232 and/or the second cushioning member 234 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam, which may be used as the first cushioning member 232 and, more preferably, the second cushioning member 234. In further embodiments, the first cushioning member 232 and/or the second cushioning member 234 may be formed using alternative methods known in the art, including the use of an expansion press, an injection machine, a pellet expansion process, a cold foaming process, a compression molding technique, die cutting, or any combination thereof. For example, the first cushioning member 232 and/or the second cushioning member 234 may be formed using a process that involves an initial foaming step in which supercritical gas is used to foam a material and then compression molded or die cut to a particular shape.

Figure 26:
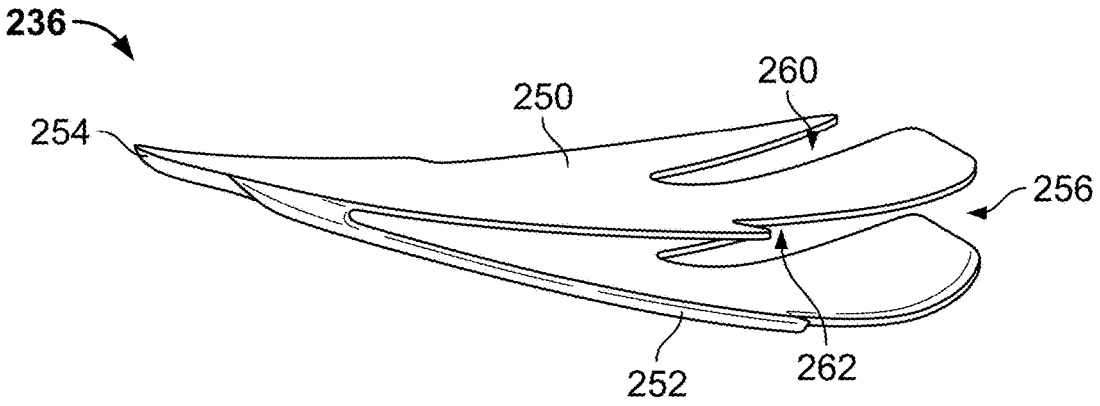
FIG. 26 is an isometric view of the sole plate of the sole structure of FIG. 15.
Figure 27:
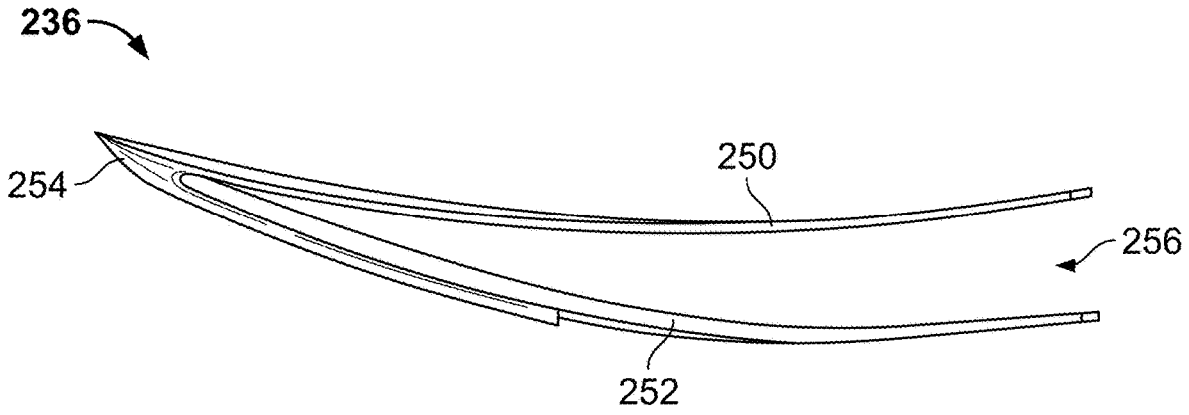
FIG. 27 is a side view of the sole plate of FIG. 26.
Figure 28:
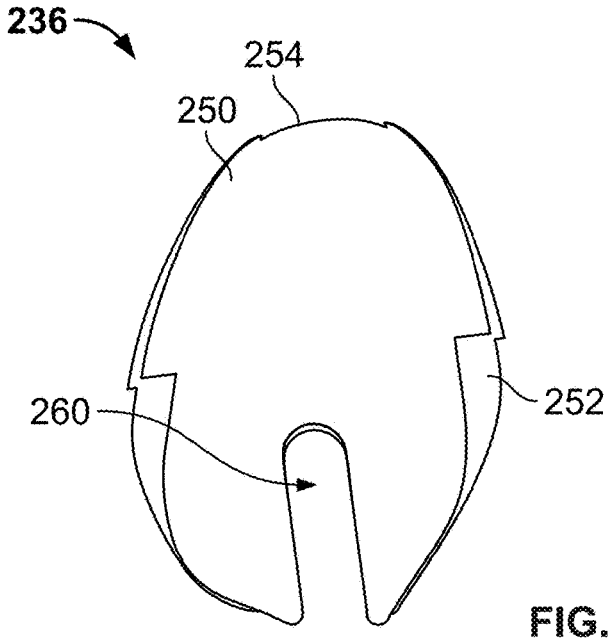
FIG. 28 is a top view of the sole plate of FIG. 26.
Figure 29:
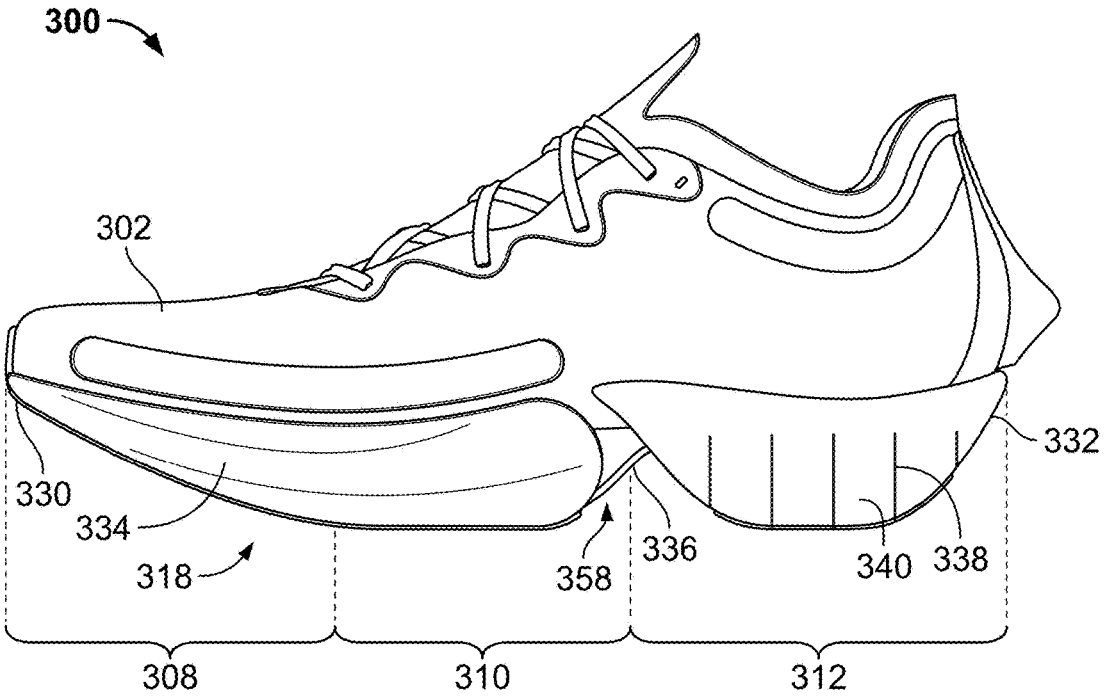
FIG. 29 is a lateral side view of an article of footwear configured as a left shoe that includes an upper and a sole structure, according to yet another embodiment of the disclosure.
Figure 30:
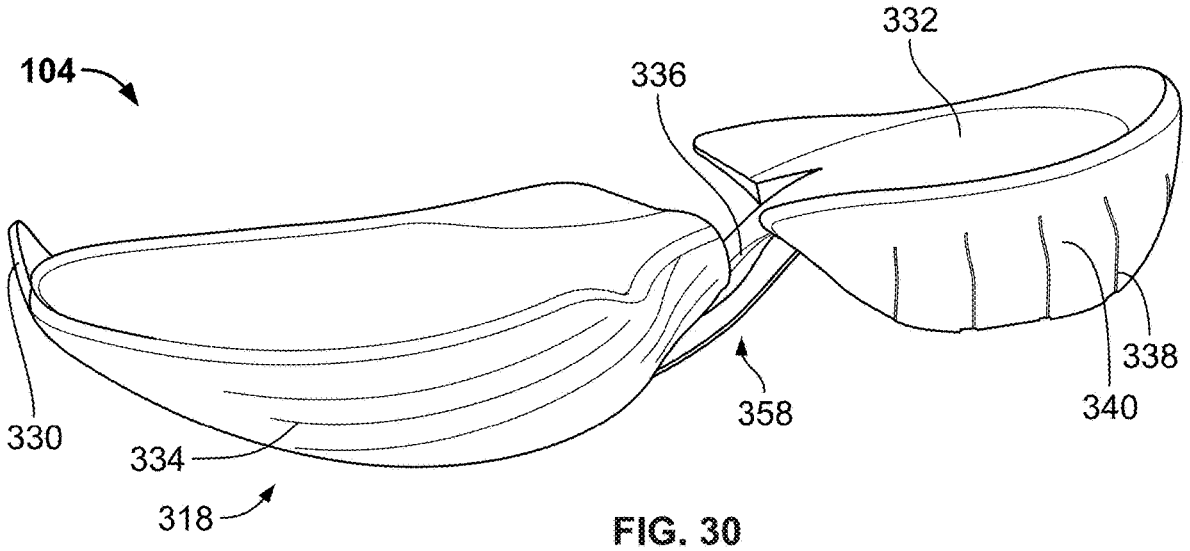
FIG. 30 is a top, lateral side view of the sole structure of the article of footwear of FIG. 29, the sole structure having a sole plate.

The sole structure 204 further includes the sole plate 236, which is best shown in FIGS. 26-28, includes an upper flange 250 and a lower flange 252 that connect at a vertex point 254. Further, a gap 256 extends between the upper flange 250 and the lower flange 252, into which the second cushioning member 234 may be positioned, as previously discussed herein. As shown in FIG. 19, the sole plate 236 extends through the forefoot region 208. As further illustrated in FIG. 19, the vertex point 254 may be spaced from a front side of the second cushioning member 234, which creates a spacing or gap 258 between the upper flange 250 and the lower flange 252.

With continued reference to FIG. 19, a rear portion of the lower flange 252 may be adjacent to and positioned between the outsole 230 and the second cushioning member 234, and a rear portion of the upper flange 250 may be adjacent to and positioned between the second cushioning member 234 and the first cushioning member 232. In some embodiments, the sole plate 236 has a uniform thickness. For example, in particular embodiments, the thickness is approximately 1.2 centimeters.

With reference to FIGS. 26 and 28, the upper flange 250 and the lower flange 252 may also include one or more cut-out portions 260, 262. The cut-out portions 260, 262 may be advantageous to allow the medial and lateral sides of the sole plate 236 to flex independent of one another.

In some embodiments, the sole plate 236 comprises a PU plastic, such as a thermoplastic polyurethane (TPU) material, for example. Other thermoplastic elastomers consisting of block copolymers are also possible. In other embodiments, the sole plate 236 can include carbon fiber, for example.

In some embodiments, the outsole 230 or the ground-engaging surface is not continuous along the article of footwear 200. For example, as best shown in FIG. 19, there is a spacing 264, or an absence of a ground-engaging surface, along the article of footwear 200, which is located within the midfoot region 210 of the article of footwear 200.

FIGS. 29-40 show another configuration of an article of footwear 300. Similar to the sole structures 104, 204, the sole structure 304 is configured to be attached to an upper 302 and together define an interior cavity into which a foot may be inserted. For reference, the sole structure 304 defines a forefoot region 308, a midfoot region 310, and a heel region 312. The forefoot region 308 generally corresponds with portions of an article of footwear, such as the article of footwear 300, for example, that encase portions of the foot that include the toes, the ball of the foot, and joints connecting the metatarsals with the toes or phalanges. The midfoot region 310 is proximate and adjoining the forefoot region 308, and generally corresponds with portions of the article of footwear that encase the arch of a foot, along with the bridge of a foot. The heel region 312 is proximate and adjoining the midfoot region 310 and generally corresponds with portions of the article of footwear that encase rear portions of the foot, including the heel or calcaneus bone, the ankle, and/or the Achilles tendon.

Figure 31:
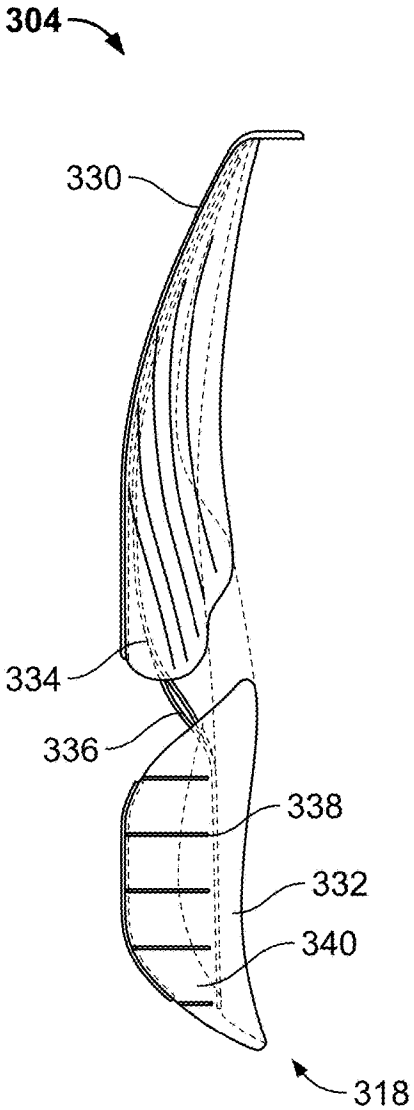
FIG. 31 is a lateral side view of the sole structure of FIG. 30.

The article of footwear 300 also includes a medial side 316 (e.g., see FIG. 33) and a lateral side 318 (e.g., see FIG. 31). In particular, the lateral side 318 corresponds to an outside portion of the article of footwear 300 and the medial side 316 corresponds to an inside portion of the article of footwear 300. As such, left and right articles of footwear have opposing lateral and medial sides, such that the medial sides 316 are closest to one another when a user is wearing the articles of footwear 300, while the lateral sides 318 are defined as the sides that are farthest from one another while being worn. The medial side 316 and the lateral side 318 adjoin one another at opposing, distal ends of the article of footwear 300.

Unless otherwise specified, the forefoot region 308, the midfoot region 310, the heel region 312, the medial side 316, and the lateral side 318 are intended to define boundaries or areas of the article of footwear 300. To that end, the forefoot region 308, the midfoot region 310, the heel region 312, the medial side 316, and the lateral side 318 generally characterize sections of the article of footwear 300. Further, both the upper 302 and the sole structure 304 may be characterized as having portions within the forefoot region 308, the midfoot region 310, the heel region 312, and on the medial side 316 and the lateral side 318. Therefore, the upper 302 and the sole structure 304, and/or individual portions of the upper 302 and the sole structure 304, may include portions thereof that are disposed within the forefoot region 308, the midfoot region 310, the heel region 312, and on the medial side 316 and the lateral side 318.

The sole structure 304 is connected or secured to the upper 302 and extends between a foot of a user and the ground when the article of footwear 300 is worn by the user. The sole structure 304 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user. As will be further discussed herein, the sole structure 304 of the present embodiment of the invention includes one or more components that provide the sole structure 304 with preferable spring and damping properties.

Figure 34:
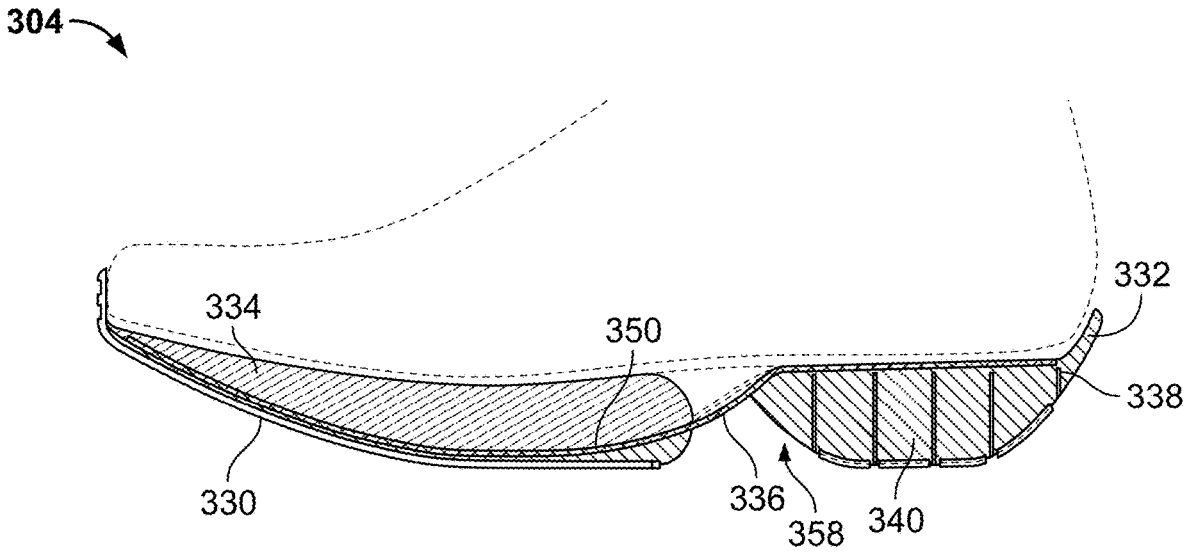
FIG. 34 is a cross-sectional view of the sole structure of FIG. 32 taken along line 34-34 thereof.
Figure 35:
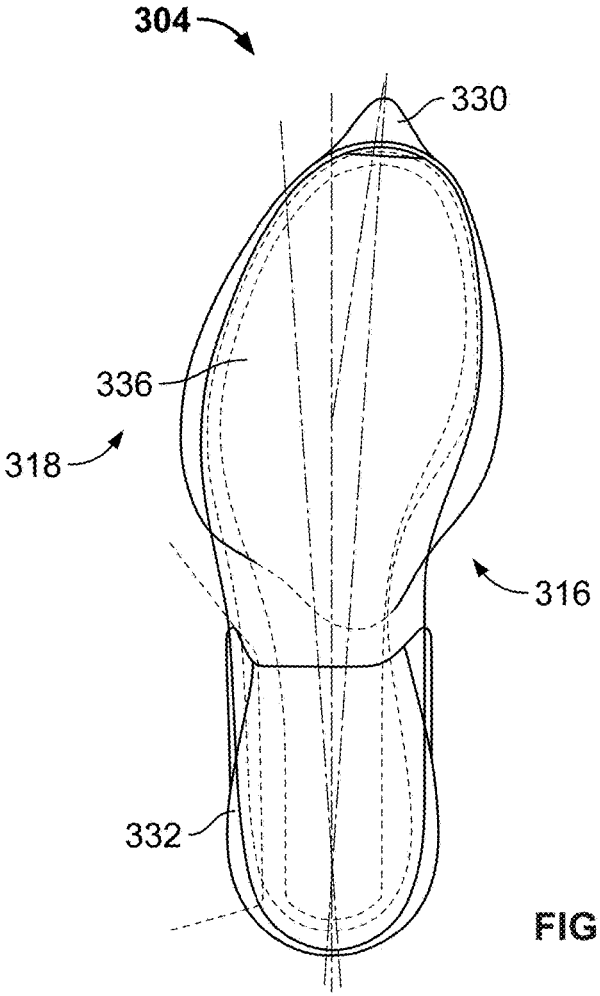
FIG. 35 is a top view of the sole structure of FIG. 30.
Figure 36:
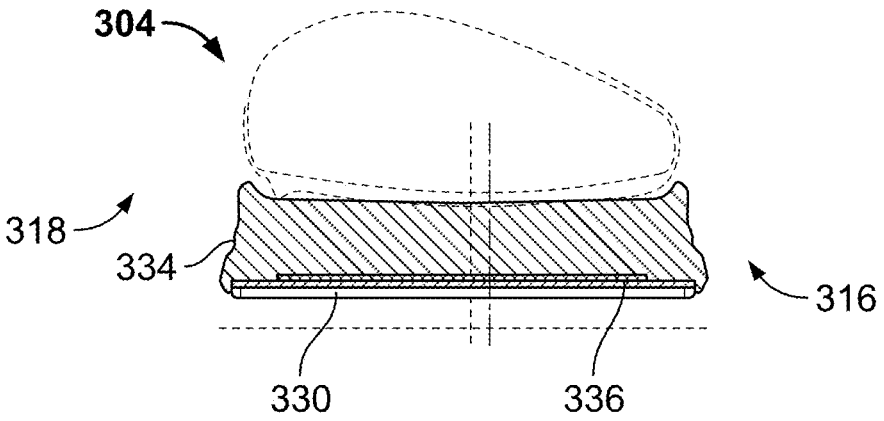
FIG. 36 is a cross-sectional view of the sole structure of FIG. 32 taken along line 36-36 thereof.
Figure 37:
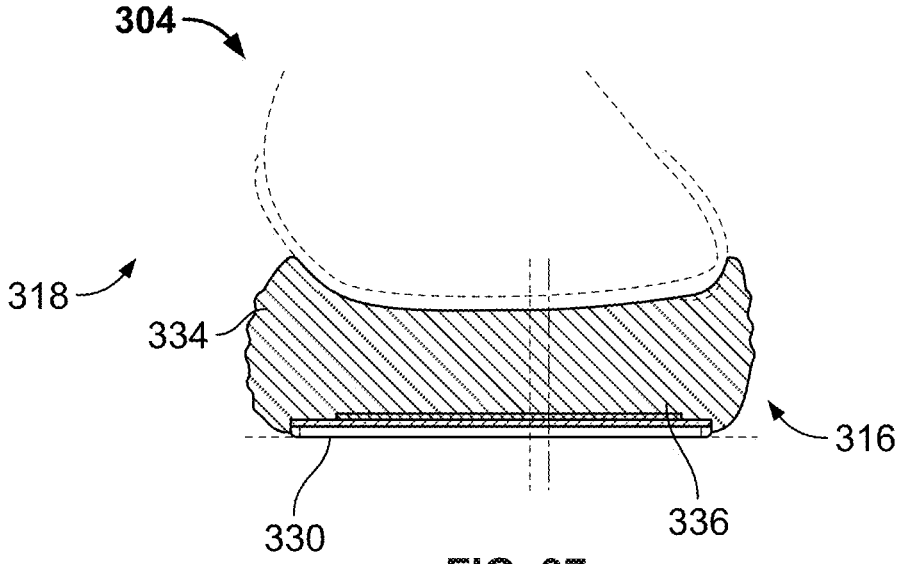
FIG. 37 is a cross-sectional view of the sole structure of FIG. 32 taken along line 37-37 thereof.
Figure 38:
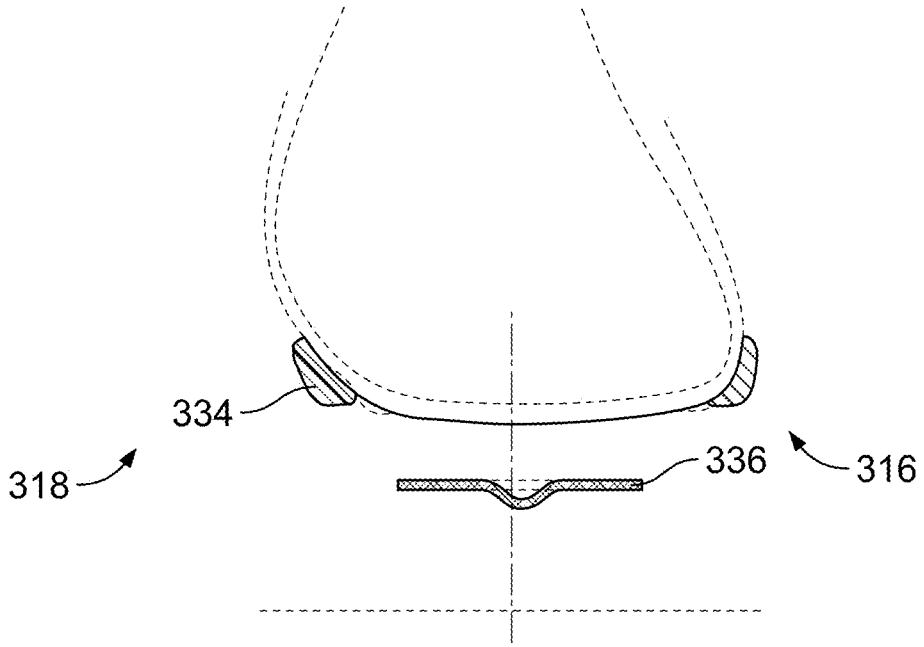
FIG. 38 is a cross-sectional view of the sole structure of FIG. 32 taken along line 38-38 thereof.
Figure 39:
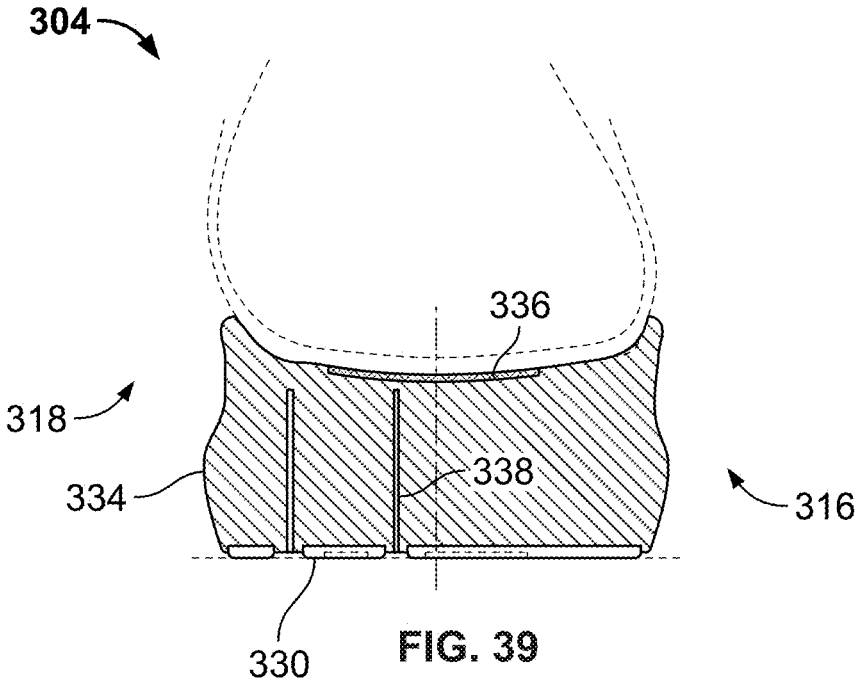
FIG. 39 is a cross-sectional view of the sole structure of FIG. 32 taken along line 39-39 thereof.
Figure 40:
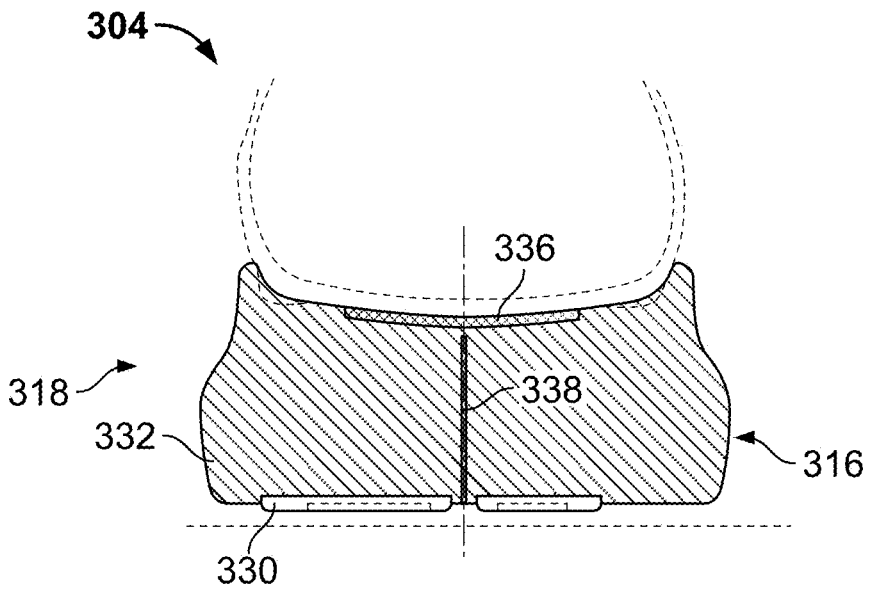
FIG. 40 is a cross-sectional view of the sole structure of FIG. 32 taken along line 40-40 thereof.

The sole structure 304 includes an outsole 330, a first cushioning member 332, a second cushioning member 334, and a sole plate 336 (see FIG. 34). The outsole 330 may define a bottom end or surface of the sole structure 304 across the heel region 312, the midfoot region 310, and the forefoot region 308. Further, the outsole 330 may be a ground-engaging portion or include a ground-engaging surface of the sole structure 304 and may be opposite of the insole thereof. The outsole 330 may be formed from one or more materials to impart durability, wear-resistance, abrasion resistance, or traction to the sole structure 304. In some embodiments, the outsole 330 may be formed from rubber, for example.

Figure 32:
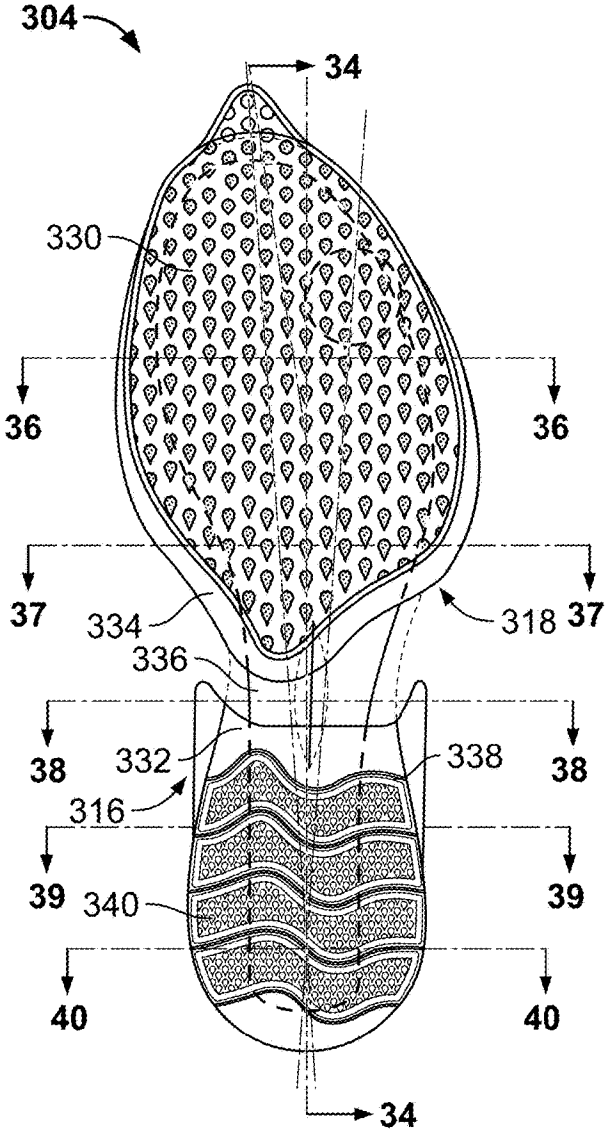
FIG. 32 is a bottom view of the sole structure of FIG. 30.
Figure 33:
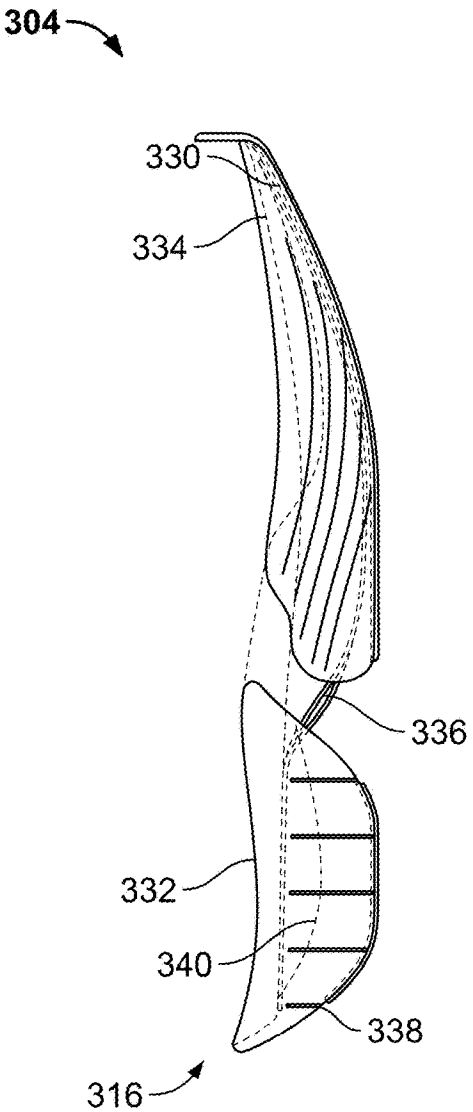
FIG. 33 is a medial side view of the sole structure of FIG. 30.

The first cushioning member 332 may be positioned adjacent to and on top of the outsole 330 in the heel region 312. The first cushioning member 332 may also be positioned adjacent to and below the sole plate 336. The first cushioning member 332 may include one or more longitudinal grooves or flex lines 338 that extend between the medial side 316 and the lateral side 318, which segments the first cushioning member 332 in the heel region 312. For example, in the particular embodiment shown in FIGS. 29-40, the first cushioning member 332 includes five flex lines 338, which define four flex regions 340. Further, as best shown in FIG. 32, the flex lines 338 may have a sinusoidal shape between the medial side 316 and the lateral side 318.

The second cushioning member 334 may be positioned adjacent to and on top of the outsole 330 in the midfoot region 310 and forefoot region 308. As will be further discussed herein, the sole plate 336 may also bifurcate the second cushioning member 334, such that the sole plate 336 is positioned within the second cushioning member 334 (see FIG. 34).

The first cushioning member 332 and/or the second cushioning member 334 may be individually constructed from a thermoplastic material, such as polyurethane (PU), for example, and/or an ethylene-vinyl acetate (EVA), copolymers thereof, or a similar type of material. In other embodiments, the first cushioning member 332 and/or the second cushioning member 334 may be an EVA-Solid-Sponge ("ESS") material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. The first cushioning member 332 and/or the second cushioning member 334 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®.

In embodiments where the first cushioning member 332 and/or the second cushioning member 334 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam, which may be used as the first cushioning member 332 and, more preferably, the second cushioning member 334. In further embodiments, the first cushioning member 332 and/or the second cushioning member 334 may be formed using alternative methods known in the art, including the use of an expansion press, an injection machine, a pellet expansion process, a cold foaming process, a compression molding technique, die cutting, or any combination thereof. For example, the first cushioning member 332 and/or the second cushioning member 334 may be formed using a process that involves an initial foaming step in which supercritical gas is used to foam a material and then compression molded or die cut to a particular shape.

Figure 41:
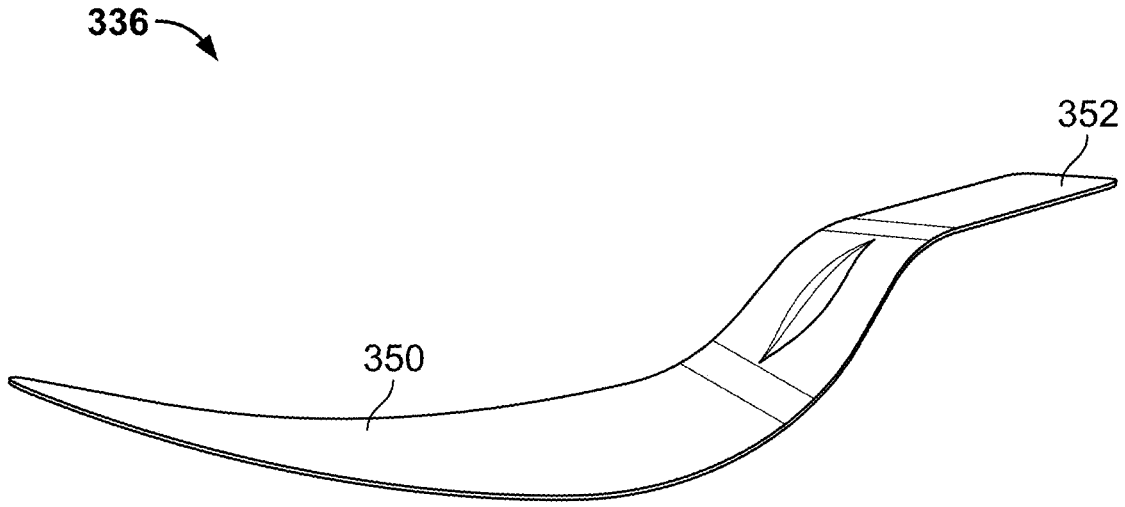
FIG. 41 is an isometric view of the sole plate of the sole structure of FIG. 30.
Figure 42:
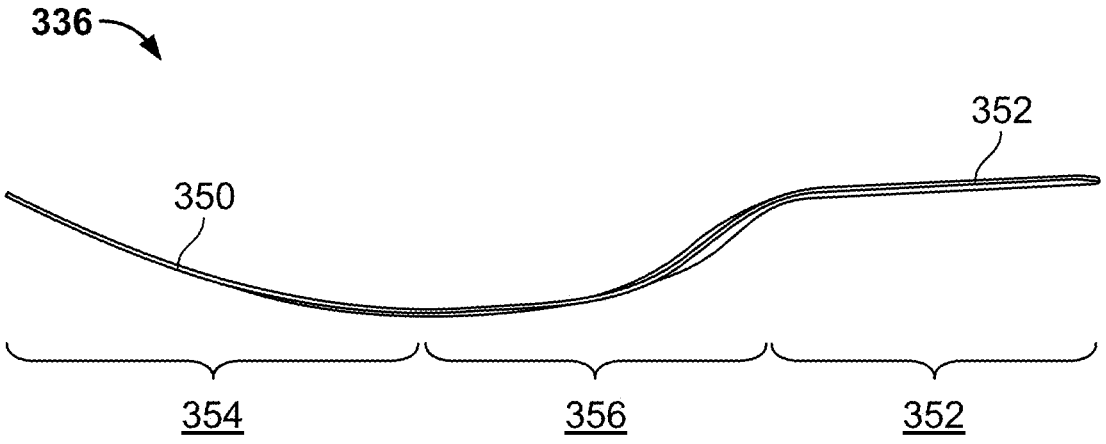
FIG. 42 is a side view of the sole plate of FIG. 41.
Figure 43:
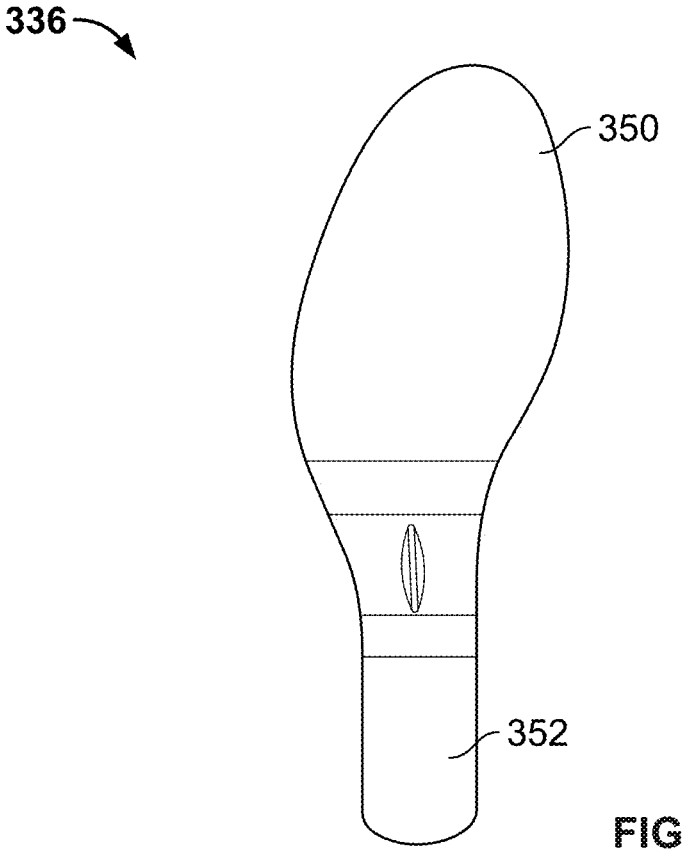
FIG. 43 is a top view of the sole plate of FIG. 41.
Figure 44:
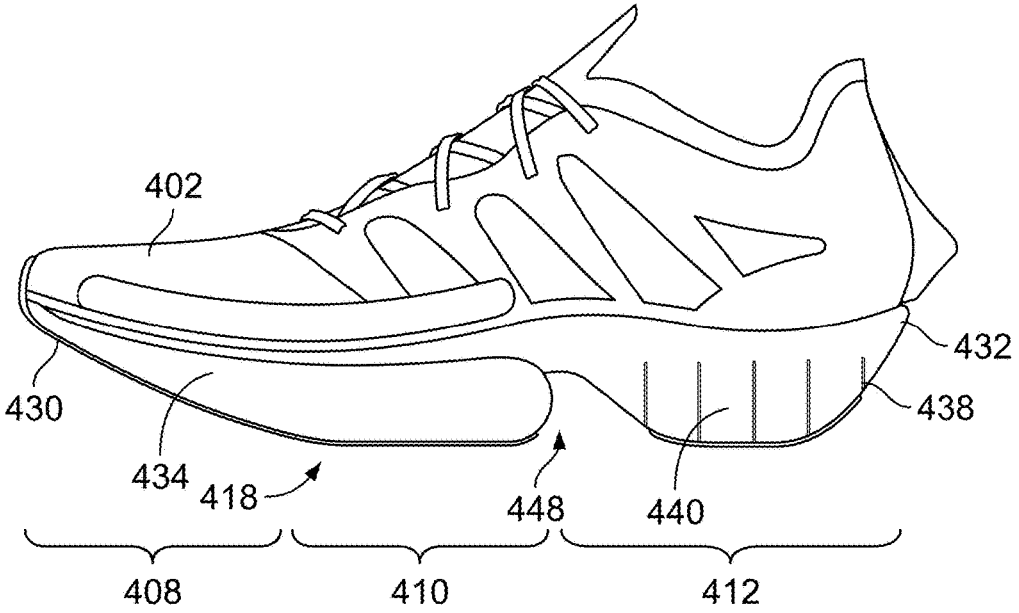
FIG. 44 is a lateral side view of an article of footwear configured as a left shoe that includes an upper and a sole structure, according to another embodiment of the disclosure.
Figure 45:
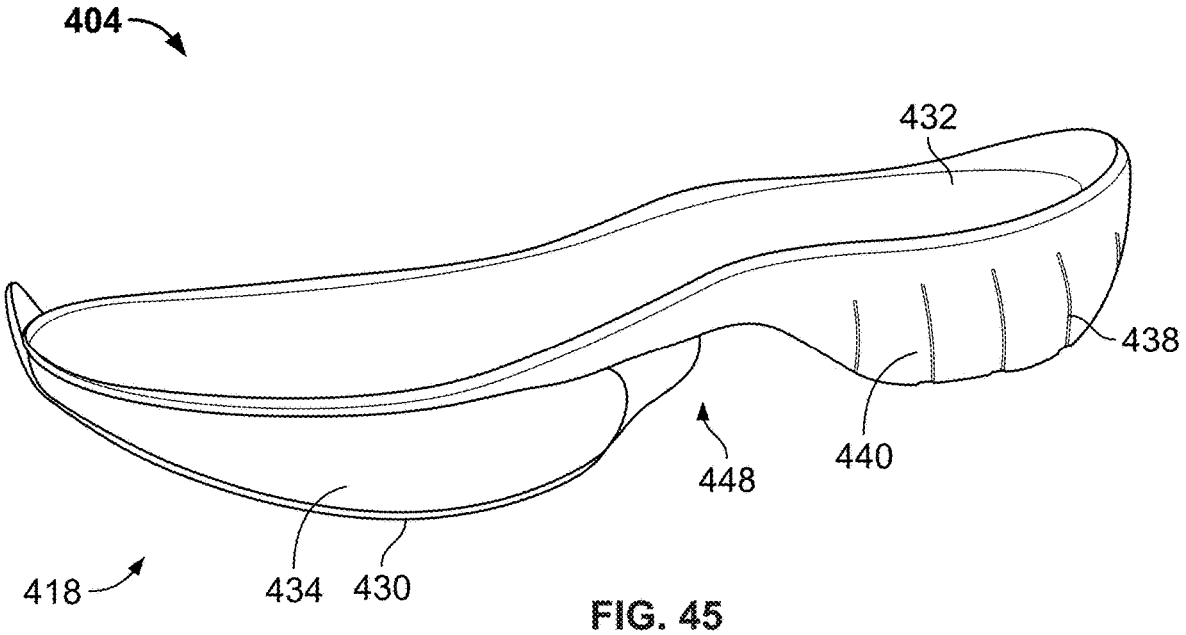
FIG. 45 is a top, lateral side view of the sole structure of the article of footwear of FIG. 44, the sole structure having a sole plate.

The sole structure 304 further includes the sole plate 336, which as best shown in FIGS. 41-43, includes a curved portion 350 and a rear portion 352, which may be relatively planar. The curved portion 350 may also include an anterior curved portion 354 and a posterior curved portion 356. The anterior curved portion 354 and the posterior curved portion 356 may each individually include one or more radii of curvature.

With reference to FIG. 34, the curved portion 350 of the plate 336 may be positioned within the second cushioning member 334 and the rear portion 352 of the plate 336 may be positioned above the first cushioning member 332. Further, a portion of the posterior curved portion 356 may extend between a gap 358 between the first cushioning member 332 and the second cushioning member 334. Resultantly, in this embodiment, a portion of the plate 336 does not include a cushioning member—such as the first cushioning member 332 or the second cushioning member 334—above, below, or between the plate 336. Thus, the plate 336 is spaced from the upper 302 and a gap, or absence of material, is present between the plate 336 and the upper 302 approximate the midfoot region 310 and/or the heel region 312 (see FIG. 29). In some embodiments, the sole plate 336 has a uniform thickness. For example, in particular embodiments, the thickness is approximately 1.2 centimeters.

In some embodiments, the sole plate 336 comprises a PU plastic, such as a thermoplastic polyurethane (TPU) material, for example. Other thermoplastic elastomers consisting of block copolymers are also possible. In other embodiments, the sole plate 336 can include carbon fiber, for example.

As briefly noted herein, in some embodiments, the outsole 330 or the ground-engaging surface is not continuous along the article of footwear 300. For example, as best shown in FIG. 34, there is a spacing or gap 358, or an absence of a ground-engaging surface, along the article of footwear 300, which is located within the midfoot region 310 of the article of footwear 300.

FIGS. 44-55 show another configuration of an article of footwear 400. Similar to the sole structures 104, 204, 304, the sole structure 404 is configured to be attached to an upper 402 and together define an interior cavity into which a foot may be inserted. Like the other sole structures, the sole structure 404 can be defined by a forefoot region 408, a midfoot region 410, a heel region 412, as well as a medial side 416 (see FIG. 48) and a lateral side 418 (see FIG. 46). Like the other embodiments described herein, unless otherwise specified, the forefoot region, the midfoot region, the heel region, the medial side 416, and the lateral side 418 are intended to define boundaries or areas of the article of footwear 400. To that end, the forefoot region, the midfoot region, the heel region, the medial side 416, and the lateral side 418 generally characterize sections of the article of footwear 400. Further, both the upper 402 and the sole structure 404 may be characterized as having portions within the forefoot region 408, the midfoot region 410, the heel region 412, and on the medial side 416 and the lateral side 418. Therefore, the upper 402 and the sole structure 404, and/or individual portions of the upper 402 and the sole structure 404, may include portions thereof that are disposed within the forefoot region 408, the midfoot region 410, the heel region 412, and on the medial side 416 and the lateral side 418.

The sole structure 404 is connected or secured to the upper 402 and extends between a foot of a user and the ground when the article of footwear 400 is worn by the user. The sole structure 404 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user. As will be further discussed herein, the sole structure 404 of the present embodiment of the invention includes one or more components that provide the sole structure 404 with preferable spring and damping properties.

Figure 49:
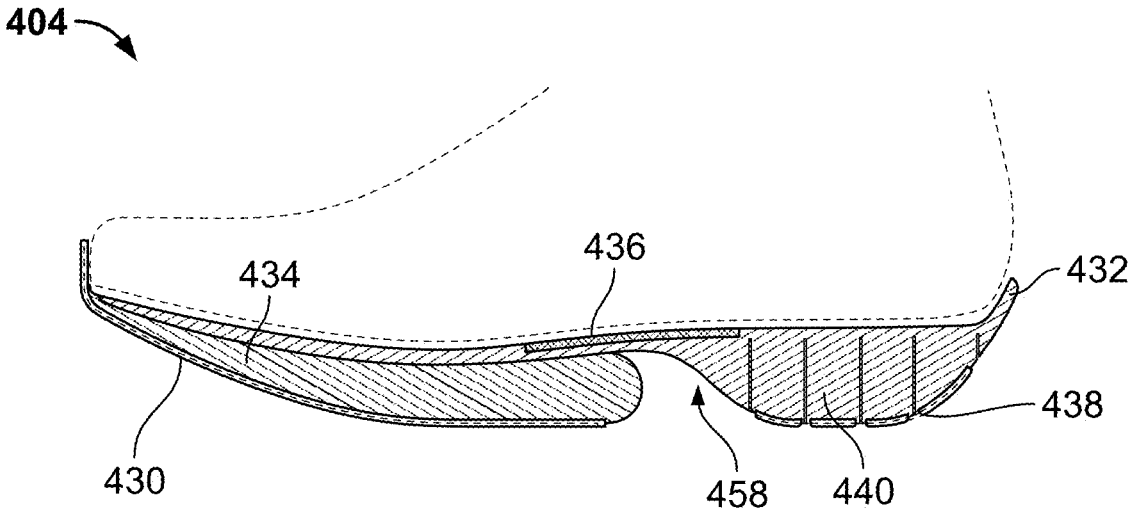
FIG. 49 is a cross-sectional view of the sole structure of FIG. 47 taken along line 49-49 thereof.

The sole structure 404 includes an outsole 430, a first cushioning member 432, a second cushioning member 434, and a sole plate 436 (see FIG. 49). The outsole 430 may define a bottom end or surface of the sole structure 404 across the heel region 412, the midfoot region 410, and the forefoot region 408. Further, the outsole 430 may be a ground-engaging portion or include a ground-engaging surface of the sole structure 404 and may be opposite of the insole thereof. The outsole 430 may be formed from one or more materials to impart durability, wear-resistance, abrasion resistance, or traction to the sole structure 404. In some embodiments, the outsole 430 may be formed from rubber, for example.

Figures 46, 47, 48:
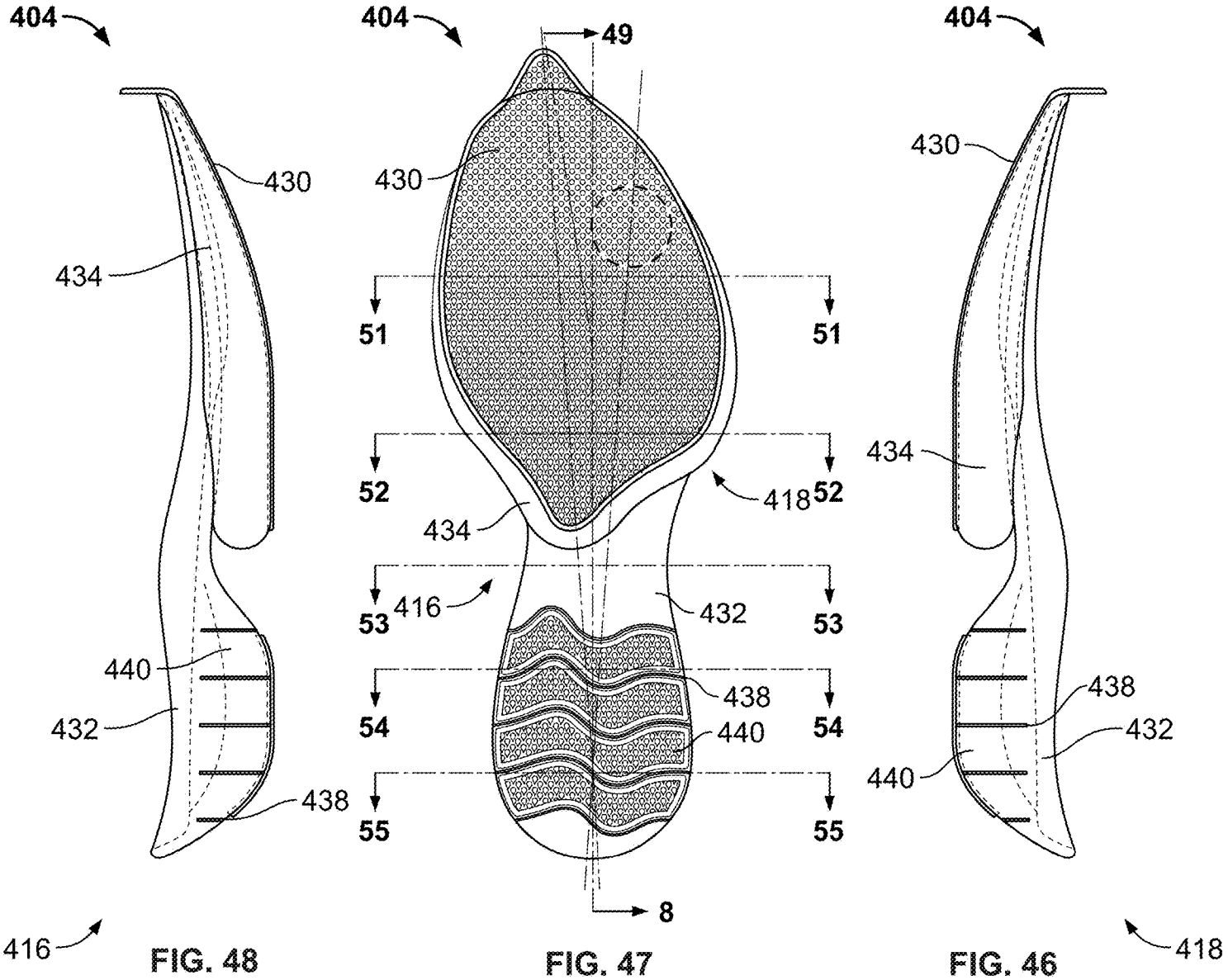
FIG. 46 is a lateral side view of the sole structure of FIG. 45.
FIG. 47 is a bottom view of the sole structure of FIG. 45.
FIG. 48 is a medial side view of the sole structure of FIG. 45.

The first cushioning member 432 may be positioned adjacent to and on top of the outsole 430 in the heel region 412, and positioned adjacent to and on top of the second cushioning member 434 in the midfoot region 410 and forefoot region 408. The first cushioning member 432 may include one or more longitudinal grooves or flex lines 438 that extend between the medial side 416 and the lateral side 418, which segments the first cushioning member 432 in the heel region 412. For example, in the particular embodiment shown in FIGS. 44-55, the first cushioning member 432 includes five flex lines 438, which define four flex regions 440. Further, as best shown in FIG. 47, the flex lines 438 may have a sinusoidal shape between the medial side 416 and the lateral side 418.

The second cushioning member 434 may be positioned adjacent to and on top of the outsole 430 in the midfoot region 410 and forefoot region 408. As will be further discussed herein, the second cushioning member 434 may also be positioned between or be enclosed within the sole plate 436 in the forefoot region 408 (see FIG. 49).

The first cushioning member 432 and/or the second cushioning member 434 may be individually constructed from a thermoplastic material, such as polyurethane (PU), for example, and/or an ethylene-vinyl acetate (EVA), copolymers thereof, or a similar type of material. In other embodiments, the first cushioning member 432 and/or the second cushioning member 434 may be an EVA-Solid-Sponge ("ESS") material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. The first cushioning member 432 and/or the second cushioning member 434 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®.

In embodiments where the first cushioning member 432 and/or the second cushioning member 434 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam, which may be used as the first cushioning member 432 and, more preferably, the second cushioning member 434. In further embodiments, the first cushioning member 432 and/or the second cushioning member 434 may be formed using alternative methods known in the art, including the use of an expansion press, an injection machine, a pellet expansion process, a cold foaming process, a compression molding technique, die cutting, or any combination thereof. For example, the first cushioning member 432 and/or the second cushioning member 434 may be formed using a process that involves an initial foaming step in which supercritical gas is used to foam a material and then compression molded or die cut to a particular shape.

Figure 50:
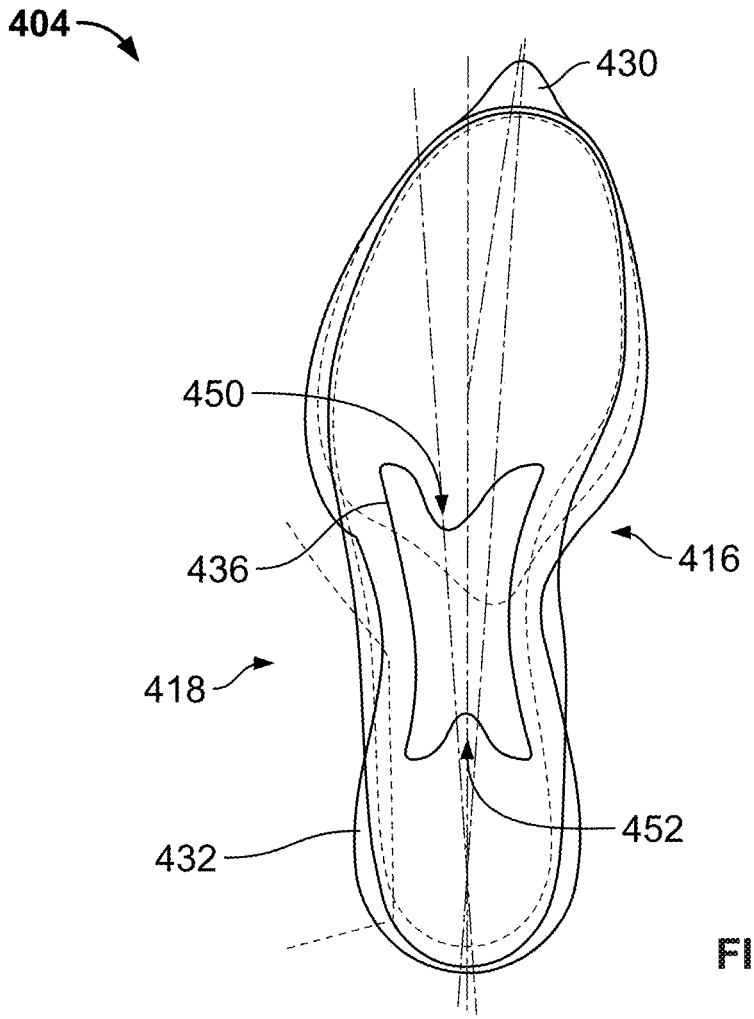
FIG. 50 is a top view of the sole structure of FIG. 45.
Figure 51:
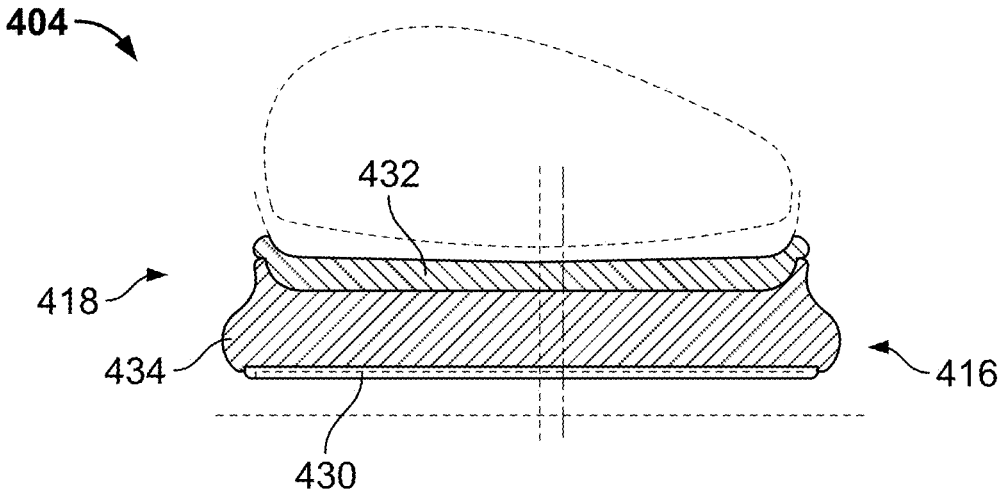
FIG. 51 is a cross-sectional view of the sole structure of FIG. 47 taken along line 51-51 thereof.
Figure 52:
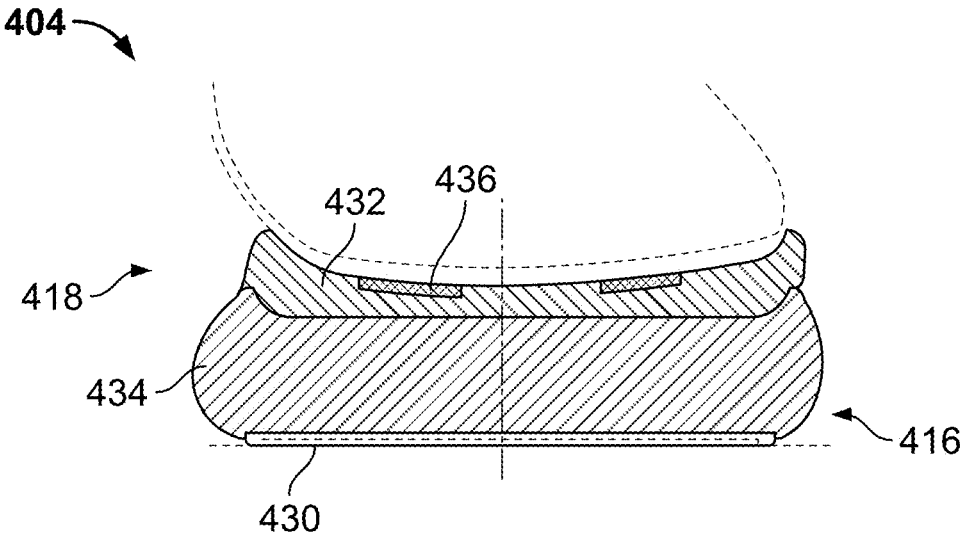
FIG. 52 is a cross-sectional view of the sole structure of FIG. 47 taken along line 52-52 thereof.
Figure 53:
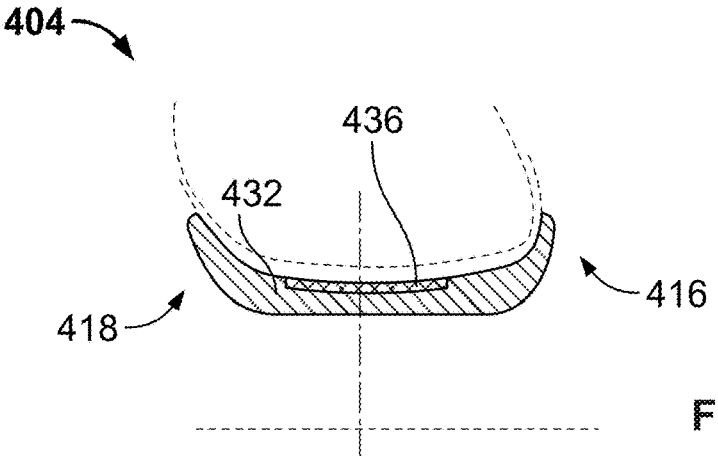
FIG. 53 is a cross-sectional view of the sole structure of FIG. 47 taken along line 53-53 thereof.
Figure 54:
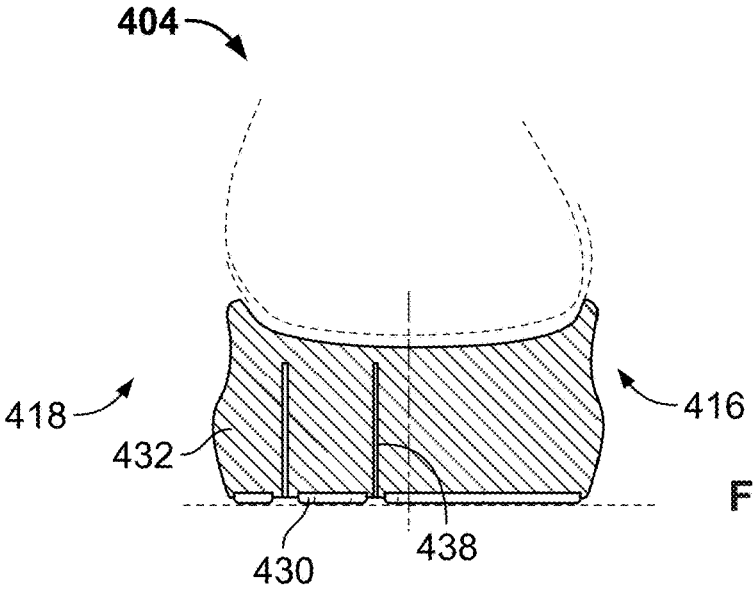
FIG. 54 is a cross-sectional view of the sole structure of FIG. 47 taken along line 54-54 thereof.
Figure 55:
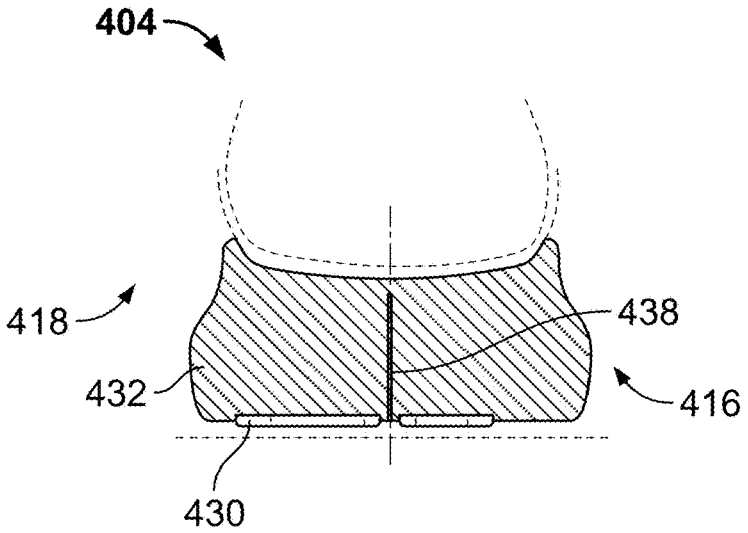
FIG. 55 is a cross-sectional view of the sole structure of FIG. 47 taken along line 55-55 thereof.
Figure 56:
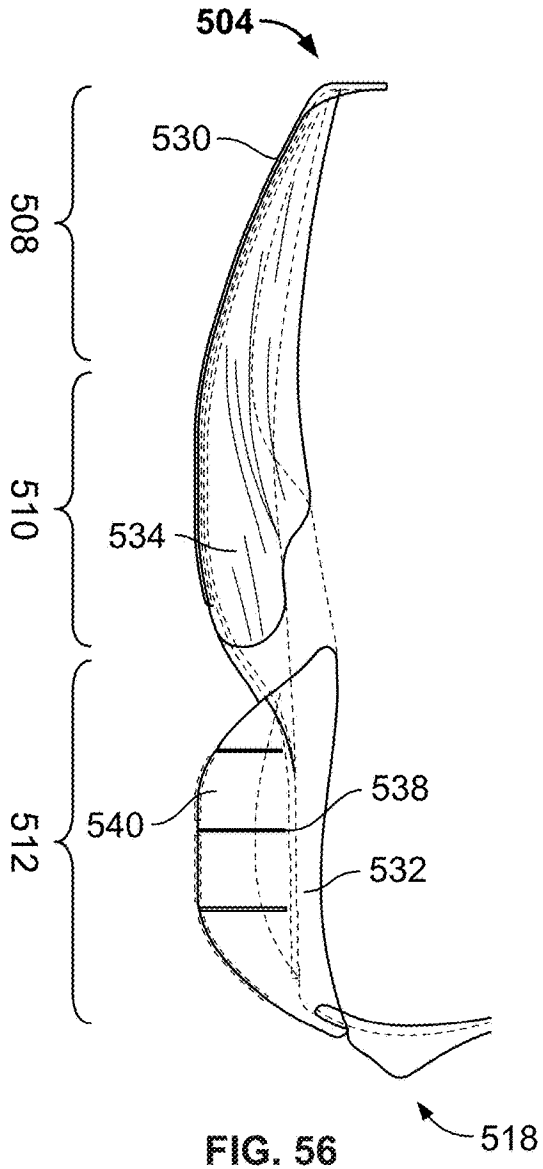
FIG. 56 is a lateral side view of an article of footwear configured as a left shoe that includes a sole structure, according to yet another embodiment of the disclosure.
Figure 57:
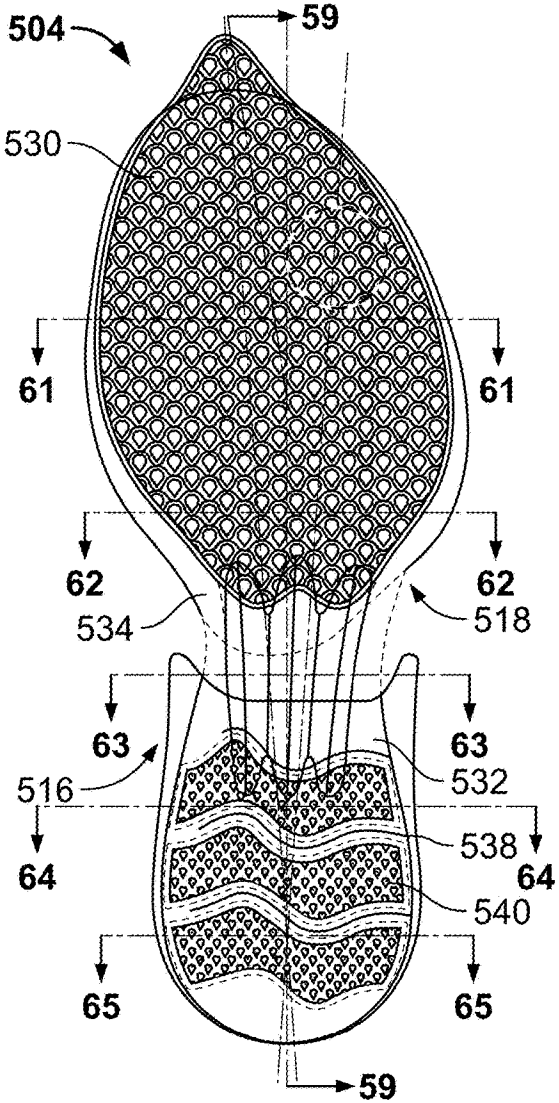
FIG. 57 is a bottom view of the sole structure of FIG. 56.
Figure 58:
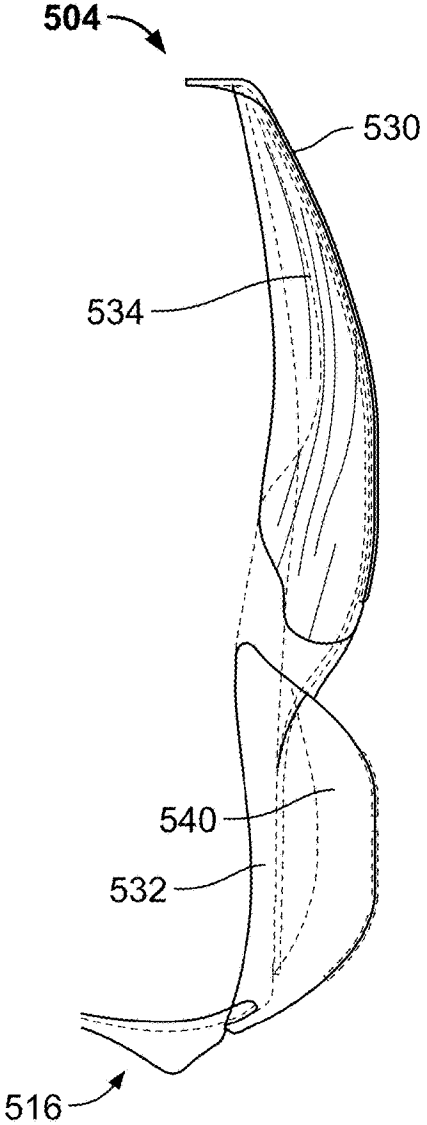
FIG. 58 is a medial side view of the sole structure of FIG. 56.

The sole structure 404 further includes the sole plate 436, which as best shown in FIGS. 49 and 50, is a relatively planar structure having a first cut-out portion 450 near a front end thereof and a second cut-out portion 452 near a rear end thereof.

With particular reference to FIG. 49, the plate 436 may be positioned above the first cushioning member 432 in the midfoot region 410. In some embodiments, the sole plate 436 has a uniform thickness. For example, in particular embodiments, the thickness is approximately 1.8 centimeters.

In some embodiments, the sole plate 436 comprises a PU plastic, such as a thermoplastic polyurethane (TPU) material, for example. Other thermoplastic elastomers consisting of block copolymers are also possible. In other embodiments, the sole plate 436 can include carbon fiber, for example.

As briefly noted herein, in some embodiments, the outsole 430 or the ground-engaging surface is not continuous along the article of footwear 400. For example, as best shown in FIG. 49, there is a spacing or gap 458, or an absence of a ground-engaging surface, along the article of footwear 400, which is located within the midfoot region 410 of the article of footwear 400.

FIGS. 56-65 show another configuration of an article of footwear 500 having an upper 502 and a sole structure 504. Similar to the sole structures 104, 204, 304, 404, the sole structure 504 is configured to be attached to the upper 502 and together define an interior cavity into which a foot may be inserted. Also similar to the other sole structures, the sole structure 504 includes a forefoot region 508, a midfoot region 510, a heel region 512, a medial side 516 (see FIG. 58) and a lateral side 518 (see FIG. 56). Unless otherwise specified, the forefoot region 508, the midfoot region 510, the heel region 512, the medial side 516, and the lateral side 518 are intended to define boundaries or areas of the article of footwear 500. Further, as will be further discussed herein, the sole structure 504 of the present embodiment of the invention includes one or more components that provide the sole structure 504 with preferable spring and damping properties.

Figure 59:
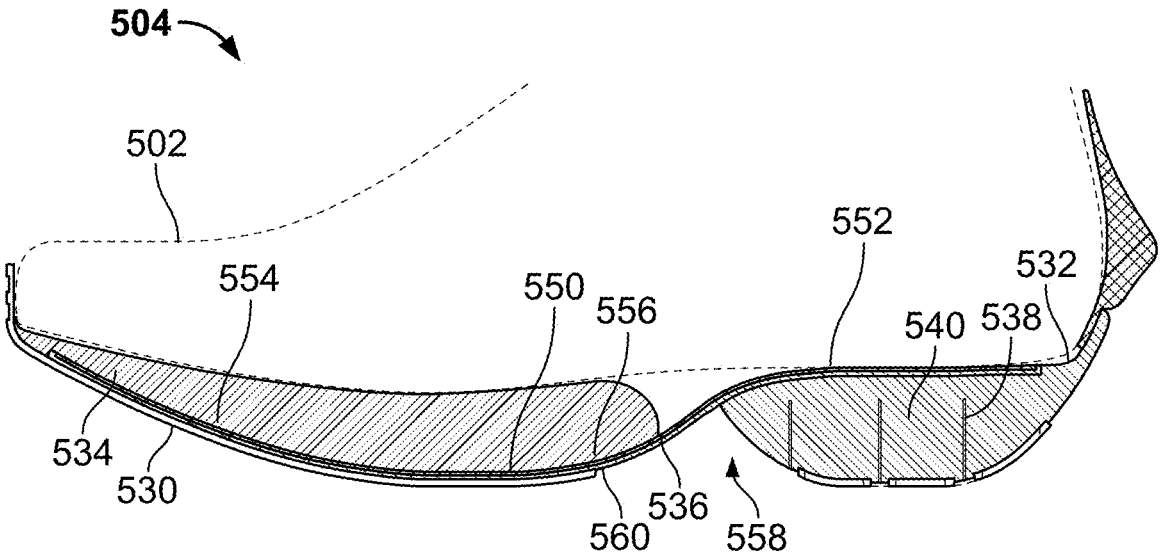
FIG. 59 is a cross-sectional view of the sole structure of FIG. 57 taken along line 59-59 thereof.
Figure 60:
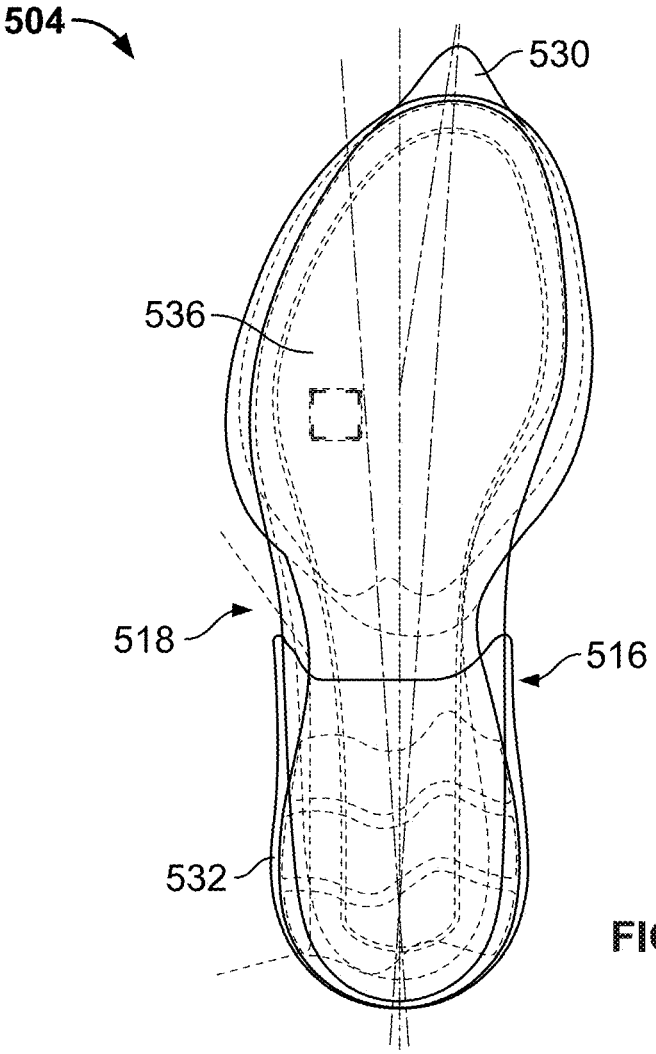
FIG. 60 is a top view of the sole structure of FIG. 56.
Figure 61:
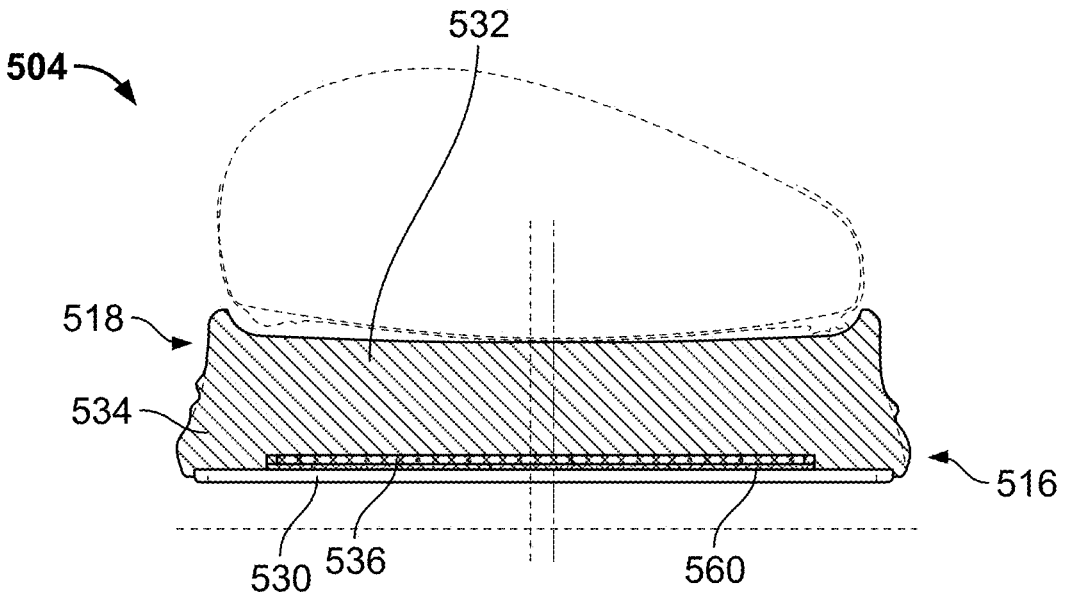
FIG. 61 is a cross-sectional view of the sole structure of FIG. 57 taken along line 61-61 thereof.
Figure 62:
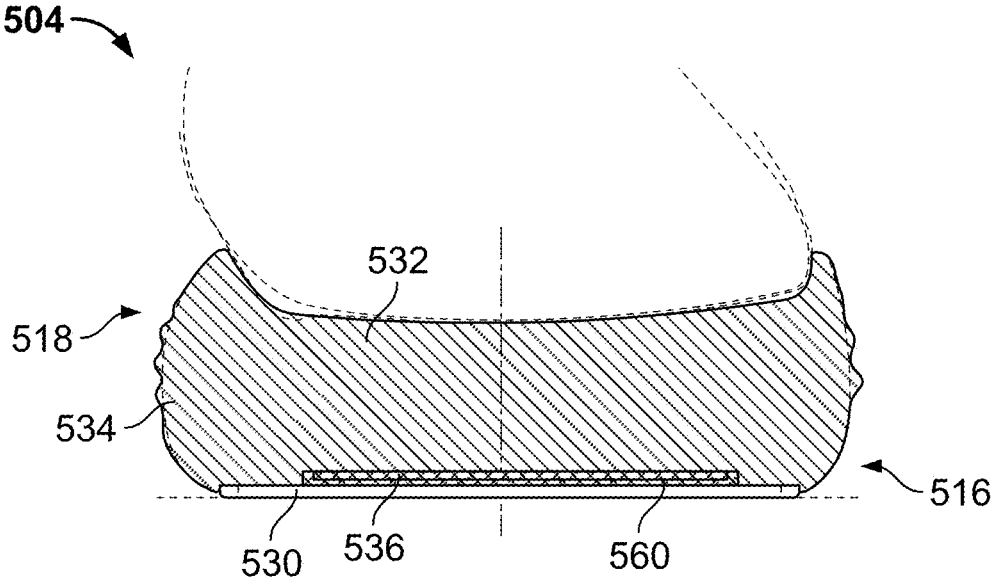
FIG. 62 is a cross-sectional view of the sole structure of FIG. 57 taken along line 62-62 thereof.
Figure 63:
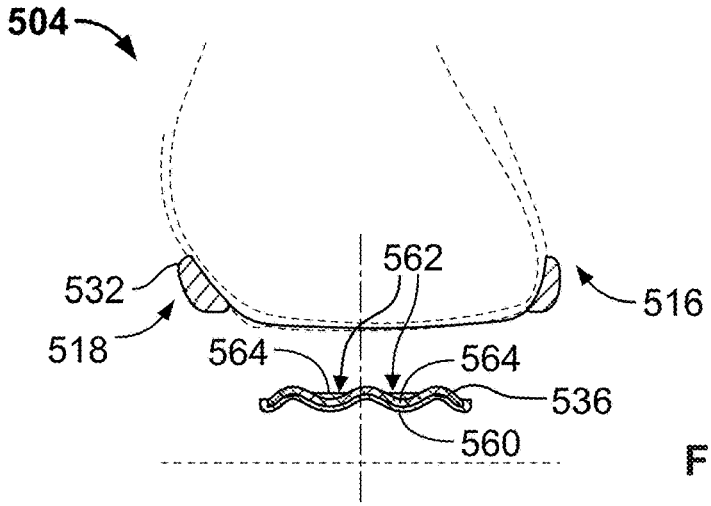
FIG. 63 is a cross-sectional view of the sole structure of FIG. 57 taken along line 63-63 thereof.
Figure 64:
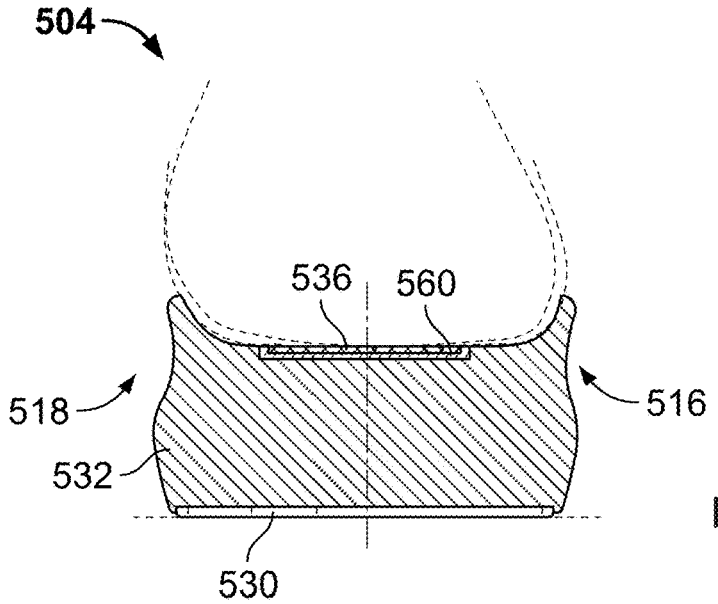
FIG. 64 is a cross-sectional view of the sole structure of FIG. 57 taken along line 64-64 thereof.
Figure 65:
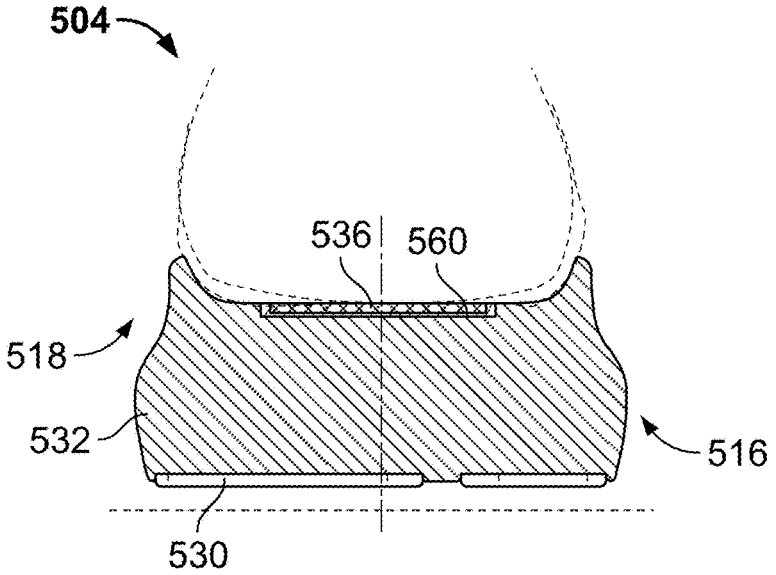
FIG. 65 is a cross-sectional view of the sole structure of FIG. 56 taken along line 65-65 thereof.
Figure 66:
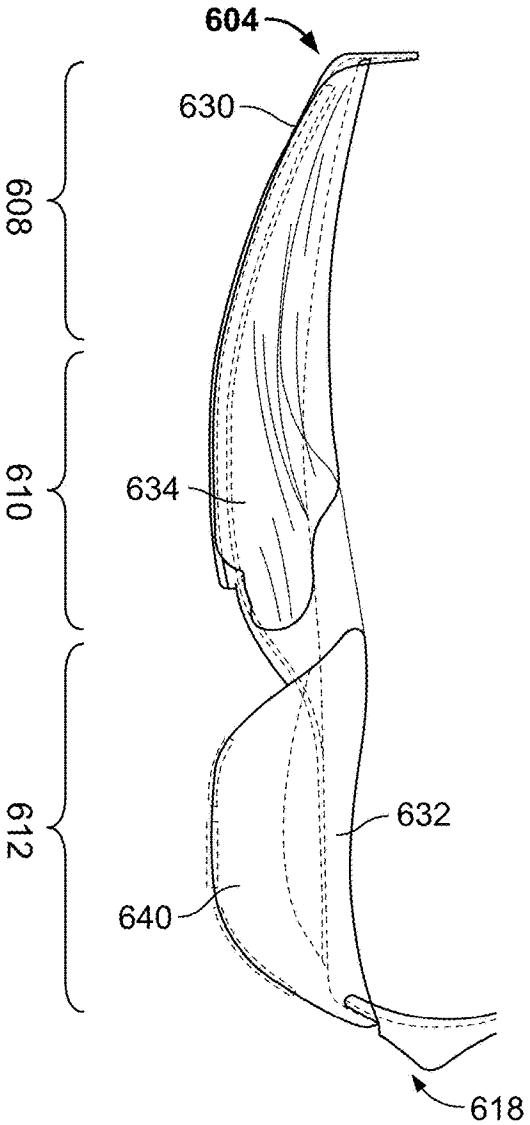
FIG. 66 is a lateral side view of an article of footwear configured as a left shoe that includes a sole structure, according to another embodiment of the disclosure.
Figure 67:
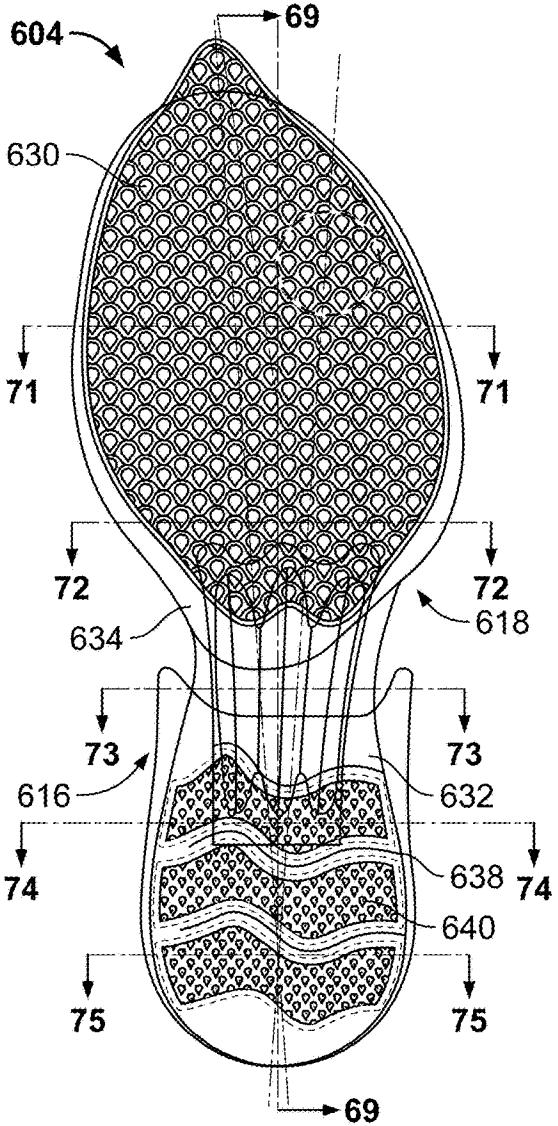
FIG. 67 is a bottom view of the sole structure of FIG. 66.
Figure 68:
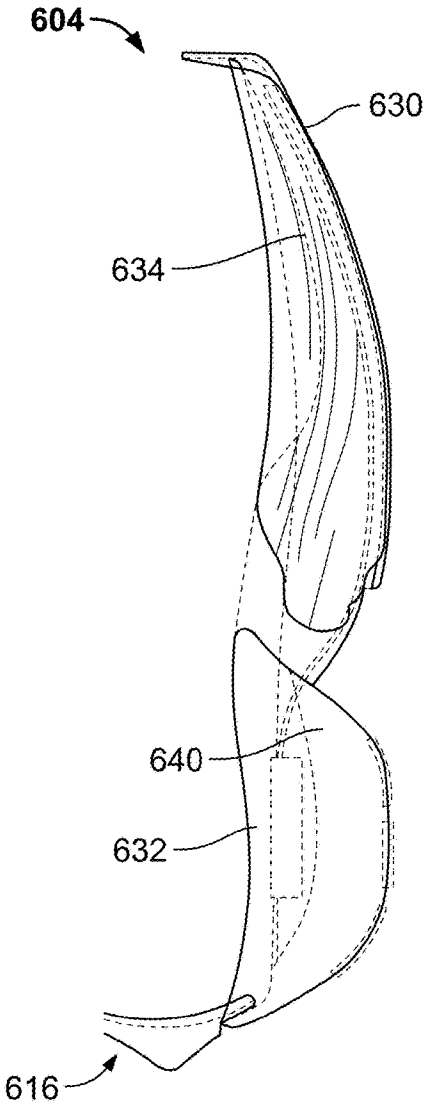
FIG. 68 is a medial side view of the sole structure of FIG. 66.

The sole structure 504 also includes an outsole 530, a first cushioning member 532, a second cushioning member 534, and a sole plate 536 (see FIG. 59). The first cushioning member 532 may be positioned adjacent to and on top of the outsole 530 in the heel region 512. The first cushioning member 532 may also be positioned adjacent to and below the sole plate 536. The first cushioning member 532 may include one or more longitudinal grooves or flex lines 538 that extend between the medial side 516 and the lateral side 518, which segments the first cushioning member 532 in the heel region 512.

The second cushioning member 534 may be positioned adjacent to and on top of the outsole 530 in the midfoot region 510 and forefoot region 508. As will be further discussed herein, the sole plate 536 may also extend between the second cushioning member 534 and the outsole 530 (see FIG. 59). The first cushioning member 532 and/or the second cushioning member 534 may be individually constructed from a thermoplastic material, such as polyurethane (PU), for example, and/or an ethylene-vinyl acetate (EVA), copolymers thereof, or a similar type of material. In other embodiments, the first cushioning member 532 and/or the second cushioning member 534 may be an EVA-Solid-Sponge ("ESS") material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. The first cushioning member 532 and/or the second cushioning member 534 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®.

The sole structure 504 further includes the sole plate 536, which as best shown in FIG. 59, includes a curved portion 550 and a rear portion 552, which may be relatively planar. The curved portion 550 may also include an anterior curved portion 554 and a posterior curved portion 556. The anterior curved portion 554 and the posterior curved portion 556 may each individually include one or more radii of curvature.

With reference to FIG. 59, the curved portion 550 of the plate 536 may be positioned below the second cushioning member 534 and the rear portion 552 of the plate 536 may be positioned above the first cushioning member 532. Further, a portion of the posterior curved portion 556 may extend between a gap 558 between the first cushioning member 532 and the second cushioning member 534. In some embodiments, the sole plate 536 has a uniform thickness. For example, in particular embodiments, the thickness is approximately 1.2 centimeters. In some embodiments, the sole plate 536 comprises a PU plastic, such as a thermoplastic polyurethane (TPU) material, for example. Other thermoplastic elastomers consisting of block copolymers are also possible. In other embodiments, the sole plate 536 can include carbon fiber, for example.

As briefly noted herein, in some embodiments, the outsole 530 or the ground-engaging surface is not continuous along the article of footwear 500. For example, as best shown in FIG. 59, there is a spacing or gap 558, or an absence of a ground-engaging surface, along the article of footwear 500, which is located within the midfoot region 510 and/or the heel region 512 of the article of footwear 500. In this embodiment, similar to the plate 336, a portion of the plate 536 does not include a cushioning member—such as the first cushioning member 532 or the second cushioning member 534—above, below, or between the plate 536. Thus, the plate 536 is spaced from the upper 502 and a gap, or absence of material, is present between the plate 536 and the upper 502 approximate the midfoot region 510 and/or the heel region 512 (see FIG. 59).

In some embodiments, the sole structure 504 may also include a second plate 560. In the particular embodiment shown in FIGS. 56-65, the second plate 560 encases the sole plate 536 such that the sole plate 536 sits within the second plate 560. Additionally, as best shown in FIG. 59, the second plate 560 extends across the forefoot region 508, the midfoot region 510, and the heel region 512. Thus, the second plate 560 is positioned below the sole plate 536 across an entire length thereof. In other embodiments, as will be further discussed herein, the second plate 560 may only extend across a portion of the sole plate 536 and may be positioned at a location along the sole structure 504 where the sole plate 536 needs targeted structural support. The second plate 560 may be constructed from similar materials to the sole plate 536, which have already been discussed herein. However, in particular embodiments, the material used to construct the second plate 560 may also differ from the material used to construct the sole plate 536 such that the second plate 560 provides added reinforcement to the sole plate 536. For example, in one embodiment, the sole plate 536 may be constructed from a carbon fiber material and the second plate 560 may be constructed from thermoplastic polyurethane (TPU) to support the sole plate 536. Additionally, the second plate 560 may support the structural integrity of the sole plate 536 and prevent the sole plate 536 from fracturing during use thereof.

In addition to the second plate 560, an amount of material may be injected into one or more grooves of the sole plate 536. More particularly, in this embodiment, the sole plate 536 may include two grooves 562 (see FIG. 63) and a material 564 may be injected or positioned within the grooves 562. Similar to the second plate 560, the material injected into the grooves 562 may provide further structural support to the sole plate 536 and targeted support to the sole plate 536. For example, in this particular embodiment, the grooves are provided across the midfoot or arch region of the sole structure 504, and therefore, the material 564 may provide support to the sole plate 536 in the arch region thereof, which thereby provides further support to a user's foot in the arch region of the sole structure 504. The injected material 564 may be a suitable plastic material, such as thermoplastic polyurethane (TPU) or the like.

FIGS. 66-75 show another configuration of an article of footwear 600 having an upper 602 and a sole structure 604. Similar to the sole structures 104, 204, 304, 404, 504 the sole structure 604 is configured to be attached to the upper 602 and together define an interior cavity into which a foot may be inserted. The sole structure 604, similar to the other sole structures, includes a forefoot region 608, a midfoot region 610, a heel region 612, a medial side 616 (see FIG. 68) and a lateral side 618 (see FIG. 66). Unless otherwise specified, the forefoot region 608, the midfoot region 610, the heel region 612, the medial side 616, and the lateral side 618 are intended to define boundaries or areas of the article of footwear 600.

Figure 69:
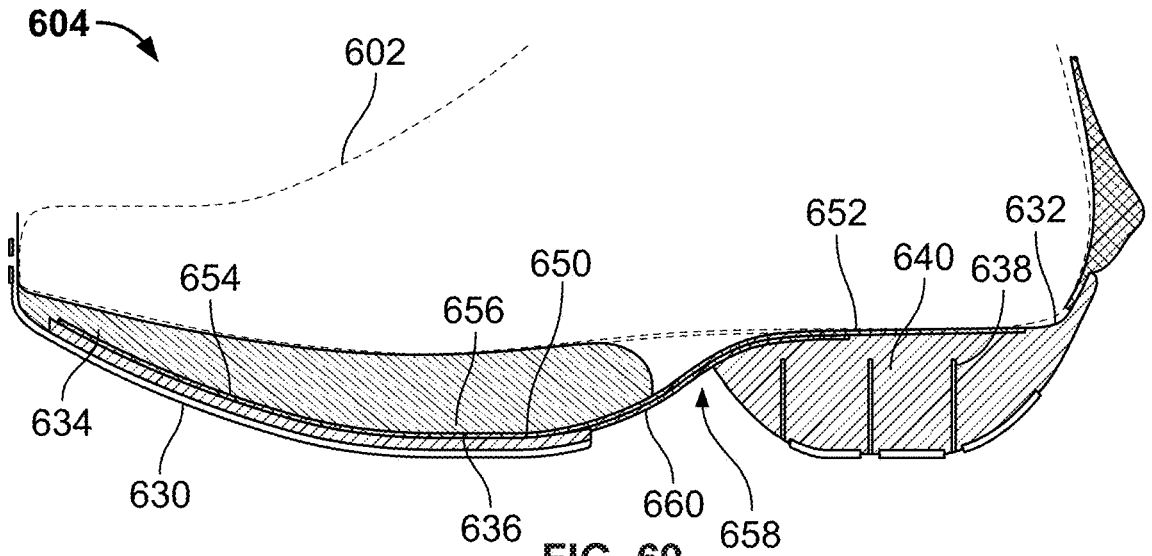
FIG. 69 is a cross-sectional view of the sole structure of FIG. 67 taken along line 69-69 thereof.
Figure 70:
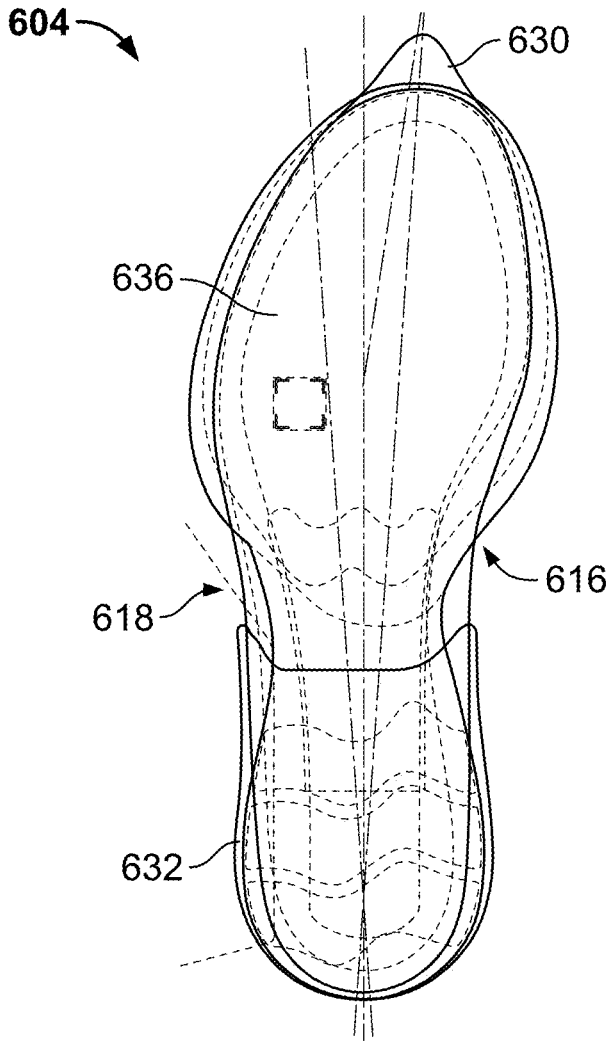
FIG. 70 is a top view of the sole structure of FIG. 66.
Figure 71:
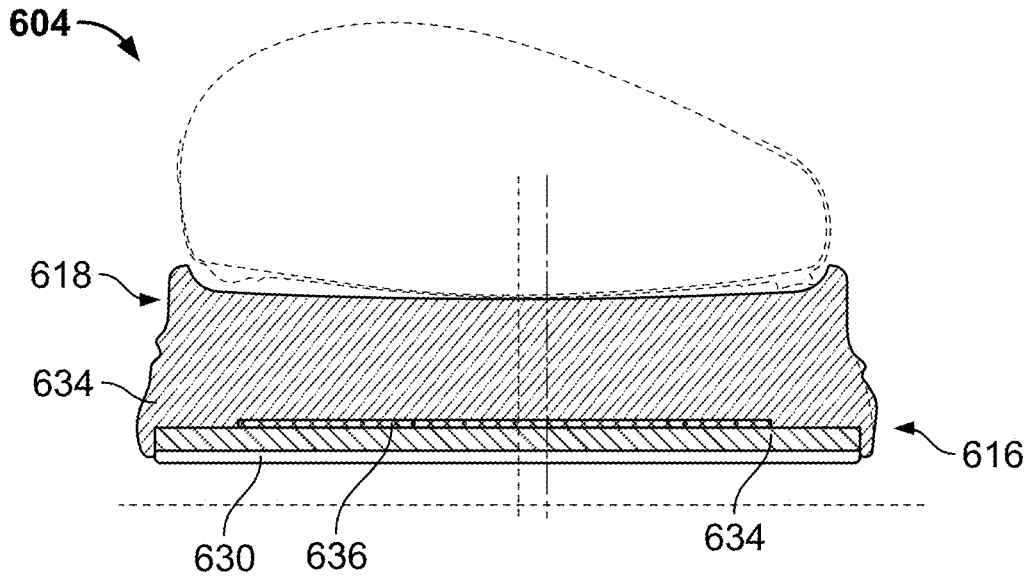
FIG. 71 is a cross-sectional view of the sole structure of FIG. 67 taken along line 71-71 thereof.
Figure 72:
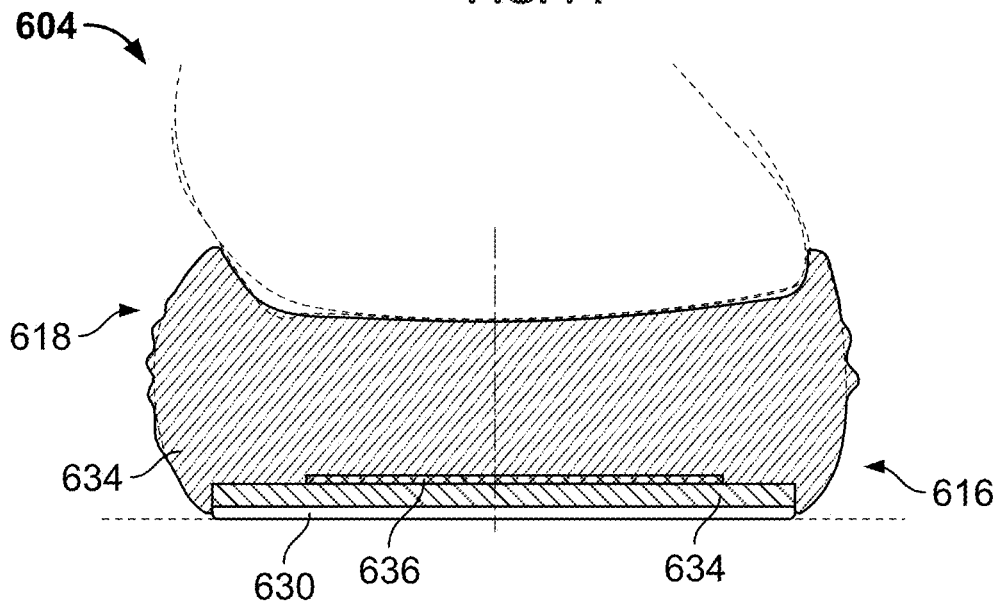
FIG. 72 is a cross-sectional view of the sole structure of FIG. 67 taken along line 72-72 thereof.
Figure 73:
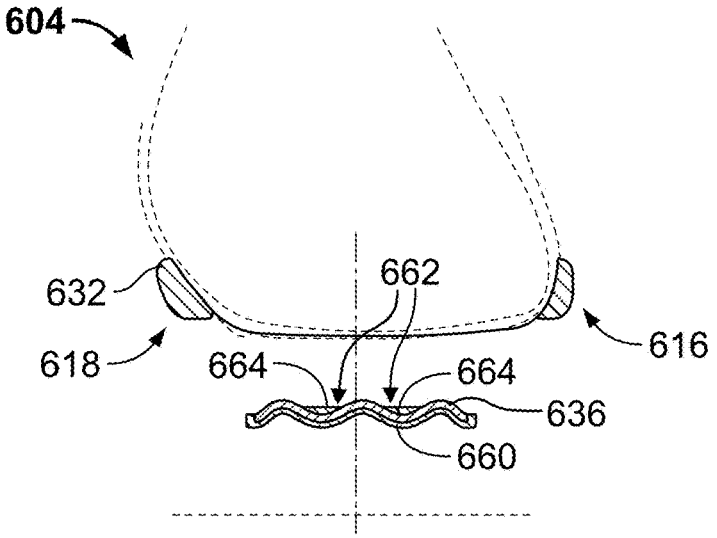
FIG. 73 is a cross-sectional view of the sole structure of FIG. 67 taken along line 72-72 thereof.
Figure 74:
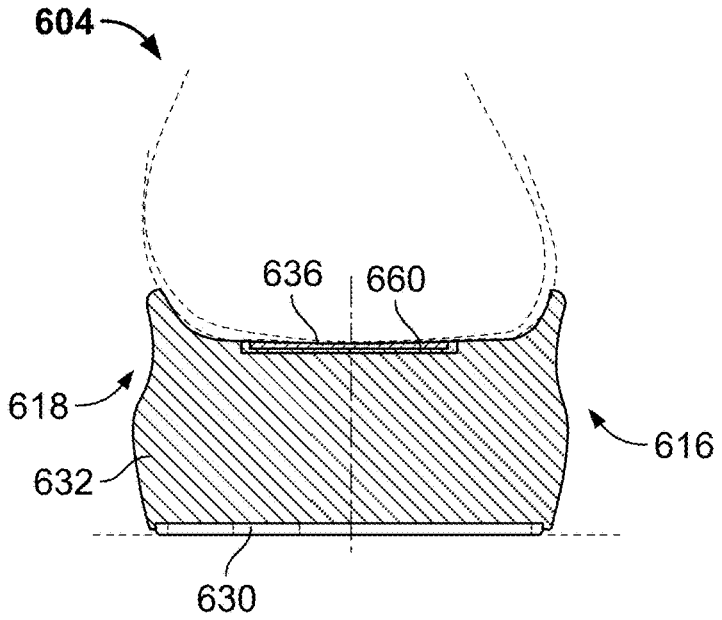
FIG. 74 is a cross-sectional view of the sole structure of FIG. 67 taken along line 72-72 thereof.
Figure 75:
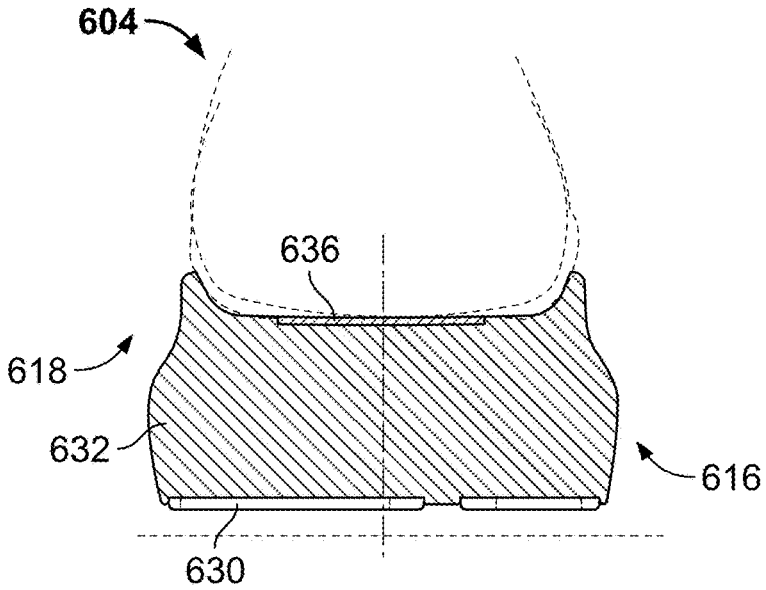
FIG. 75 is a cross-sectional view of the sole structure of FIG. 67 taken along line 72-72 thereof.
Figure 76:
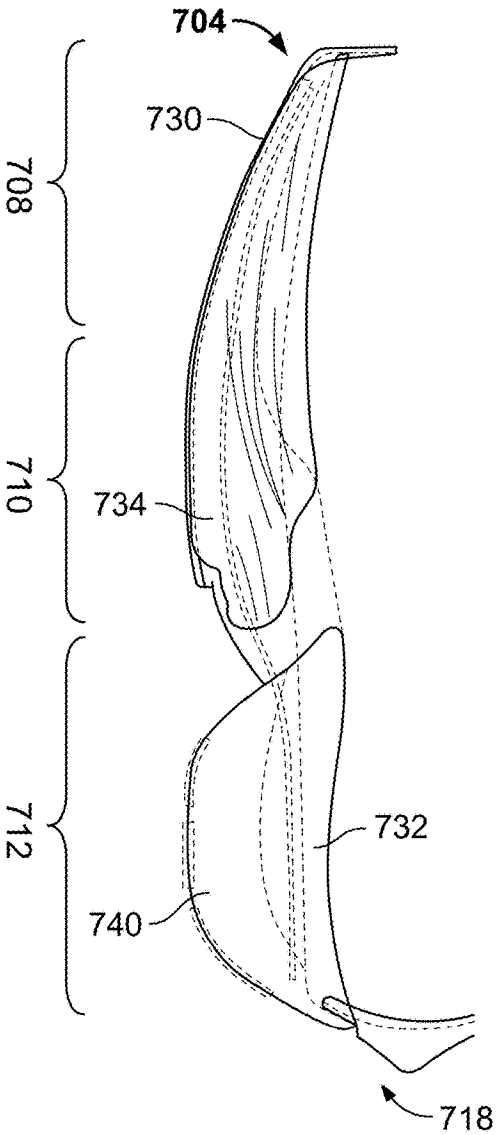
FIG. 76 is a lateral side view of an article of footwear configured as a left shoe that includes a sole structure, according to yet another embodiment of the disclosure.
Figure 77:
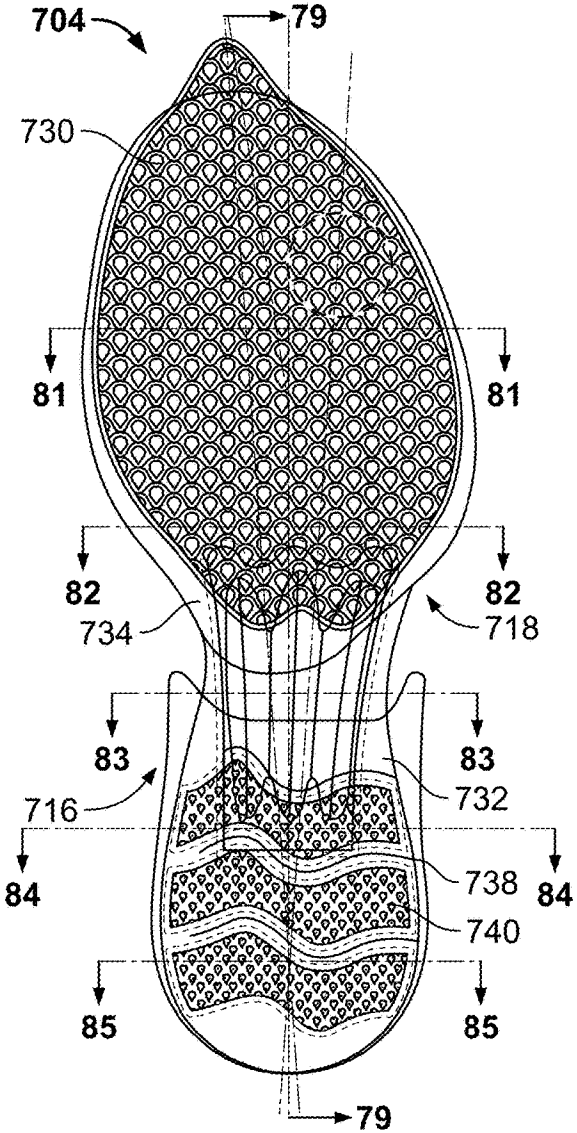
FIG. 77 is a bottom view of the sole structure of FIG. 76.
Figure 78:
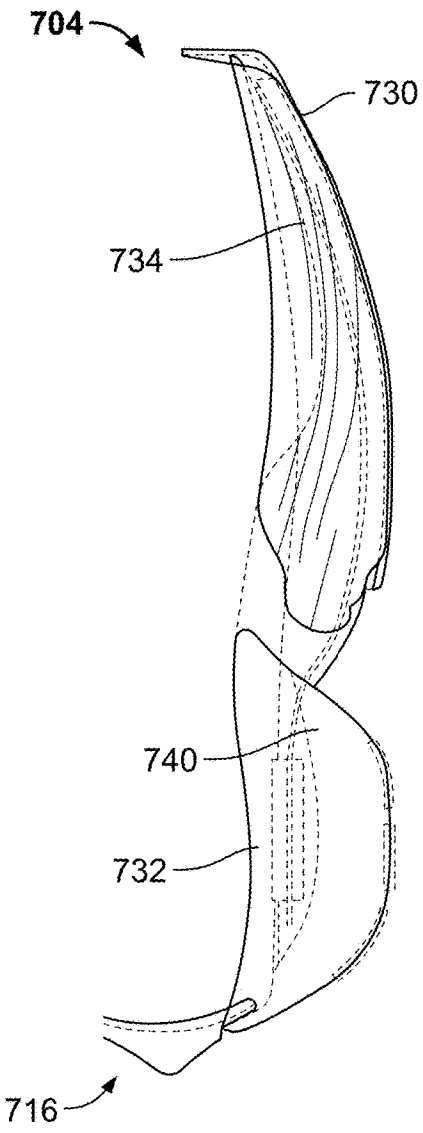
FIG. 78 is a medial side view of the sole structure of FIG. 76.

The sole structure 604 also includes an outsole 630, a first cushioning member 632, a second cushioning member 634, and a sole plate 636 (see FIG. 69). The outsole 630 may define a bottom end or surface of the sole structure 604 across the heel region 612, the midfoot region 610, and the forefoot region 608.

The first cushioning member 632 may be positioned adjacent to and on top of the outsole 630 in the heel region 612. The first cushioning member 632 may also be positioned adjacent to and below the sole plate 636. The first cushioning member 632 may include one or more longitudinal grooves or flex lines 638 that extend between the medial side 616 and the lateral side 618, which segments the first cushioning member 632 in the heel region 612.

The second cushioning member 634 may be positioned adjacent to and on top of the outsole 630 in the midfoot region 610 and forefoot region 608. As will be further discussed herein, the sole plate 636 may also bifurcate the second cushioning member 634, such that the sole plate 636 is positioned within the second cushioning member 634 (see FIG. 69).

The first cushioning member 632 and/or the second cushioning member 634 may be individually constructed from similar materials to those already disclosed in connection with the other embodiments disclosed herein.

The sole structure 604 further includes the sole plate 636, which as best shown in FIG. 69, includes a curved portion 650 and a rear portion 652, which may be relatively planar. The curved portion 650 may also include an anterior curved portion 654 and a posterior curved portion 656. The anterior curved portion 654 and the posterior curved portion 656 may each individually include one or more radii of curvature.

With reference to FIG. 69, the curved portion 650 of the plate 636 may be positioned within the second cushioning member 634 and the rear portion 652 of the plate 636 may be positioned above the first cushioning member 632. Further, a portion of the posterior curved portion 656 may extend between a gap 658 between the first cushioning member 632 and the second cushioning member 634. In some embodiments, the sole plate 636 has a uniform thickness. For example, in particular embodiments, the thickness is approximately 1.2 centimeters.

In some embodiments, the sole plate 636 comprises a PU plastic, such as a thermoplastic polyurethane (TPU) material, for example. Other thermoplastic elastomers consisting of block copolymers are also possible. In other embodiments, the sole plate 636 can include carbon fiber, for example.

As briefly noted herein, in some embodiments, the outsole 630 or the ground-engaging surface is not continuous along the article of footwear 600. For example, as best shown in FIG. 69, there is a spacing or gap 658, or an absence of a ground-engaging surface, along the article of footwear 600, which is located within the midfoot region 610 of the article of footwear 600.

Similar to the sole structure 504, the sole structure 604 may also include a second plate 660. In the particular embodiment shown in FIGS. 66-75, the second plate 660 partially encases the sole plate 636 such that the sole plate 636 sits within the second plate 660. Additionally, as best shown in FIG. 69, the second plate 660 extends across the midfoot region 610 and the heel region 610. Thus, the second plate 660 is positioned below the sole plate 636 across a portion of the sole plate 636, and more particularly, the arch or midfoot region thereof. In other embodiments, as previously discussed herein, the second plate 660 may extend across an entire length of the sole plate 636 or may be positioned at a location along the sole structure 604 where the sole plate 636 needs targeted structural support. The second plate 660 may be constructed from similar materials to the sole plate 636, which have already been discussed herein. However, in particular embodiments, the material used to construct the second plate 660 may differ from the material used to construct the sole plate 636 such that the second plate 660 provides added reinforcement to the sole plate 636. For example, in one embodiment, the sole plate 636 may be constructed from a carbon fiber material and the second plate 660 may be constructed from thermoplastic polyurethane (TPU) to support the sole plate 636. Additionally, the second plate 660 may support the structural integrity of the sole plate 636 and prevent the sole plate 636 from fracturing during use thereof.

In addition to the second plate 660, an amount of material may be injected into one or more grooves of the sole plate 636. More particularly, in this embodiment, the sole plate 636 may include two grooves 662 (see FIG. 73) and material 664 may be injected or positioned within the grooves 662. Similar to the second plate 660, the material injected into the grooves 662 may provide further structural support to the sole plate 636 and targeted support to the sole plate 636. For example, in this particular embodiment, the grooves are provided across the midfoot or arch region of the sole structure 604, and therefore, the material 664 may provide support to the sole plate 636 in the arch region thereof, which thereby provides further support to a user's foot in the arch region of the sole structure 604. The injected material 664 may be a suitable plastic material, such as thermoplastic polyurethane (TPU) or the like.

FIGS. 76-85 show another configuration of an article of footwear 700 having an upper 702 and a sole structure 704. Similar to the sole structures 104, 204, 304, 404, 504, 604 the sole structure 704 is configured to be attached to the upper 702 and together define an interior cavity into which a foot may be inserted. Further, the sole structure 704 includes a forefoot region 708, a midfoot region 710, a heel region 712, a medial side 716 (see FIG. 78), and a lateral side 718 (see FIG. 76). Unless otherwise specified, the forefoot region 708, the midfoot region 710, the heel region 712, the medial side 716, and the lateral side 718 are intended to define boundaries or areas of the article of footwear 700.

Figure 79:
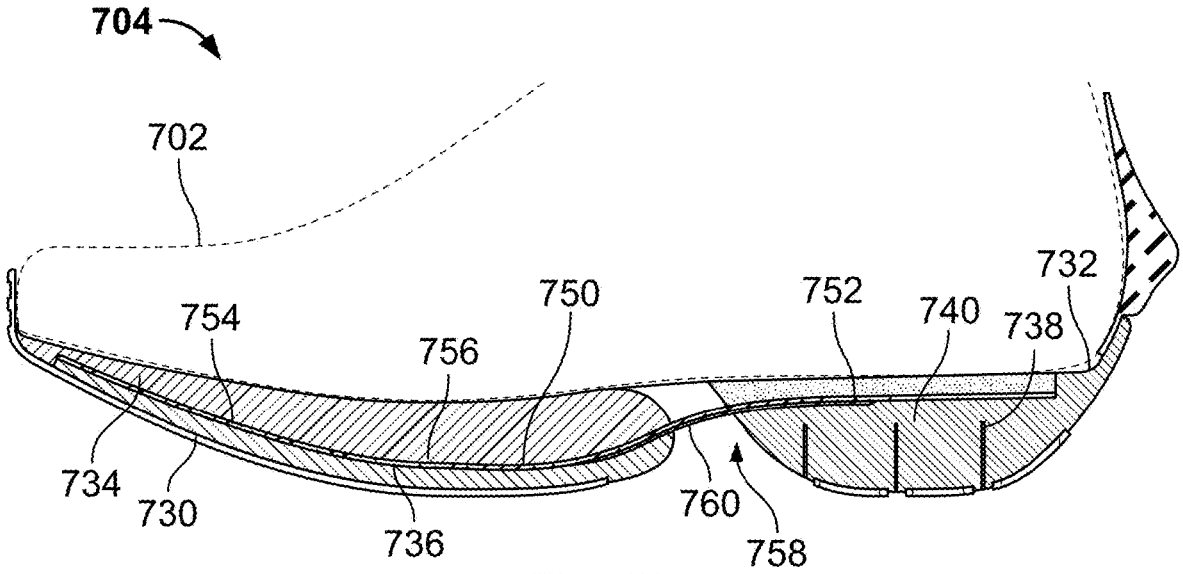
FIG. 79 is a cross-sectional view of the sole structure of FIG. 77 taken along line 79-79 thereof.
Figure 80:
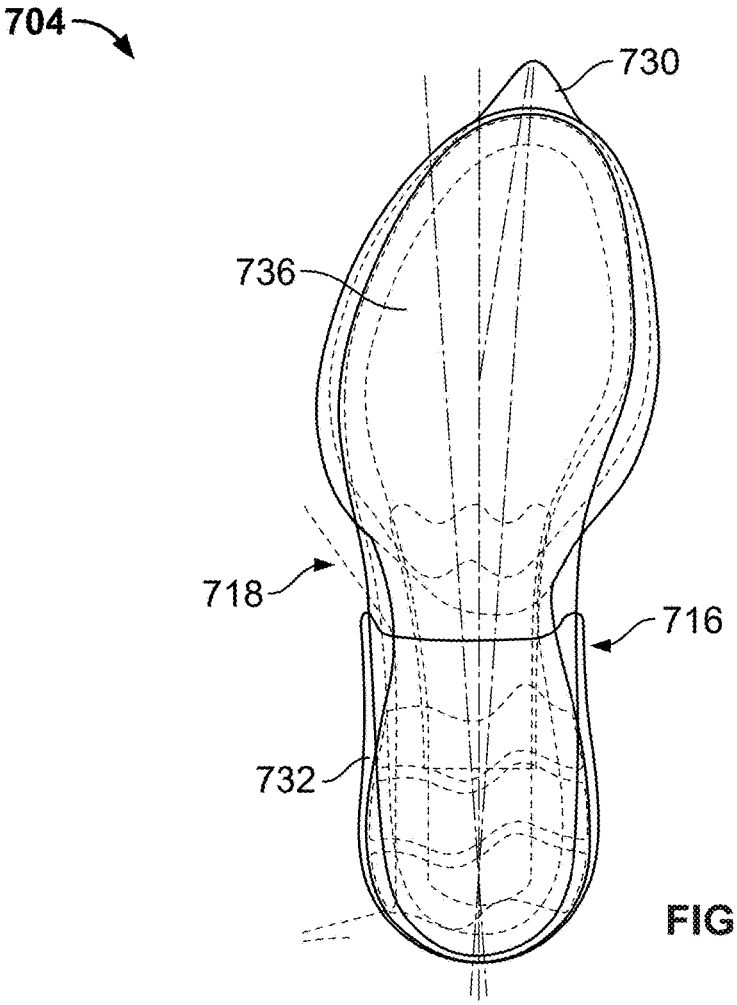
FIG. 80 is a top view of the sole structure of FIG. 76.
Figure 81:
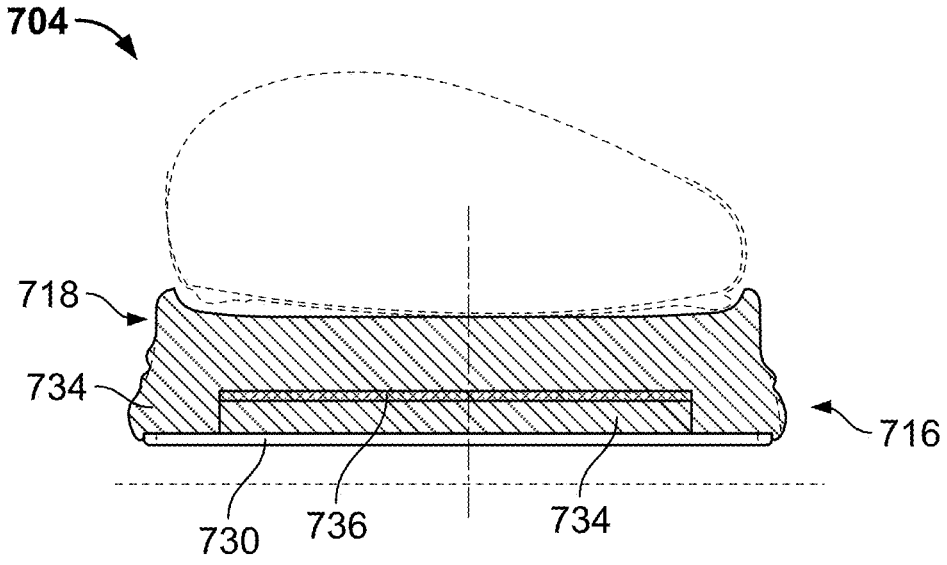
FIG. 81 is a cross-sectional view of the sole structure of FIG. 77 taken along line 81-81 thereof.
Figure 82:
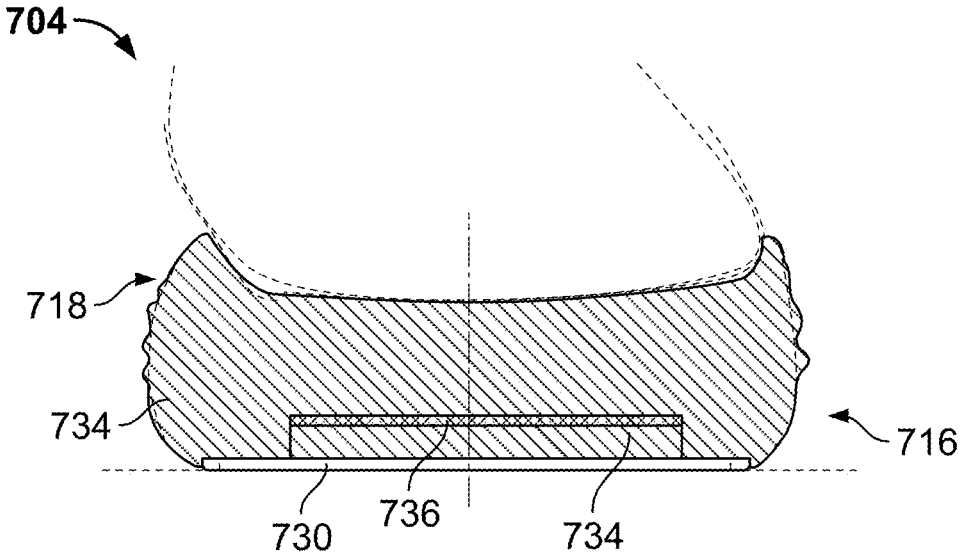
FIG. 82 is a cross-sectional view of the sole structure of FIG. 77 taken along line 81-81 thereof.
Figure 83:
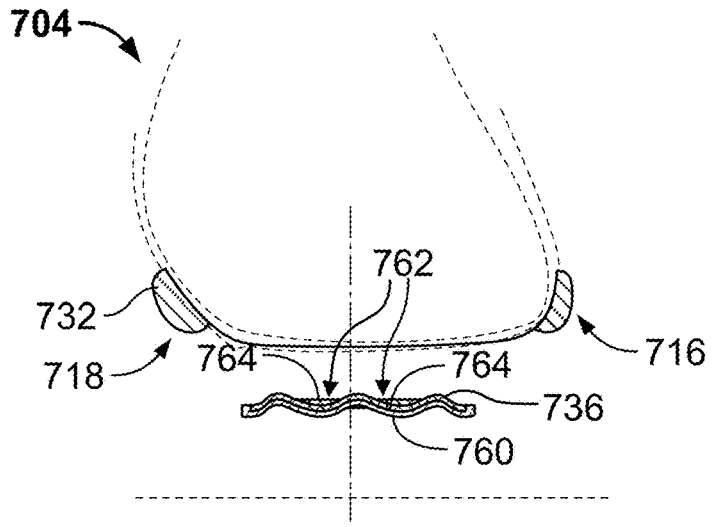
FIG. 83 is a cross-sectional view of the sole structure of FIG. 77 taken along line 82-82 thereof.
Figure 84:
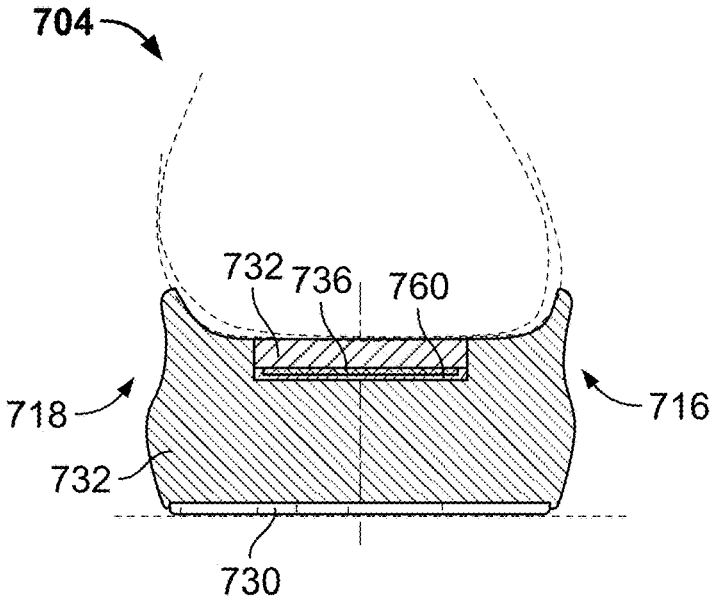
FIG. 84 is a cross-sectional view of the sole structure of FIG. 77 taken along line 83-83 thereof.
Figure 85:
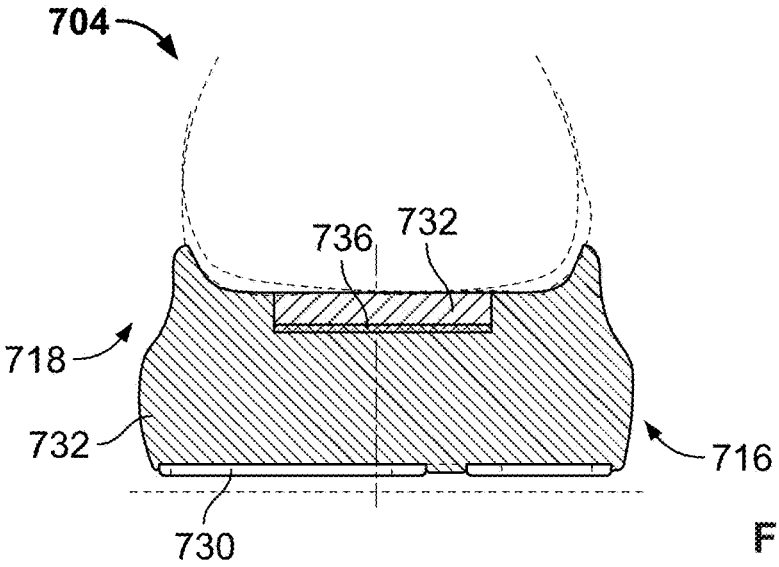
FIG. 85 is a cross-sectional view of the sole structure of FIG. 77 taken along line 84-84 thereof.

The sole structure 704 includes an outsole 730, a first cushioning member 732, a second cushioning member 734, and a sole plate 736 (see FIG. 79). The outsole 730 may define a bottom end or surface of the sole structure 704 across the heel region 712, the midfoot region 710, and the forefoot region 708.

The first cushioning member 732 may be positioned adjacent to and on top of the outsole 730 in the heel region 712. The first cushioning member 732 may also be positioned adjacent to and below the sole plate 736. The first cushioning member 732 may include one or more longitudinal grooves or flex lines 738 that extend between the medial side 716 and the lateral side 718, which segments the first cushioning member 732 in the heel region 712.

The second cushioning member 734 may be positioned adjacent to and on top of the outsole 730 in the midfoot region 710 and forefoot region 708. As will be further discussed herein, the sole plate 736 may also bifurcate the second cushioning member 734, such that the sole plate 736 is positioned within the second cushioning member 734 (see FIG. 79). Further, the sole plate 736 may also bifurcate the first cushioning member 732, such that the sole plate 736 is positioned within the first cushioning member as well (see FIG. 79).

The first cushioning member 732 and/or the second cushioning member 734 may be individually constructed from similar materials to the first and second cushioning members of the other embodiments.

The sole structure 704 also includes the sole plate 736, which as best shown in FIG. 79, includes a curved portion 750 and a rear portion 752, which may be relatively planar. The curved portion 750 may also include an anterior curved portion 754 and a posterior curved portion 756. The anterior curved portion 754 and the posterior curved portion 756 may each individually include one or more radii of curvature.

With reference to FIG. 79, the curved portion 750 of the plate 736 may be positioned within the second cushioning member 734 and the rear portion 752 of the plate 736 may be positioned above the first cushioning member 732. Further, a portion of the posterior curved portion 756 may extend between a gap 758 between the first cushioning member 732 and the second cushioning member 734. In some embodiments, the sole plate 736 has a uniform thickness. For example, in particular embodiments, the thickness is approximately 1.2 centimeters.

In some embodiments, the sole plate 736 comprises a PU plastic, such as a thermoplastic polyurethane (TPU) material, for example. Other thermoplastic elastomers consisting of block copolymers are also possible. In other embodiments, the sole plate 736 can include carbon fiber, for example.

As briefly noted herein, in some embodiments, the outsole 730 or the ground-engaging surface is not continuous along the article of footwear 700. For example, as best shown in FIG. 79, there is a spacing or gap 758, or an absence of a ground-engaging surface, along the article of footwear 700, which is located within the midfoot region 710 of the article of footwear 700.

Similar to the sole structures 504, 604, the sole structure 704 may also include a second plate 760. In the particular embodiment shown in FIGS. 76-85, the second plate 760 partially encases the sole plate 736 such that the sole plate 736 sits within the second plate 760. Additionally, as best shown in FIG. 79, the second plate 760 extends across the midfoot region 710 and the heel region 712. Thus, the second plate 760 is only positioned below the sole plate 736 across a portion of the sole plate 736, and more particularly, the arch or midfoot region thereof. In other embodiments, as previously discussed herein, the second plate 760 may extend across an entire length of the sole plate 736 or may be positioned at a location along the sole structure 704 where the sole plate 736 needs targeted structural support. The second plate 760 may be constructed from similar materials to the sole plate 736, which have already be discussed herein. However, in particular embodiments, the material used to construct the second plate 760 may differ from the material used to construct the sole plate 736 such that the second plate 760 provides added reinforcement to the sole plate 736. For example, in one embodiment, the sole plate 736 may be constructed from a carbon fiber material and the second plate 760 may be constructed from thermoplastic polyurethane (TPU) to support the sole plate 736. Additionally, the second plate 760 may support the structural integrity of the sole plate 736 and prevent the sole plate 736 from fracturing during use thereof.

Figure 86:
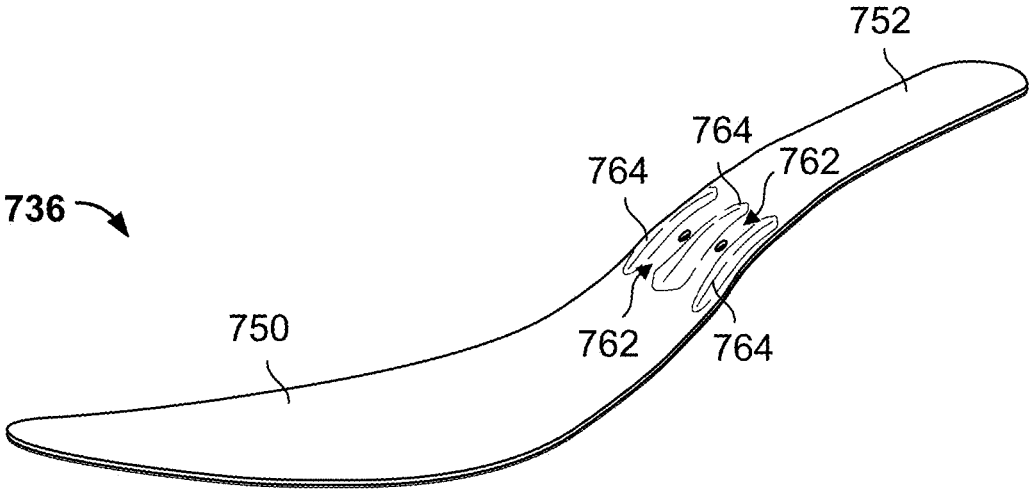
FIG. 86 is an isometric view of the sole plate for use with the sole structures of FIG. 56, 66, or 76.
Figure 87:
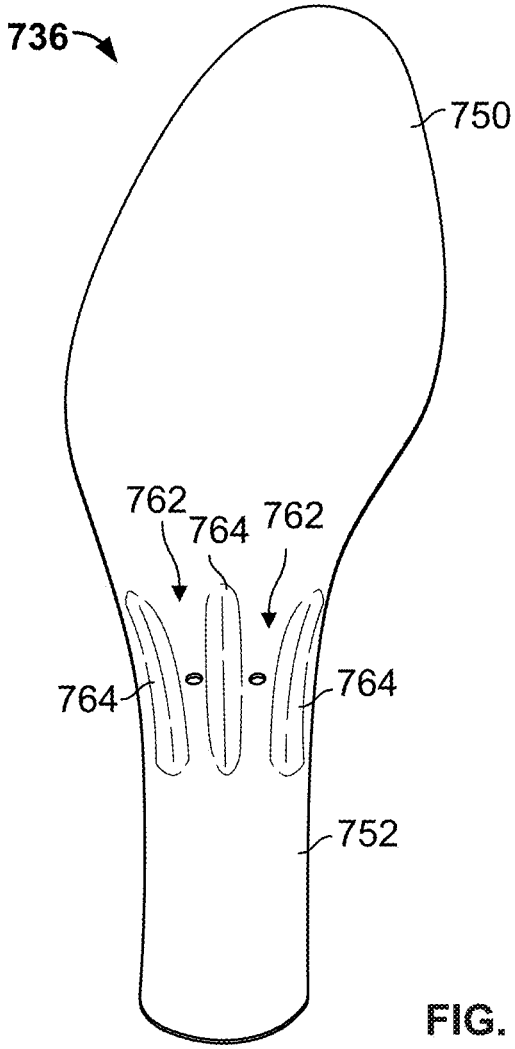
FIG. 87 is a top plan view of the sole plate of FIG. 86.

In addition to the second plate 760, an amount of material may be injected into one or more grooves of the sole plate 736. More particularly, in this embodiment, the sole plate 736 may include two grooves 762 formed from a plurality of raised portions 764 (see FIGS. 83, 86, and 87), and material 766 may be injected or positioned within the grooves 762. Similar to the second plate 760, the material injected into the grooves 762 may provide further structural support to the sole plate 736 and targeted support to the sole plate 736. For example, in this particular embodiment, the grooves are provided across the midfoot or arch region of the sole structure 704, and therefore, the material 766 may provide support to the sole plate 736 in the arch region thereof, which thereby provides further support to a user's foot in the arch region of the sole structure 704. The injected material 766 may be a suitable plastic material, such as thermoplastic polyurethane (TPU) or the like.

Figure 88:
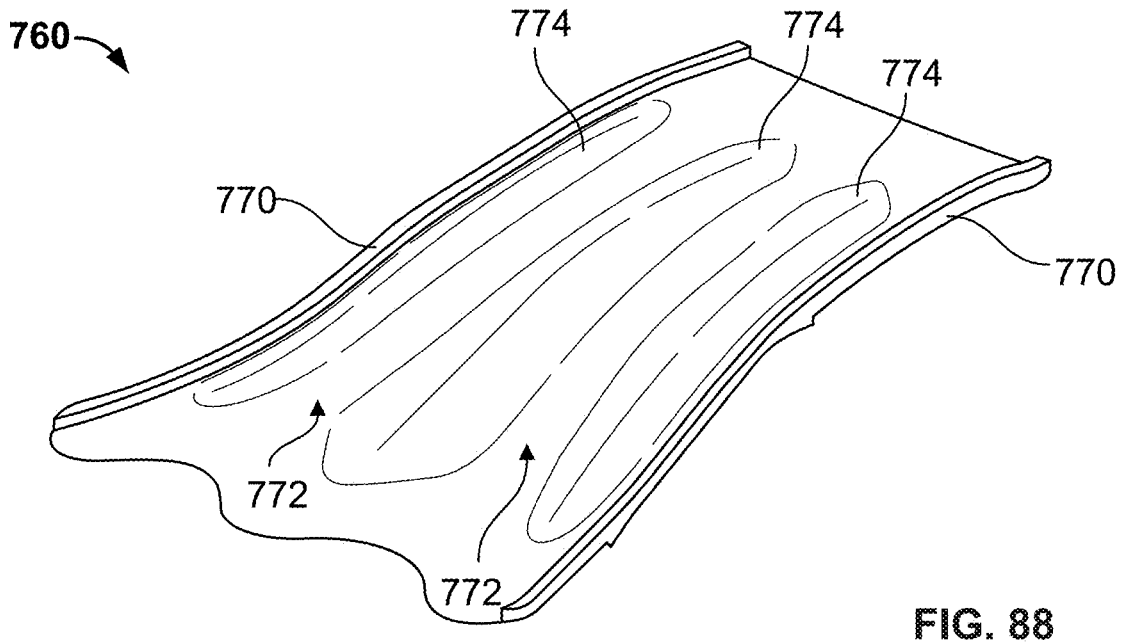
FIG. 88 is an isometric view of another plate for use with the sole structures of FIGS. 66 and 76.
Figure 89:
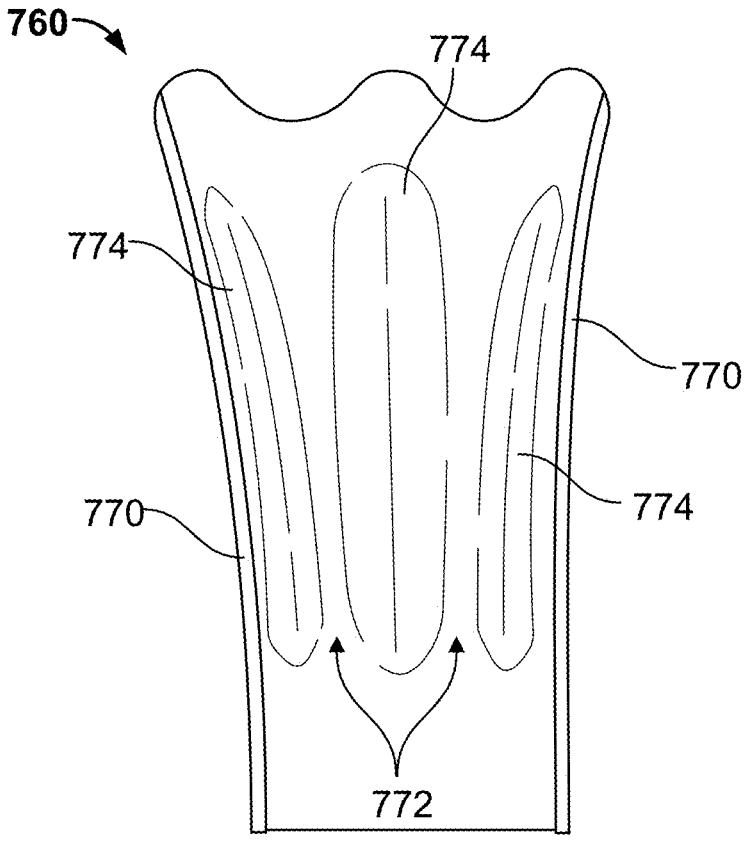
FIG. 89 is a top plan view of the plate of FIG. 88.

FIGS. 88 and 89 depict the second plate 760 of the present embodiment. Further, as discussed herein in connection with several embodiments, the second plates 560, 660, 760 may encase the sole plates 536, 636, 736. To perform this function, the second plate 560, 660, 760 may include outer walls or sidewalls 570, 670, 770 that extend upward from the main body of the second plate 560, 660, 760. Additionally, the second plate 560, 660, 760 may include a shape that conforms to the shape of the sole plate 536, 636, 736. For example, as best shown in FIGS. 88 and 89, the second plate 760 may include a plurality of raised portions 772 and grooves 774 that conform with the plurality of raised portions 764 and grooves 762 of the sole plate 736.

EXAMPLES

The examples herein are intended to illustrate certain embodiments of the articles of footwear and sole structures discussed herein to one of ordinary skill in the art and should not be interpreted as limiting in the scope of the disclosure set forth in the claims. The articles of footwear and sole structures of the present disclosure may comprise the following non-limiting examples.

Example 1

Figure 90:
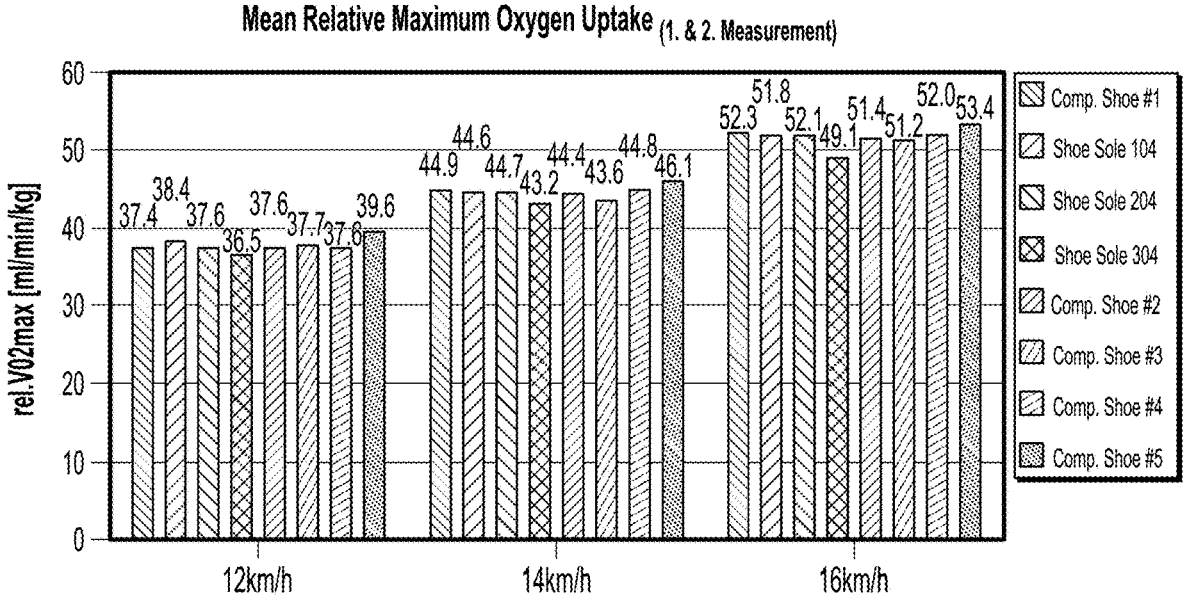
FIG. 90 schematically depicts a mean relative maximum oxygen uptake relative to a velocity of a runner, according to one or more aspects described herein.

Several studies were conducted to assess the performance of the sole structures discussed herein in comparison to other comparative sole structures. First, a mean relative maximum oxygen uptake for a subject wearing the sole structures 104, 204, 304 was measured and compared to the mean relative maximum oxygen uptake of the subject wearing comparative sole structures. These measurements were performed while the subject was running on a treadmill at various speeds, including 12 km/h, 14 km/h, and 16 km/h. The results of this study are shown in FIG. 90.

Oxygen uptake or consumption is a measure of a person's ability to take in oxygen and deliver it to the working tissues of an athlete's body, but a lower mean relative maximum oxygen uptake equates to more efficient running. In other words, if a runner is more efficient by way of a more efficient and effective shoe sole, for example, the runner needs a lower amount of oxygen, and therefore, the runner would exhibit a lower mean relative maximum oxygen uptake. With reference to FIG. 90, the sole structure 304 consistently had the lowest mean relative maximum oxygen uptake compared to other comparative soles across all speeds. However, at the higher speed of 16 km/h, the difference between the oxygen uptake values were accentuated and the article of footwear utilizing the sole structure 304 exhibited a mean relative maximum oxygen uptake of 49.1 ml/min/kg, which was far less than the other shoes having values greater than 51 ml/min/kg. The other sole structures 104, 204 also exhibited very low oxygen uptake values in comparison to several of the comparative shoes. These results exhibit the improved efficiency the sole structures 104, 204, 304 can provide to a runner or athlete.

Example 2

Next, a mean heartrate of a subject wearing a shoe having the sole structures 104, 204, 304 was measured and compared to the heartrate of the subject wearing comparative sole structures. These measurements were performed while the subject was running on a treadmill at various speeds, including 12 km/h, 14 km/h, and 16 km/h.

Figure 91:
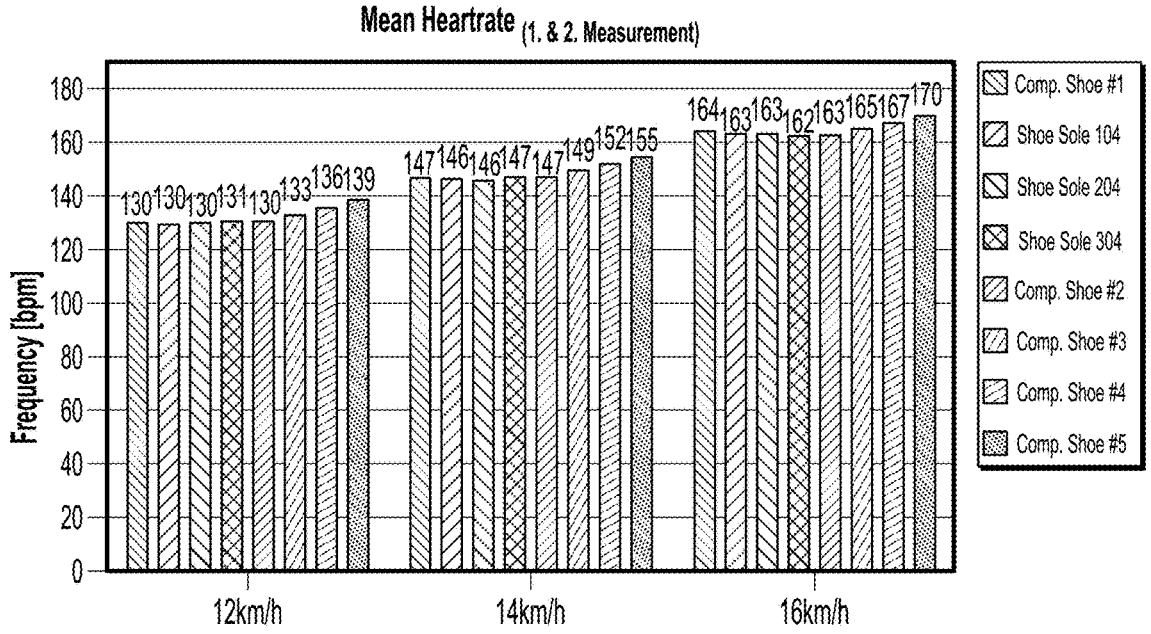
FIG. 91 schematically depicts a mean heart rate relative to velocity of a runner, according to the aspects described herein.

The heartrate of a subject, like oxygen uptake, can be a measure of the efficiency of a runner and the efficiency of a sole structure worn by a runner. For example, if a runner is more efficient by way of a more efficient and effective sole structure, for example, the runner would have a lower mean heartrate. With reference to FIG. 91, a runner wearing each sole structure 104, 204, 304 had a lower heartrate compared to several comparative shoe soles, which exhibits the improved efficiency imparted on a runner wearing a shoe having the sole structures 104, 204, 304.

Example 3

Figure 92:
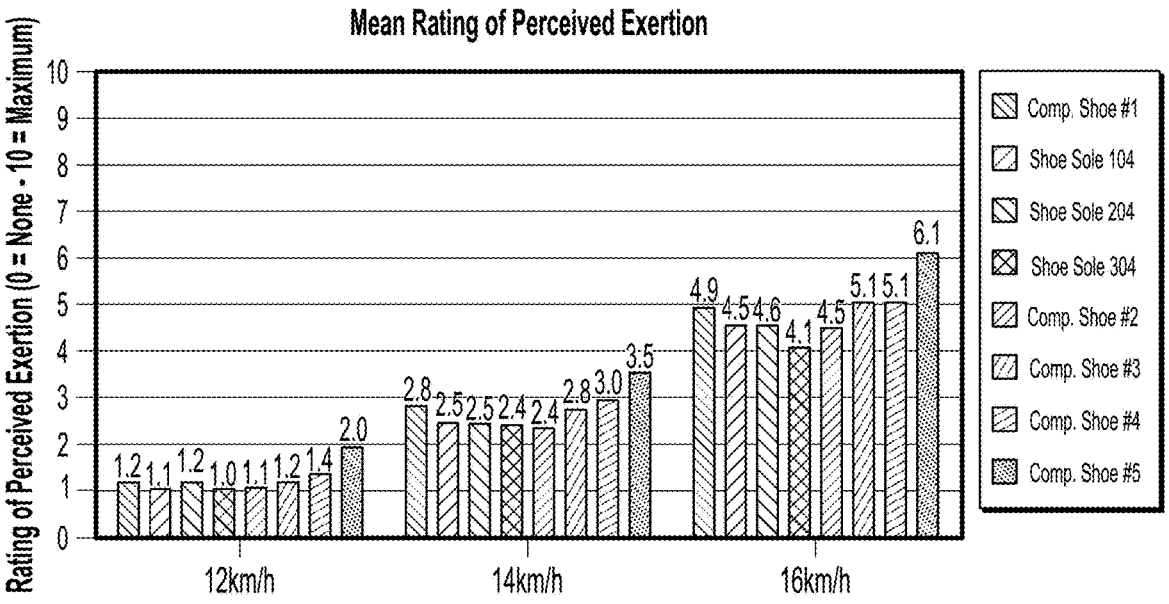
FIG. 92 schematically depicts a mean rating of perceived exertion relative to a velocity of a runner, according to the aspects described herein.

The perceived exertion of the subjects was also documented after a subject ran on a treadmill at several speeds, including 12 km/h, 14 km/h, and 16 km/h. More particularly, a subject was asked to run at a speed of 12 km/h, for example, and then asked to provide a rating of perceived exertion from a zero to ten scale with zero indicating no perceived level of exertion and ten indicating a very high level of perceived exertion by the subject. These values were documented for articles of footwear having the sole structures 104, 204, 304, compared with several comparative shoe soles, and then graphed. The results of this experiment are shown in FIG. 92, and as shown in FIG. 92, runners or subjects consistently provided low ratings for articles of footwear having the sole structures 104, 204, 304. In particular, subjects consistently provided the lowest mean rating of perceived exertion for the sole structure 304 compared to the other sole structures, which shows the beneficial experience subjects or runners have with the sole structure 304 during use thereof.

Example 4

Figure 93:
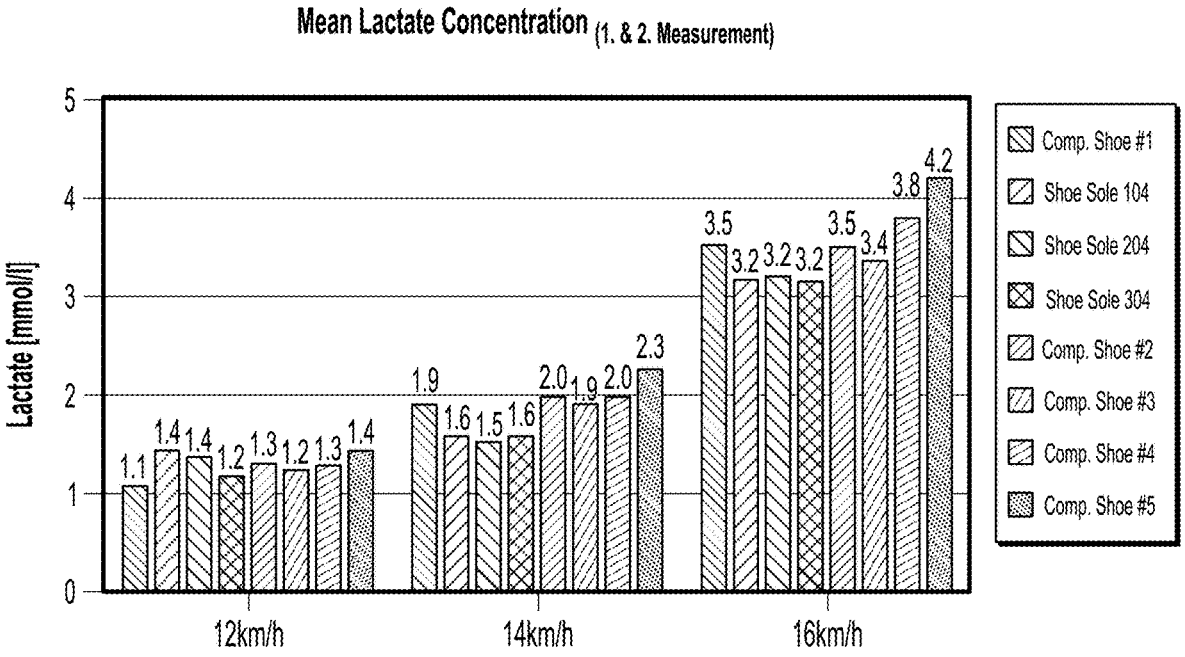
FIG. 93 schematically depicts a mean lactate concentration relative to a velocity of a runner, according to the aspects described herein.

The mean lactate concentration for a subject wearing the sole structures 104, 204, 304 was also measured and compared to the lactate concentration of a subject or runner wearing articles of footwear with comparable sole structures. These measurements were performed while the subject was running on a treadmill at various speeds, including 12 km/h, 14 km/h, and 16 km/h. The results of this study are shown in FIG. 93.

Blood lactate levels can serve as an indirect marker for biochemical events, such as fatigue within exercising muscle. Further, the concentration of blood lactate is usually 1-2 mmol/L at rest, but can rise to greater than 20 mmol/L during intense exertion. In short, the higher lactate concentration within the blood is an indication of fatigue for a runner. Therefore, lower lactate concentrations are desired because lower lactate concentrations indicate more efficient running and a more efficient sole structure that provides a higher level of performance to a runner. With reference to FIG. 93, each sole structure 104, 204, 304 performed exceptionally compared to other sole structures and provided low lactate concentrates compared to the other tested sole structures. As previously discussed herein, higher speeds (such as 16 km/h) can provide clearer data and more accentuated differences between the sole structures, and looking to the data collected at a running speed of 16 km/h, the sole structures 104, 204, 304 each registered lactate concentrations of about 3.2 mmol/l, which were significantly lower than the other comparable sole structures. As should be understood by one of ordinary skill in the art, these differences in lactate concentration (or decrease in lactate formation) can have a drastic and positive impact on runners during training, recovery, and performance activities, especially athletes or runners in endurance sports (e.g., marathon runners).

Example 5

Figure 94:
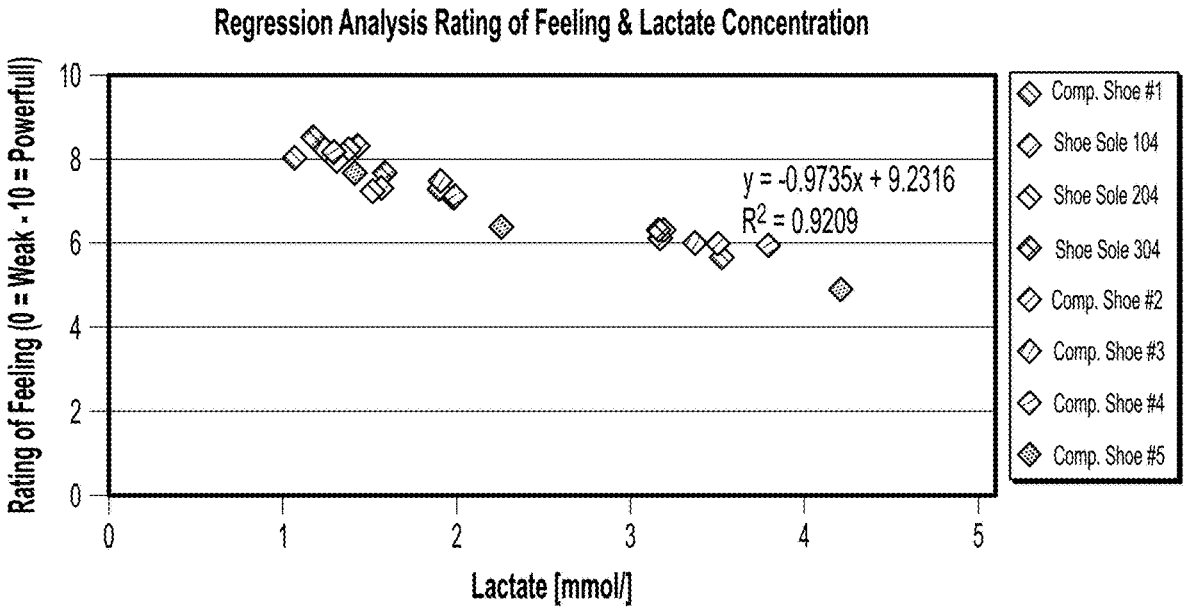
FIG. 94 schematically depicts a regression analysis comparing a rate of feeling to a lactate concentration, according to the aspects described herein.

In addition to measuring a lactate concentration of a subject or runner, a regression analysis rating of feeling and lactate concentration was performed. More particularly, for each sole structure, the subject or runner provided a perceived level of exhaustion using a zero to ten scale, with zero indicating no perceived level of exhaustion and ten indicating a very high level of exhaustion. Then these values were graphed with the lactate concentrations collected from Example 4 previously discussed herein. Specifically, for each speed and for each sole structure, the perceived levels of exhaustion for a runner were placed on a y-axis and their lactate concentrations were placed on the x-axis. This graph is shown in FIG. 94 and a regression analysis was performed to determine the statistical link between blood lactate concentration levels and perceived levels of exhaustion. After performing the regression analysis, the graph of FIG. 94 had an R-squared value of 0.92, thereby showing a strong statistical link between how tired runners felt and their lactate concentration in their blood.

Any of the embodiments described herein may be modified to include any of the structures or methodologies disclosed in connection with different embodiments. Further, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. An article of footwear having a sole structure and an upper, the sole structure comprising:

an outsole having a ground-engaging surface;

a first cushioning member disposed between the outsole and the upper in a heel region of the sole structure;

a second cushioning member disposed between the outsole and the upper in a forefoot region of the sole structure; and a sole plate having a rear portion and a curved portion that includes an anterior curved portion and a posterior curved portion, wherein the first cushioning member is spaced apart from the second cushioning member by a gap that extends between the first cushioning member and the second cushioning member, wherein the anterior curved portion is disposed proximate the second cushioning member, a portion of the posterior curved portion spans between the first cushioning member and the second cushioning member, and the rear portion is disposed between the first cushioning member and the upper, wherein the ground-engaging surface is not continuous along a midfoot region of the article of footwear, and wherein the sole plate is positioned within the second cushioning member and extends across the gap to the first cushioning member.

2. The article of footwear of claim 1, wherein a portion of the midfoot region of the sole structure consists of the sole plate.

3. The article of footwear of claim 1, wherein the sole structure further includes a second plate.

4. The article of footwear of claim 3, wherein the second plate includes sidewalls and wherein the second plate encases the sole plate.

5. The article of footwear of claim 3, wherein the sole plate includes a plurality of raised portions and grooves.

6. The article of footwear of claim 5, wherein a material is positioned within the grooves of the sole plate.

7. The article of footwear of claim 6, wherein the material is thermoplastic polyurethane.

8. The article of footwear of claim 7, wherein the sole plate is constructed from a carbon fiber and the second plate is constructed from thermoplastic polyurethane.

9. The article of footwear of claim 1, wherein the first cushioning member extends from a first end positioned at a heel end of the structure to a second end positioned in the midfoot region; and wherein the second cushioning member extends from a third end positioned at a toe end of the sole structure to a fourth end portion positioned in the midfoot region.

10. The article of footwear of claim 9, wherein the gap extends along a non-linear path from a lateral side of the sole structure to the medial side of the sole structure so that the first cushioning member is spaced apart from the second cushioning member in the midfoot region.

11. An article of footwear having a sole structure and an upper, the sole structure comprising:

a first cushioning member positioned in a heel region of the sole structure;

a second cushioning member positioned in a forefoot region of the sole structure; and a first plate continuously extending from the heel region, a midfoot region, and the forefoot region of the sole structure, wherein a gap extends between the first cushioning member and the second cushioning member so that the first cushioning member is spaced apart from the second cushioning member by the gap, and the plate extends between the gap, and wherein the first plate is positioned within the second cushioning member.

12. The article of footwear of claim 11, wherein the first plate is positioned above the first cushioning member in the heel region of the sole structure.

13. The article of footwear of claim 12, wherein a gap extends between the first plate and the upper in the midfoot region of the sole structure.

14. The article of footwear of claim 13, wherein the sole structure further includes an outsole, and wherein a portion of the second cushioning member extends between the outsole and the first plate in the forefoot region of the sole structure and the first cushioning member extends between the first plate and the outsole in the heel region of the sole structure.

15. The article of footwear of claim 11, wherein the first plate is positioned within the second cushioning member and is positioned within the first cushioning member such that the first plate bifurcates the second cushioning member and the first cushioning member.

16. The article of footwear of claim 15, wherein the sole structure further includes an outsole, and wherein a portion of the first cushioning member extends between the first plate and the outsole in the heel region of the sole structure and a portion of the second cushioning member extends between the first plate and the outsole in the forefoot region of the sole structure.

17. The article of footwear of claim 16, wherein the sole structure further includes a second plate having sidewalls that encase the first plate.

18. The article of footwear of claim 17, wherein the first plate includes a plurality of raised portions and grooves.

19. The article of footwear of claim 18, wherein a material is positioned within the grooves of the first plate.

20. An article of footwear having a sole structure and an upper, the sole structure comprising:

an outsole having a ground-engaging surface;

a first cushioning member disposed in a heel region of the sole structure;

a second cushioning member disposed in a forefoot region of the sole structure;

a first plate having a rear portion and a curved portion that includes an anterior curved portion and a posterior curved portion; and a second plate having a base and sidewalls that extend therefrom, the second plate being shaped in conformity with the first plate so that the first plate sits within the second plate, wherein the anterior curved portion is disposed proximate the second cushioning member, a portion of the posterior curved portion spans between the first cushioning member and the second cushioning member, and the rear portion is disposed between the first cushioning member and the upper, wherein the first plate includes a plurality of raised portions and a plurality of grooves, and wherein a material is positioned within the grooves of the first plate.

* * * * *